US005190276A

United States Patent [19]

Namba et al.

[11] Patent Number: 5,190,276

[45] Date of Patent: Mar. 2, 1993

[54] SHEET FEEDING APPARATUS

[75] Inventors: Toyoaki Namba, Nara; Kazuaki Karasuda, Yamatokoriyama; Osamu Wakuda, Yamatotakada; Hiranaga Yamamoto, Yamatokoriyama, all of Japan

[73] Assignee: Sharp Kabushiki Kaisha, Osaka, Japan

[21] Appl. No.: 668,259

[22] Filed: Mar. 12, 1991

[30] Foreign Application Priority Data

Mar. 13, 1990 [JP] Japan ..... 2-62205
Mar. 20, 1990 [JP] Japan ..... 2-70915

[51] Int. Cl.[5] ..... B65H 5/08

[52] U.S. Cl. ..... 271/13; 271/15; 271/94; 271/99; 271/104; 271/105; 271/108

[58] Field of Search ..... 271/6, 7, 11, 13, 15, 271/16, 17, 20, 94, 98, 99, 104, 105, 108

[56] References Cited

U.S. PATENT DOCUMENTS

| | | | |
|---|---|---|---|
| 3,198,514 | 8/1965 | Barbara et al. | 271/12 |
| 4,168,829 | 9/1979 | Wilson et al. | 271/108 |
| 4,184,672 | 1/1980 | Watkins et al. | 271/108 X |
| 4,236,710 | 12/1980 | Nakamura et al. | 271/108 |
| 4,279,381 | 11/1981 | Smith | 271/108 X |
| 4,299,406 | 5/1981 | Hamlin | 271/108 |
| 4,418,905 | 12/1983 | Garavuso | 271/98 |
| 4,451,028 | 5/1984 | Holmes et al. | 271/108 X |
| 4,566,683 | 1/1986 | Moore | 271/108 X |
| 4,635,921 | 1/1987 | Thomas | 271/94 |
| 4,678,176 | 7/1987 | Roller | 271/94 |
| 4,699,369 | 10/1987 | Zirilli | 271/105 X |

FOREIGN PATENT DOCUMENTS

| | | | |
|---|---|---|---|
| 55-19859 | 5/1980 | Japan . | |
| 0149250 | 8/1984 | Japan | 271/11 |
| 0254439 | 11/1986 | Japan | 271/97 |
| 0088734 | 4/1987 | Japan | 271/108 |
| 0088735 | 4/1987 | Japan | 271/108 |

*Primary Examiner*—H. Grant Skaggs
*Assistant Examiner*—Carol Lynnn Druzbick
*Attorney, Agent, or Firm*—David G. Conlin; Donald R. Castle

[57] ABSTRACT

The intermediate tray of a copying machine for copying on both sides of recording paper or recording paper feeding apparatus incorporates a mechanism for loosening and separating recording papers by air blow in order to prevent duplicate feed. Conventionally, such constitution could not be commonly applied to recording papers of plural sizes, and the recording paper vibrated due to the air flow to give off a loud noise. In the invention, the air flow is formed by plural nozzles arranged in the widthwise direction of the recording paper, and the nozzles near the both ends are controlled by opening and closing depending on the paper size. When the recording paper is conveyed by vacuum attracting to the belt, the recording paper is attracted closely to the belt, eliminating the space for allowing the air flow to enter in, so that vibration may be prevented.

10 Claims, 41 Drawing Sheets

SHEET FEEDING APPARATUS

BACKGROUND OF THE INVENTION

1. Field of the Invention

The present invention relates to a sheet feeding apparatus such as recording paper feeding apparatus and intermediate tray of a copying machine for both side of paper for feeding one sheet each by separating from a stacked state of sheets, regardless of the sheet size, when sheets of single-form documents or recording paper are used in plural sizes in a copying machine or the like.

2. Description of the Prior Art

In a copying machine equipped with a recirculating document handler (RDH) for stacking up documents of single form in a plurality, separating and feeding the documents one by one from the top side or bottom side, and returning to the stacked position after reading the documents in the bottom side or top side, a sheet feeder is used, such as the feeding apparatus of documents and the feeding apparatus of separating and feeding the stacked recording sheets one by one. In printing apparatus and photographic printing device, too, an apparatus for separating and feeding stacked recording papers is employed. In such paper feeding device, it is necessary to separate the stacked sheets one by one, and various separating methods are known, such as the air flow separating method, separating claw method, and method for separating sheets by using a roller rotating in a reverse direction of sheet feeding direction.

As an example of the prior art of separating sheets by using air flow, "the sheet feeding apparatus" is disclosed in the Japanese Laid-open Patent No. 58-78932, and a similar structure is found in the U.S. Pat. No. 3,198,514 or the Japanese Patent Publication No. 55-19859. The structure is shown in FIG. 1, a side view, and in FIG. 2, a plan view. This composition is, for example in a copying machine of RDH method, a paper feeding 1 for feeding by separating the stacked recording papers one by one. The paper feeder 1 is provided with a support tray 3 on which recording papers 2 are stacked up.

At the downstream side of the feeding direction A1 of the recording paper 2 and near the middle of the widthwise direction of the support tray 3 intersecting with the feeding direction A1, a notch 4 is formed, and a feed belt 7 stretched on a pair of rotating rollers 5, 6 disposed beneath the support tray 3 and having many penetration holes formed is exposed at this notch 4. Between the rotating rollers 5, 6 is arranged an air intake duct 8 opposite the notch 4 across the feed belt 7, and the recording paper 2 on the support tray 3 is attracted by vacuum to the feed belt 7, and is fed in the feeding direction A1 by running and driving of the feed belt 7.

On the other hand, since there is a possibility that plural recording papers 2 on the support tray 3 be attracted and fed together by the feed belt 7, an air injection duct 9 is disposed above the downstream side of the feeding direction A1 from the support tray 3, and nozzles **10*b* to 10*e* parallel to the feeding direction A1, and plural nozzles 10*a*, 10*f* directed toward the middle of the widthwise direction are communicated. On the other hand, the support tray 3 has a base part 5 in an extended shape from the downstream side to the upstream side of the feeding direction A1, and a side wing parts 15, 16 formed obliquely upward from the both sides of the widthwise direction of the base part 14, as shown in FIG. 3**

The air injection duct 9 and support tray 3 in this prior art are arranged as shown in FIG. 1, and the air stream in a flat shape is concentrated near the middle position in the widthwise direction of the support tray 3 by the nozzles **10*a* to 10*f*. This state of distribution of air stream by the air injection duct 9 is indicated in the shaded area in FIG. 4**.

This prior art is capable of separating the recording papers 2 favorable as far as the size of the recording papers 2 is relatively small or the weight is relatively large.

However, in the case of recording paper of relatively large size or small weight, or therefore in the case of recording paper of weak consistency, favorable separation may not be always possible. That is, in this prior art, by concentrating the air stream near the middle portion of the widthwise direction of the support tray 3, the air stream is inflated in the vertical direction near the middle position to realize the action of separating the recording papers. On the other hand, in the recording paper of large size or small weight, not only the lowermost recording paper but also plural recording papers are deformed with a relatively large deflection, in a recess 19 formed by the base part 15 and side wing parts 15, 16 of the support tray 3, in a shape corresponding to the pattern of the recess, and the gap for entry of air stream is hardly formed among the recording papers, and separation of recording papers may be sometimes unsuccessful.

Or among the recording papers indicated in the shaded area in FIG. 4, the area of separation region 17 mutually separated by entry of air from the air injection duct 9 becomes relatively smaller than the area of the non-separating region 18 where the recording papers adhere with each other, and therefore when the lowermost recording paper is attracted in vacuum by the conveying belt 7 and conveyed, duplicate feed may occur due to the frictional force in the non-separating region 18. At this time, in order to extend the separating region 17, when nozzles **10*g*, 10*h* indicated by double point chain line in FIG. 2 are disposed further outward in the widthwise direction of the nozzles 10*a*, 10*f* in the air injection duct 9 so as to be directed outward in the widthwise direction, in the case of recording paper 2 of which width W1 is smaller than the interval L11 shown in FIG. 2 between the nozzles 10*g*, 10*b*, the air stream from the nozzles 10*g*, 10*h* collides against the both ends 2*a*, 2*b* in the widthwise direction of the recording paper, and these end parts 2*a*, 2*b* come to flap. In this case, the stacked state of the recording papers 2 piled up in the paper feeder 1 is disturbed, and duplicate feed or defective feed may take place. Or when the recording paper 2 is relatively small in size, the separation capacity due to the air stream concentrated by the nozzles 10*a* to 10*f* is excessive, and the recording papers of small size may scatter about in the paper feeder 1**.

In the prior art, therefore, although the separating capacity is relatively favorable as far as the recording paper is limited in type, separation failure or feeding failure may occur from the viewpoint of versatility of separating recording papers in a wide variety of sizes effectively, and it is not sufficient in versatility, and the sheet feeding apparatus with versatility having the favorable separating capacity in a wide range of size and weight of recording paper is desired.

Usually, an electrophotographic apparatus such as copying machine and laser printer possesses a transfer unit composed of photosensitive material and transfer charger, and in this transfer unit, the image of the photosensitive material is transferred on one side of the recording paper contacting with the photosensitive material.

Incidentally when the recording paper is passed twice in the transfer unit so that the same side of the recording paper makes contact with the photosensitive material, a composite copy of obtaining an image synthesize on the same side of the recording paper is realized. On the other hand, when the recording paper is passed in the transfer unit so that one side and other side of the recording paper may contact with the photosensitive material sequentially, a two-sided copy of forming images on both sides of the recording paper is realized.

Generally, an electrophotographic apparatus capable of executing such composite copy or two-sided copy is equipped with a circulating route capable of transferring the recording paper repeatedly in the transfer unit, and this circulating route is composed of the transfer unit, conveying roller and other rollers, inverting claw, switchback part, and intermediate tray for temporarily storing the recording paper on which visible image is transferred on one side thereof. They interact to realize favorable composite copy or two-sided copy.

Such composite copy and two-sided copy are desired to be capable of performing plural times continuously for the sake of improving the working efficiency. Therefore, the intermediate tray is designed to store plural recording papers, and conventionally, in the paper feeding portion from the intermediate tray, the recording papers are taken out sequentially from the bottom side while blowing air and separating the recording papers.

In the conventional intermediate tray, however, when taking out the recording papers, scatter of recording paper due to air blow or defective biting into paper feed roller may occur.

More specifically, the recording paper conveyed in the circulation route is heated at the fixing unit in order to fix the image transferred in the transfer unit. At this time, the recording paper is often curled downward at the end portion due to massive heat, and the curved recording papers are stacked up on the intermediate tray. This curling will form a space between the recording papers and the intermediate tray, and this space may cause to scatter about the recording papers when air is blown in. This scattering of recording papers by air is particularly obvious when the number of recording papers is not enough to suppress this space by the own weight of the recording papers. Furthermore, the curling may cause defective biting such as folding at the curved part when held between the paper feed rollers.

SUMMARY OF THE INVENTION

It is hence a primary object of the invention to solve the above technical problems and present an improved sheet feeding apparatus possessing a favorable separating and feeding capacity for sheets in a wide variety of types and sizes.

As mentioned above, in the conventional intermediate tray, scattering or biting failure of recording papers could be caused by curling of recording papers. In the invention, therefore, by eliminating curling at the time of feeding, it is intended to present a sheet feeding apparatus capable of feeding sheets favorable while preventing scattering or defective biting of recording papers.

To achieve the above object, the invention presents a sheet feeding apparatus comprising:

a laying plate on which plural sheets are stacked up and laid down, a feeding means for feeding the lowermost or uppermost sheet by attracting in vacuum, out of stacked-up sheets, being disposed beneath or above the sheets, an air stream forming means for injecting plural air streams in the widthwise direction of the laying plate, toward the feeding means and toward the end part vicinity of the stacked-up sheets, being disposed at the downstream side of the feeding direction of the laying table, and the air stream flow rate control means for controlling the air flow of the outward air stream, out of the plural air streams disposed in the widthwise direction of the laying plate.

In the invention, the air stream forming means comprises a nozzle member for injecting air from one or plural nozzle holes disposed for every air stream, and the air stream flow rate control means comprises:

a valve for opening and closing the nozzle hole, and a opening and closing means for opening and closing the nozzle hole by driving and displacing the valve.

In the invention, the opening and closing means comprises:

a plunger coupled with the valve, and an electromagnetic solenoid for driving the plunger.

The invention further comprises detecting means for detecting the size of the sheets being stacked up in the widthwise direction, and control means for controlling the electromagnetic solenoid in response to the output of the detecting means to open or close the nozzle hole by the valve depending on the size of the sheet width.

The invention also comprises a lateral end defining member movable in the widthwise direction so as to align the lateral ends of the sheets stacked up on the laying plate, wherein the opening and closing means cooperates with the lateral end defining member and opens or closes the nozzle hole by the valve depending on the size of the sheet width.

The invention furthermore comprises a lateral end defining member movable in the widthwise direction so as to align the lateral ends of the sheets stacked up on the laying plate, wherein the air stream forming means possesses a nozzle member for injecting air from one or plural nozzle holes disposed for every air stream, and the lateral end defining member has a shut-off piece located opposite to the exit end of the nozzle hole in the case of the small sheet width.

The invention has the laying plate composed mirror-symmetrically with respect to the symmetric plane passing the central position in the widthwise direction, wherein the air stream forming mean injects an air stream from each of the symmetrical positions with respect to the symmetric plane, and the air stream flow control means controls simultaneously the flow rate of both outward air streams in the widthwise direction of the air streams.

According to the invention, the laying plate possesses a nearly horizontal central laying part and side laying parts extending to both sides in the widthwise direction from the central laying part, the end portion of the downstream side of the feeding direction of the central laying part has a notch formed in the laying plate located at the upstream side in the feeding direction from the end part of the downstream side in the feeding direction of the side laying part, and the feeding means for feeding the lowermost sheet of the stacked-up sheets faces to the notch, the air stream forming means composes a first air stream injected toward the boundary of the central laying part and side laying part of the laying plate, and a second air stream injected outward of both sides in the widthwise direction, being disposed outward of both sides in the widthwise direction of the first air stream, and the air stream control means controls the flow rate of the second air stream.

According also to the invention, the feeding means is located above the stacked-up sheets, and means for injecting the air for lifting the sheets is disposed toward the end portion of the downstream side of the feeding direction of the stacked-up sheets.

To solve the above problems, moreover, the invention presents the sheet feeding apparatus which feeds from the lowermost sheet while separating the sheets by blowing air to the stored sheets, by temporarily storing plural sheets in the circulating route in an electrophotographic apparatus capable of performing composite copy and/or two-sided copy, wherein the sheet feeding apparatus comprises a stack tray for laying sheets on, and this stack tray is provided with bilateral end defining members composed of a pair of matching plates having lateral sides contacting against the both side ends of the sheets by moving in the widthwise direction of the stack tray, and a rear end defining member composed of a rear end plate having a lateral part contacting against the rear end of the sheet by moving in the paper feeding direction, and this stack tray further comprises attracting means composed of attracting belt and attracting duct having attracting holes for conveying the sheet in the feeding direction while attracting the sheet in the stack tray direction, and protrusions having a surface positioned above the surface of the attracting means for contacting against the sheet at the front end side of the feeding direction, wherein the attracting means operates prior to the blowing action.

According to the invention, of the plural sheets stacked up on the laying plate, the lowermost or uppermost sheet is attracted in vacuum by the conveying means and fed, and at this time in order to prevent simultaneous conveyance of plural sheets, the stacked-up sheets are separated up and down by the air from the air stream forming means, and are handled individually. This air stream forming means is located at the downstream side of the feeding direction of the laying plate, that is, in the forward position, and plural air streams are formed in the widthwise direction of the laying plate, and the air stream flow control means controls so as not to form the air stream at the outward side of the widthwise direction of the laying plate when the sheet width is small and the weight is generally light, thereby preventing disturbance of the stacked state of the sheets having small width, and controls to form an outward air stream in the widthwise direction when feeding wide sheets, thereby sufficiently separating vertically the wide sheets generally having a greater weight to handle separately, thus making it possible to feed one by one.

Thus, according to the invention, it is possible to feed sheets, from small width to large width, securely one by one regardless of the size.

Aside from the controlling whether or not to form the air stream outward in the widthwise direction, it is also possible to vary the flow rate of the air stream outward in the widthwise direction. For example, when feeding narrow sheets, the flow rate of the air stream outward in the widthwise direction is controlled to a small value other than zero by the flow rate control means, and when feeding side sheets, the flow rate of the air flow outward in the widthwise direction is increased. In this way, depending on the width of the sheet, that is, the size of the sheet, the flow rate of the air stream in the outward direction, that is, outward in the widthwise direction is controlled, and the sheets may be securely fed one by one regardless of the difference in size.

The air stream of which flow rate is controlled is the air stream of the outward side, of the plural air streams disposed in the widthwise direction of the laying plate, and the air stream thus controlled in flow rate does not depend on whether disposed at the outside of the widthwise direction of the laying plate or not, but it is the air stream of the outward side in the widthwise direction on both right and left sides disposed of the plural air streams for separating the sheets vertically.

According to the invention, the nozzle member possesses one or plural nozzle holes for every air stream, and the flow control means of the air stream comprises the valve for opening and closing the nozzle, and the opening and closing driving means for opening and closing the nozzle holes by driving the nozzle, and this opening and closing driving means comprises a plunger for driving the valve and an electromagnetic solenoid for driving the plunger. The flow rate control means of the air stream may be composed so as to be operated manually, or according to the invention it may be designed to control automatically by exciting/de-exciting the electromagnetic solenoid by detecting the magnitude in the widthwise direction of the sheets to be stacked up.

Moreover according to the invention, the opening and closing driving means for driving the valve in the air stream, flow rate control means cooperates with the lateral end defining means for aligning the lateral ends of the sheets stacked up on the lying plate.

In the invention, still more, instead of having a valve for opening and closing the nozzle holes, the air stream injected from the nozzle holes may be shut off by the shut-off means mounted on the lateral end defining means, so that supply of excessive air flow into the narrow sheet may be prevented.

Also in the invention, the laying plate is composed mirror-symmetrically, and the air stream is formed as being injected from symmetrical positions, and the air stream flow rate control means simultaneously forms the air streams on both outward sides in the widthwise direction, out of these air streams, and does not form the air streams on both outward sides of the widthwise direction, out of these air streams, thereby preventing the both lateral parts of the narrow sheet from flapping. Meanwhile, in the invention, one side of the sheets in the widthwise direction is aligned and defined in feeding, and therefore the central position of the sheets varies depending on the width of the sheet in the widthwise direction, according to other possible constitution.

Still more, conforming to the invention, the laying plate has a nearly horizontal middle laying part and lateral laying part stretching in both side ways in the widthwise direction, and a notch is formed in the central laying part, and the feeding means for feeding the lowermost sheet is opposite thereto, and therefore the lowermost sheet is fed as being attracted in vacuum by the feeding means, and at this time a first air stream is injected around the boundary of the central laying part and lateral laying part, and the first air stream is smoothly blown into the gap near the boundary of the lowermost sheet and the remaining sheets, and the lowermost sheet and the other sheets are smoothly separated vertically, so that the lowermost sheet may be securely fed one by one. Further outward on both sides in the widthwise direction of this first air stream, a second air stream is injected, and this second air stream is not formed by the flow rate control means when the sheet width is small, so that flapping of the both sides of the narrow sheets by the second air stream may be prevented. What is more, when feeding wide sheets, not only the first air flow, but also the second air flow are formed, and therefore wide, hence heavy, sheets may be separated vertically and fed one by one from the lowermost one and fed securely. In this constitution, instead of forming or not forming the second air stream, it may be also composed to adjust to a small flow when feeding narrow sheets, and to a large flow when feeding wide sheets.

When the feeding means is located above the sheets, sheet lifting air is injected to the sheets stacked up on the laying plate so that the upper and lower sheets may be separated easily, and the air stream from the air stream forming means is injected to the feeding means, and therefor the uppermost sheet of the stacked-up sheets is attracted in vacuum by the feeding means, and this uppermost sheet and the other sheets may be separated from each other by the air stream from the air stream forming means and the sheet lifting air.

This, according to the invention, of the sheets stacked up on the laying plate, the top of or bottom sheet is attracted in vacuum by the feeding means, and conveyed, and in this conveying process, the air stream outward in the widthwise direction out of the plural air streams from the air stream forming means is formed or not formed by the air stream flow rate control means, and therefore when feeding narrow sheets, the air stream outward in the widthwise direction is not formed to prevent flapping due to excessive flow rate at both sides of the narrow sheets, so that narrow sheets may be separated and fed securely one by one. When conveying wide sheets, on the other hand, the outward air stream in the widthwise direction is formed by the air stream adjusting means, and hence wide sheets which are generally heavy sheets may be conveyed one by one. Besides, by air the stream flow rate control means, the flow rate of the air stream may be varied.

In the invention, thus, sheets having various sizes from narrow sheets to wide sheets may be fed securely one by one.

Still more, according to the invention, the air stream forming means comprises a nozzle member, and this nozzle member has one or plural nozzle holes for every air stream, and the air stream flow rate control means has a valve for opening and closing the nozzle holes by the opening and closing means, and this opening and closing means is designed to drive the plunger coupled, for example, to the valve means of an electromagnetic solenoid. Such constitution is relatively simple, and is excellent in productivity.

Moreover, according to the invention, by detecting the size in the widthwise direction of the sheets stacked up by the detecting means, and controlling to open or close the nozzle holes depending on the size of the sheet width by the valve, an optimum air stream depending on the size of the width may be obtained automatically, so that the sheets may be securely separated and fed one by one.

Also according to the invention, in order to form or not to form the air stream outward in the widthwise direction depending on the size of the sheet width, the valve for opening and closing the nozzle holes may cooperate with the lateral end defining member for aligning the lateral ends of the sheets on the laying plate. As a result, depending on the size of the length in the widthwise direction of the sheets, the air stream may be formed or not formed depending on the length the sheets in the widthwise direction, or the air stream flow rate may be varied, so that it may be possible to feed the lowermost or uppermost sheet of the stacked-up sheets by aligning.

In the invention, still more, the laying plate is disposed mirror-symmetrically with respect to the symmetrical surfaces passing the central position in the widthwise direction, or the air stream may be supplied from each position of the mirror symmetry with respect to the symmetrical surfaces, and air is blown in between the upper and lower sheets supplied in this way so as to be fed one by one.

According also to the invention, a first air stream is supplied toward the vicinity of the boundary of a nearly horizontal central laying part of the laying plate and lateral laying part stretching on both side ways in the widthwise direction, and feeding means for feeding the lowermost sheet is disposed opposite to the notch formed in the central laying part, and an air stream may be easily blow in between the lowermost sheet and the remaining sheets near the boundary, so that the sheets may be vertically separated easily, and when feeding narrow sheets, second air stream disposed outward in the widthwise direction on both sides of the first air stream is not formed to prevent flapping of the both sides of the narrow sheets, or when feeding wide sheets, the upper and lower sheets are separated by using second air stream, as well as first air stream.

In the invention, furthermore, the feeding means is disposed above the stacked-up sheets, and sheet lifting air is injected toward the end part of the downstream side of the sheet feeding direction, that is, toward the vicinity of the front end part, thereby making it easy to separate the sheets, and the air stream forming means injects air stream toward the feeding means to separate the uppermost sheet only from the other sheets to feed the sheets one by one from the top.

According to the above constitution, sheets are curled in the process of conveyance through the circulation route, and are temporarily stored in the intermediate tray in the curled state. In consequence, a free space is formed due to curling between the sheets and the stack tray. At this time, the free space is high in airtightness because the both ends of the sheets contact against the both end defining members and the rear ends contact against the rear end defining members. Therefore, the sheets stored in the feeder may be easily attracted into the stack tray direction by the attracting action.

This attracting action is executed prior to the blowing action for blowing air to the sheets. Therefore, after the free space is eliminated by the attracting action, the sheets are separated by the blowing action, thereby preventing scattering due to invasion of the blow air into the free space.

In addition, as the sheets are attracted in the stack tray direction by the attracting means, and are caused to contact against the attracting means, and also contact against the protrusions having the surface position higher than the surface of the attracting means. Therefore, the sheets conveyed by the attracting means are formed in a corrugated shape as seen from the paper feeding direction side and reinforced, thereby preventing defective biting into the conveying rollers.

The sheet feeding apparatus of the invention possesses, as mentioned above, the stack tray for mounting sheets on, and this stack tray comprises a pair of both end defining members contacting against the both ends of the sheets moving in the widthwise direction of the stack tray, rear end defining member moving in the feeding direction by contact against the rear end of the sheets, attracting means for attracting the sheets in the stack tray direction prior to blowing action and conveying sheets in the feeding direction, and protrusions locating higher than the surface of the attracting means contacting against the sheets at the front end side of the feeding direction.

Thereby the airtightness of the free space formed between the sheets and stack tray is heightened by the both end defining members and rear end defining members, and the free space may be easily eliminated by the attracting action, and as the attracting action is executed prior to blowing action, scatter of the sheets due to invasion of the blow air into the free space may be prevented.

Furthermore, as the sheets are attracted into the stack tray direction by the attractive means to contact against the attracting means and protrusions, the sheets are formed in a corrugated shape as seen from the feeding direction side and reinforced, and defective biting into the conveying rollers is prevented so that it is effective to facilitate the feeding of papers.

BRIEF DESCRIPTION OF THE DRAWINGS

Other and further objects, features, and advantages of the invention will be more explicit from the following detailed description taken with reference to the drawings wherein:

FIG. 29 is a plan view near a belt 157 stretched for feeding paper in the paper feeder 38.

DETAILED DESCRIPTION OF THE PREFERRED EMBODIMENTS

Figure 1:
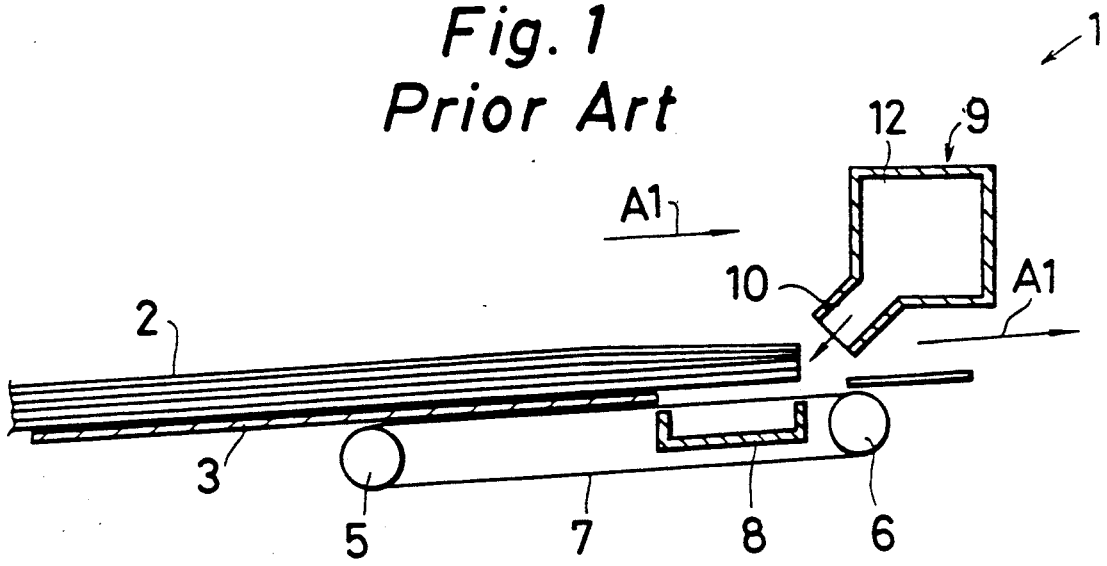
Fig. 1 Prior Art
FIG. 1 is a side view of a typical conventional paper feeder.
Figure 2:
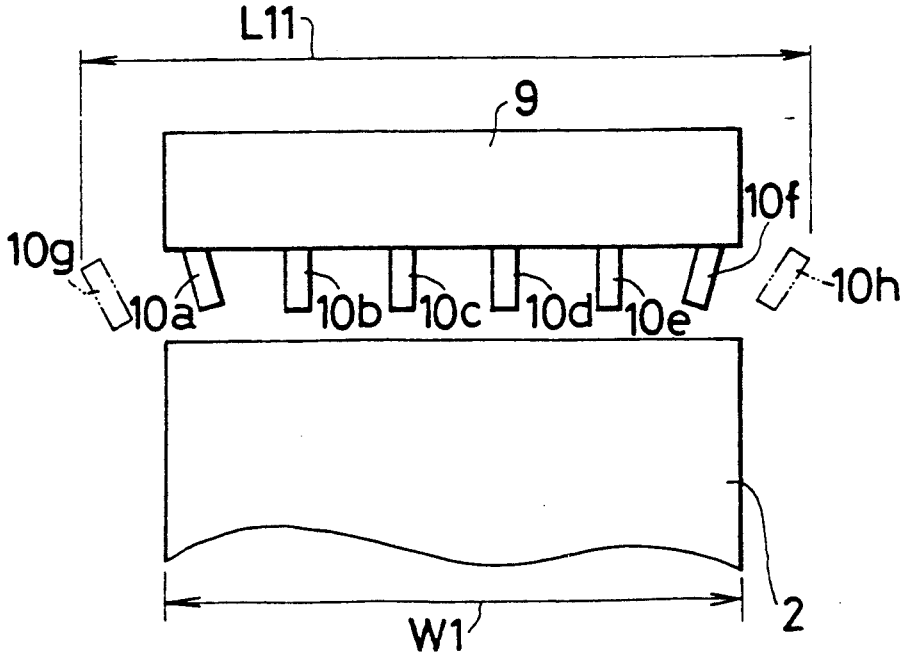
Fig. 2 Prior Art
FIG. 2 is a sectional view for explaining the layout of an air injection duct 9 and nozzle 10 used in the paper feeder 1.
Figure 3:
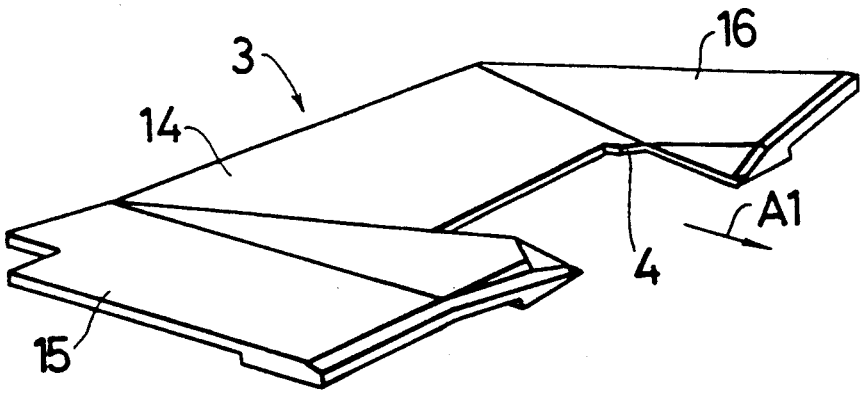
Fig. 3 Prior Art
FIG. 3 is a perspective view of a support tray used in the paper feeder 1.
Figure 4:
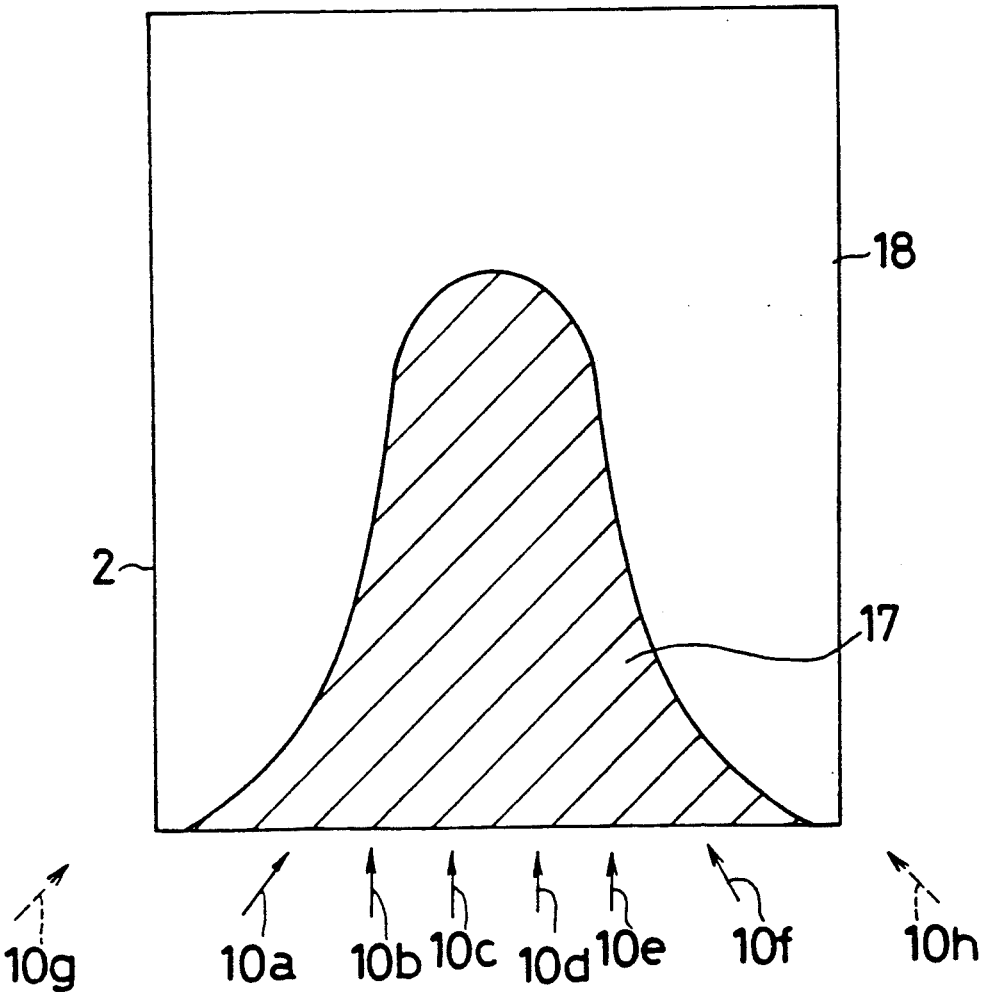
Fig. 4 Prior Art
FIG. 4 is a plan view for explaining the state of air stream in the prior art.

Now referring to the drawing, preferred embodiments of the invention are described below.

Figure 5:
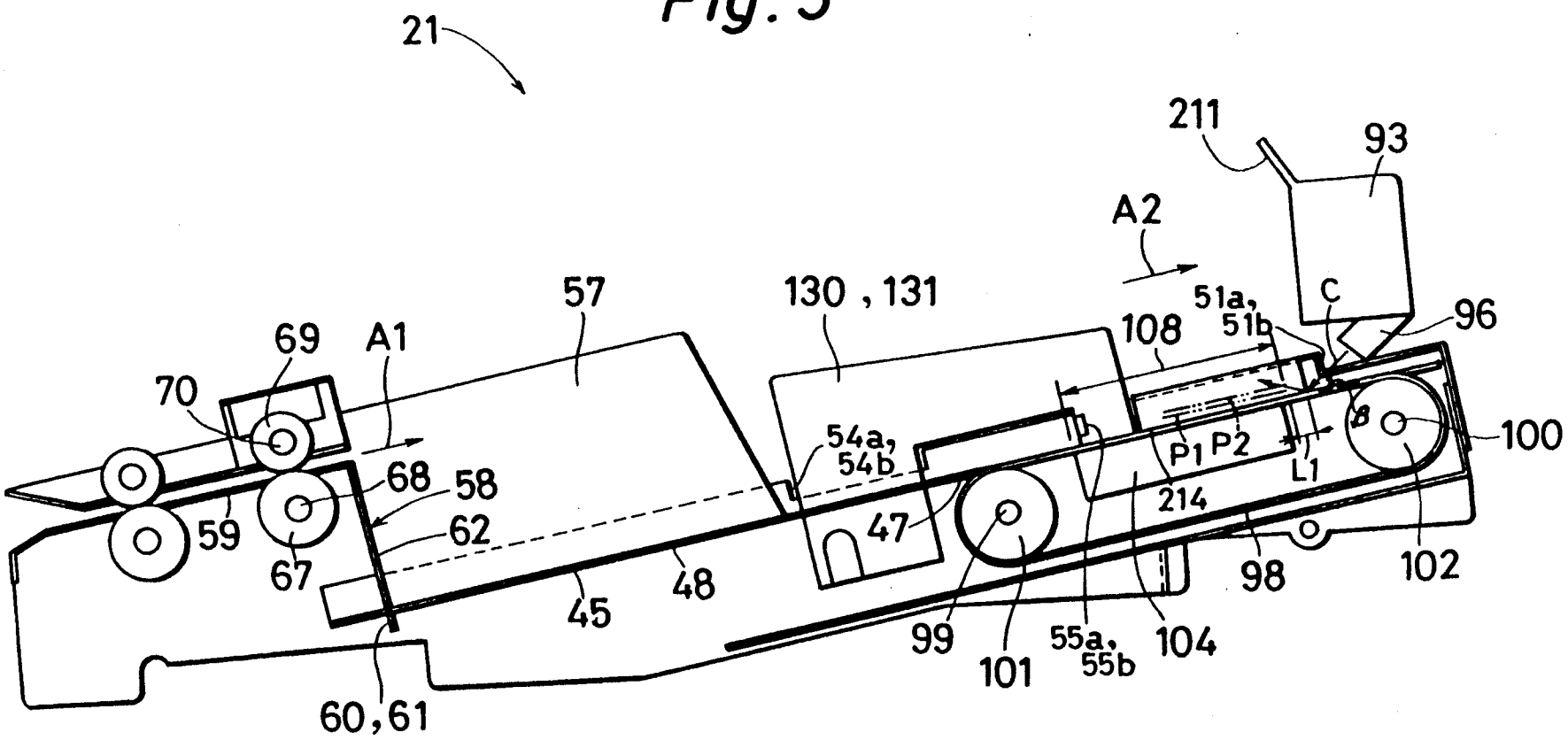
FIG. 5 is a sectional view of a paper feeder 21 in an embodiment of the invention.
Figure 6:
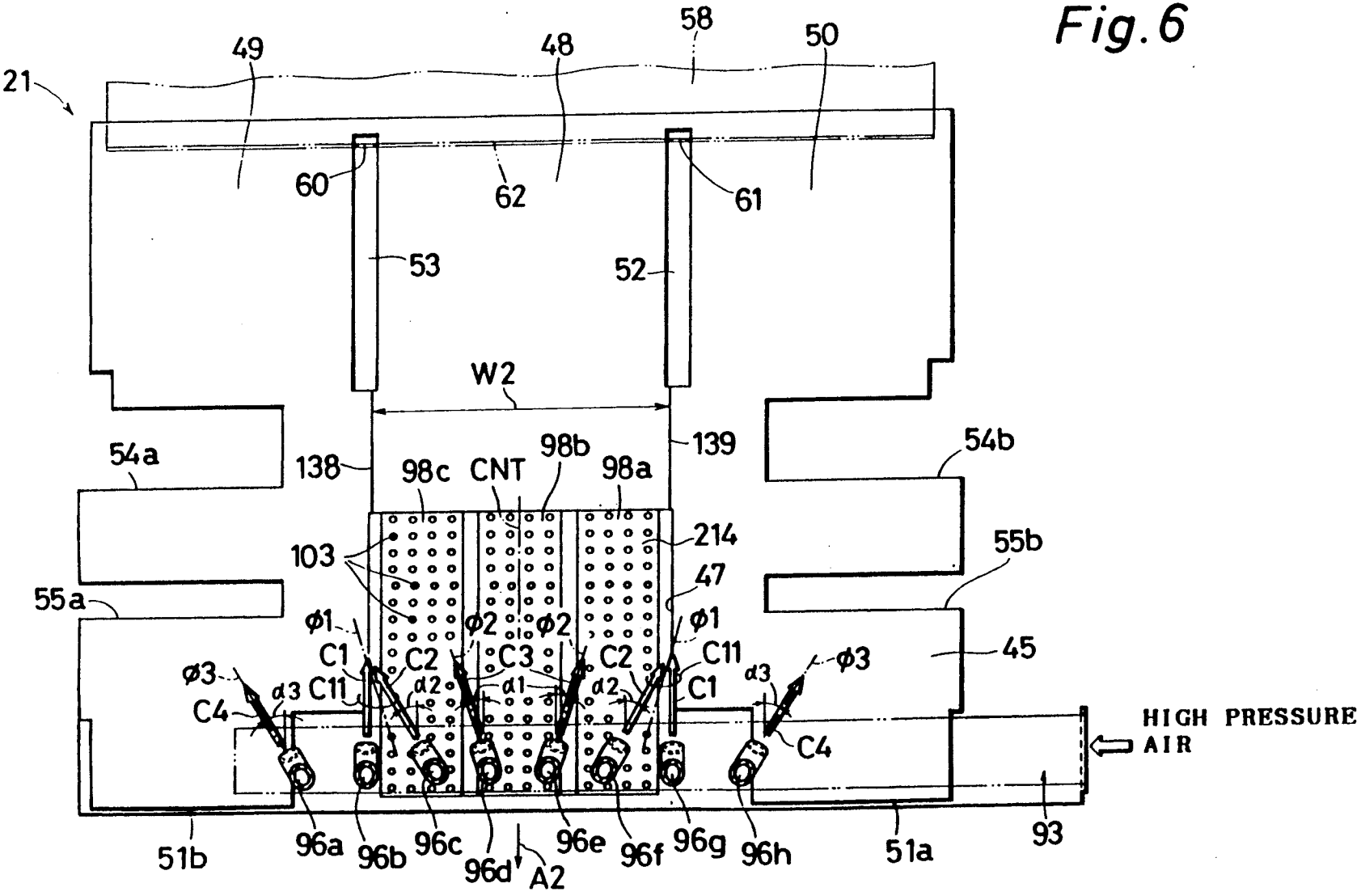
FIG. 6 is a plan view of the paper feeder 21.
Figure 7:
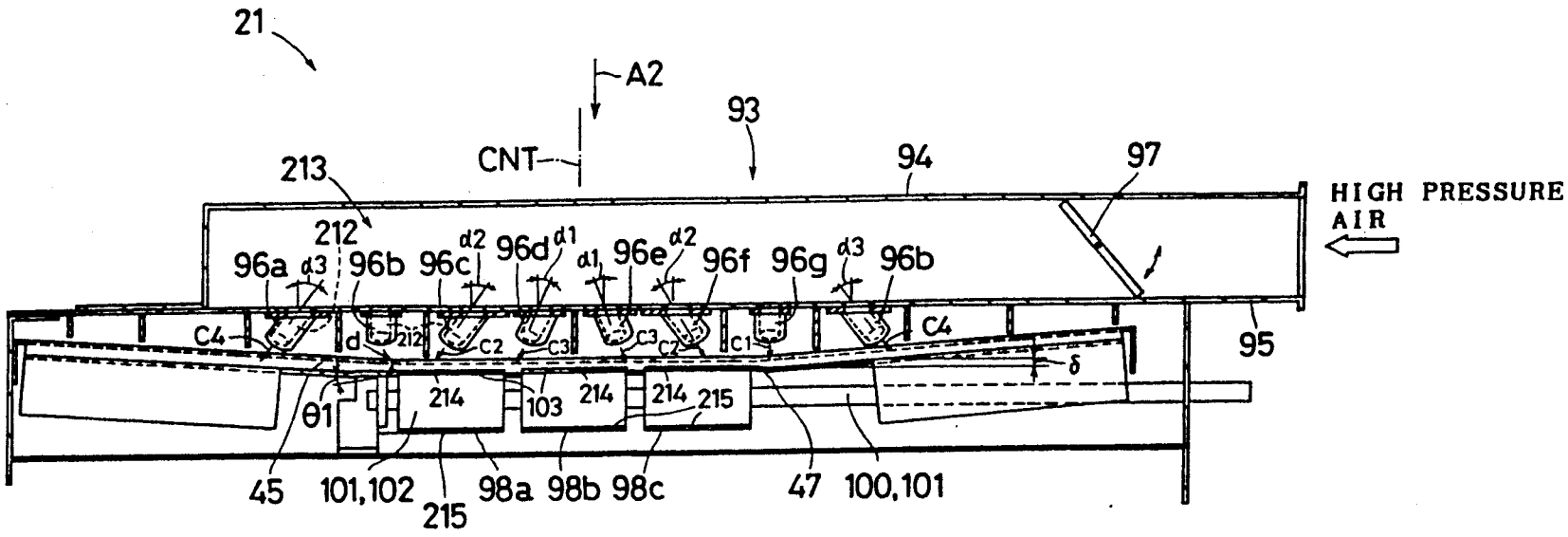
FIG. 7 is a side view thereof.
Figure 8:
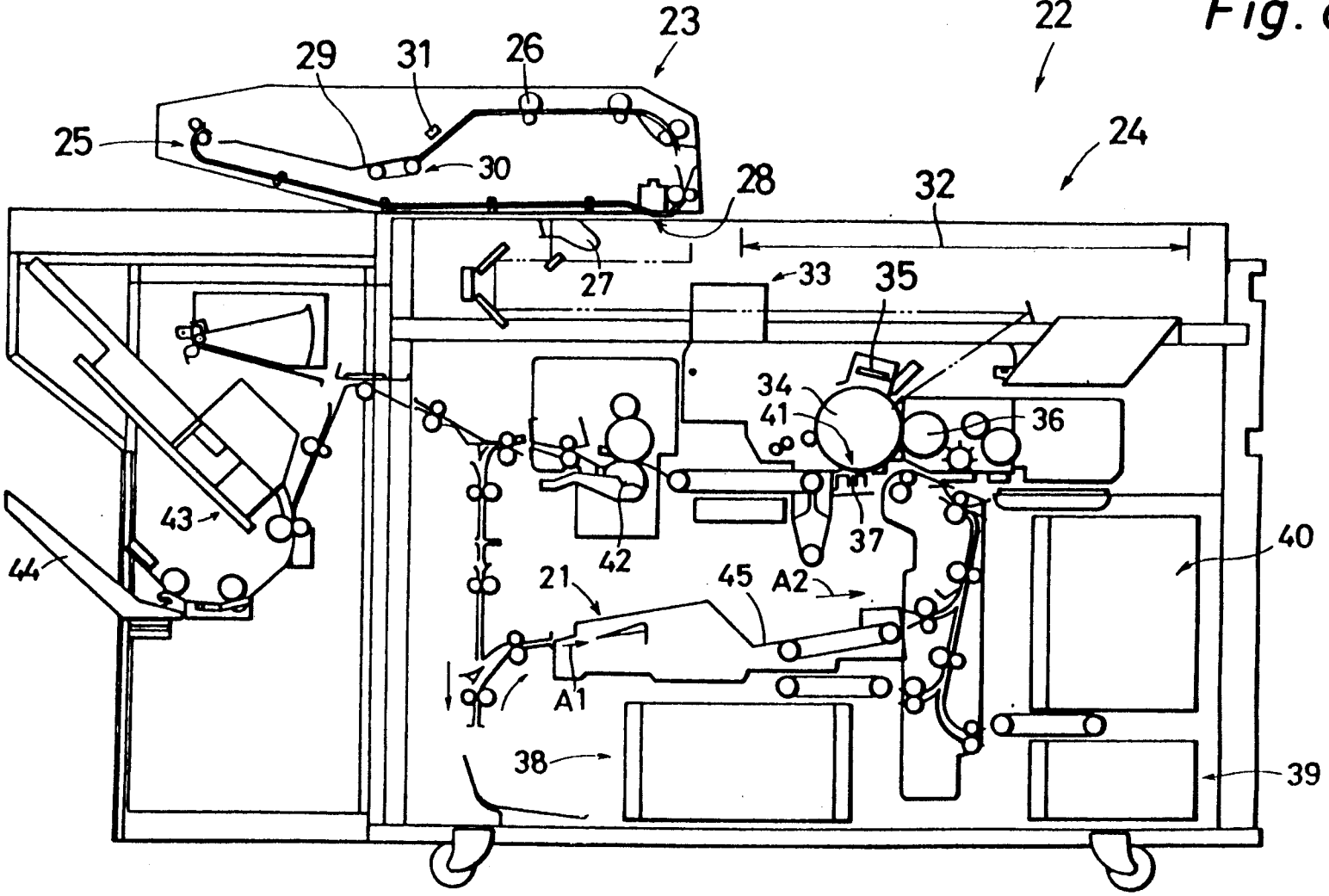
FIG. 8 is a sectional view of a copying machine 22 employing the paper feeder 21.

FIG. 5 is a side view showing a section of a paper feeder 21 called an intermediate tray in an embodiment of the invention, FIG. 6 is a plan view of the paper feeder 21, FIG. 7 is a front view thereof, and FIG. 8 is a sectional view of a copying machine 22 employing such paper feeder 21. The copying machine 22 comprises a recirculating document handler unit (hereinafter called RDH unit) 23, and a main body 24. The RHD unit 23 has a document feeder 25 of so-called bottom-take top-return system, and the taken document is exposed in an exposure region 28 by a light source 27 while being conveyed through a conveying route 26, and is returned to the document feeder 25. The document feeder 25 comprises a document laying plate 29, paper feeder 30, and air injection unit 31.

The main body 24 has the light source 27 in its inside, and an exposure region 28 of the RDH unit 23 by the light source 27 and an exposure region 32 of the main body 24 are set. The document reflected light beams from the exposure regions 28, 32 are focused on a photosensitive drum 34 through an optical system 33. Around the photosensitive drum 34 are arranged a charger 35, a developer 36, and a transfer unit 37, and recording papers of various sizes are supplied from three paper feeders 38, 39, 40 to the transfer region 41 between the transfer unit 37 and the photosensitive drum 34, and the document images by the document reflected light are recorded. The recording papers after transfer are fixed in a fixing unit 42, and filed in every specified number of pieces in a bundling unit 43, and stored in a discharge tray 44.

In the paper feeder 21, the copied recording papers are carried in the direction of arrow A1, and fed along the direction of arrow A2. The laying plate 45 of the paper feeder 21 which is explained below is positioned at an inclination of, for example, 10.4 degrees to the horizontal direction so that the upstream side may be lower than the downstream side of the paper feeding direction A2 with respect to the horizontal direction.

Figure 9:
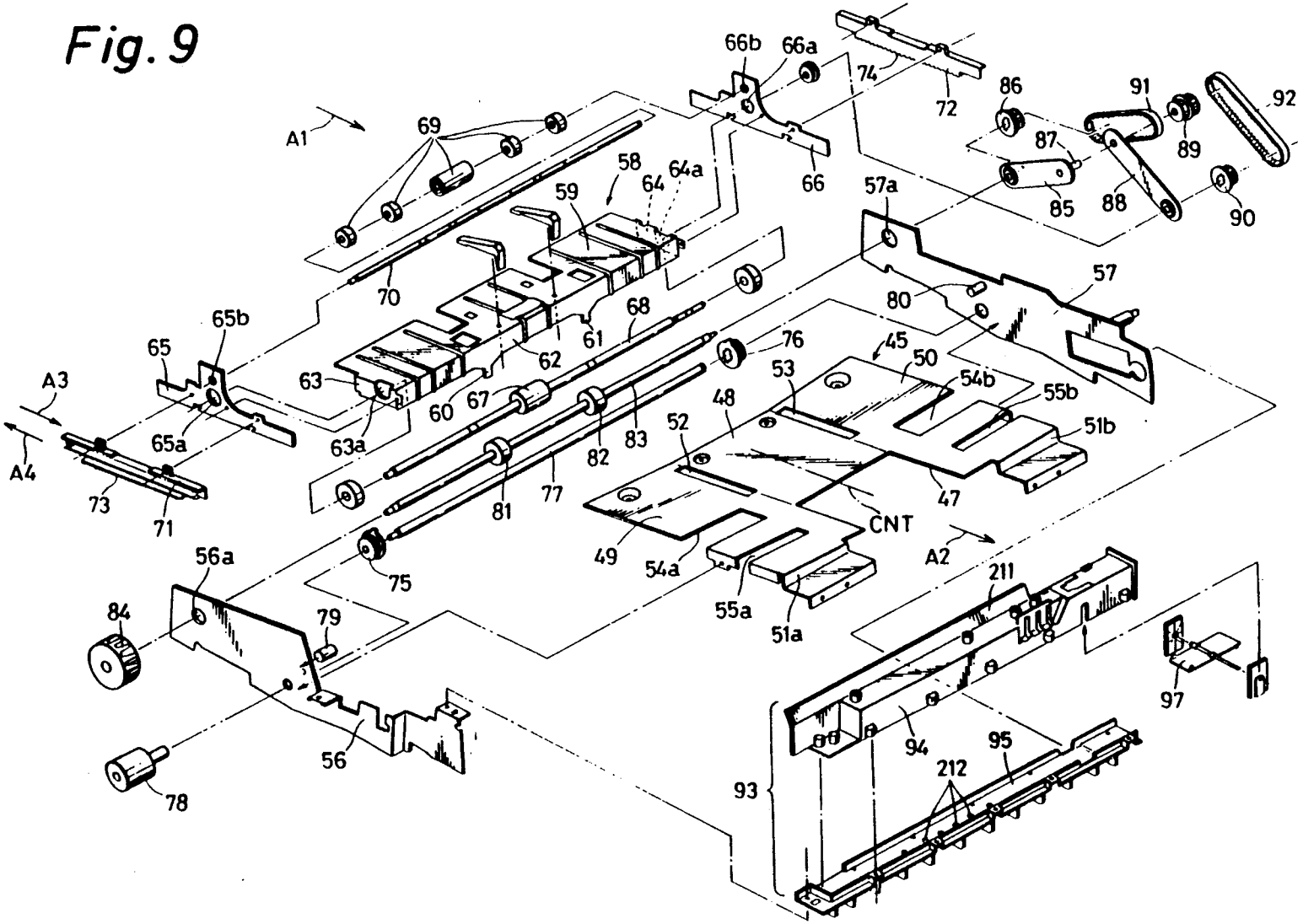
FIG. 9 and FIG. 10 are exploded perspective views of the paper feeder 21.
Figure 10:
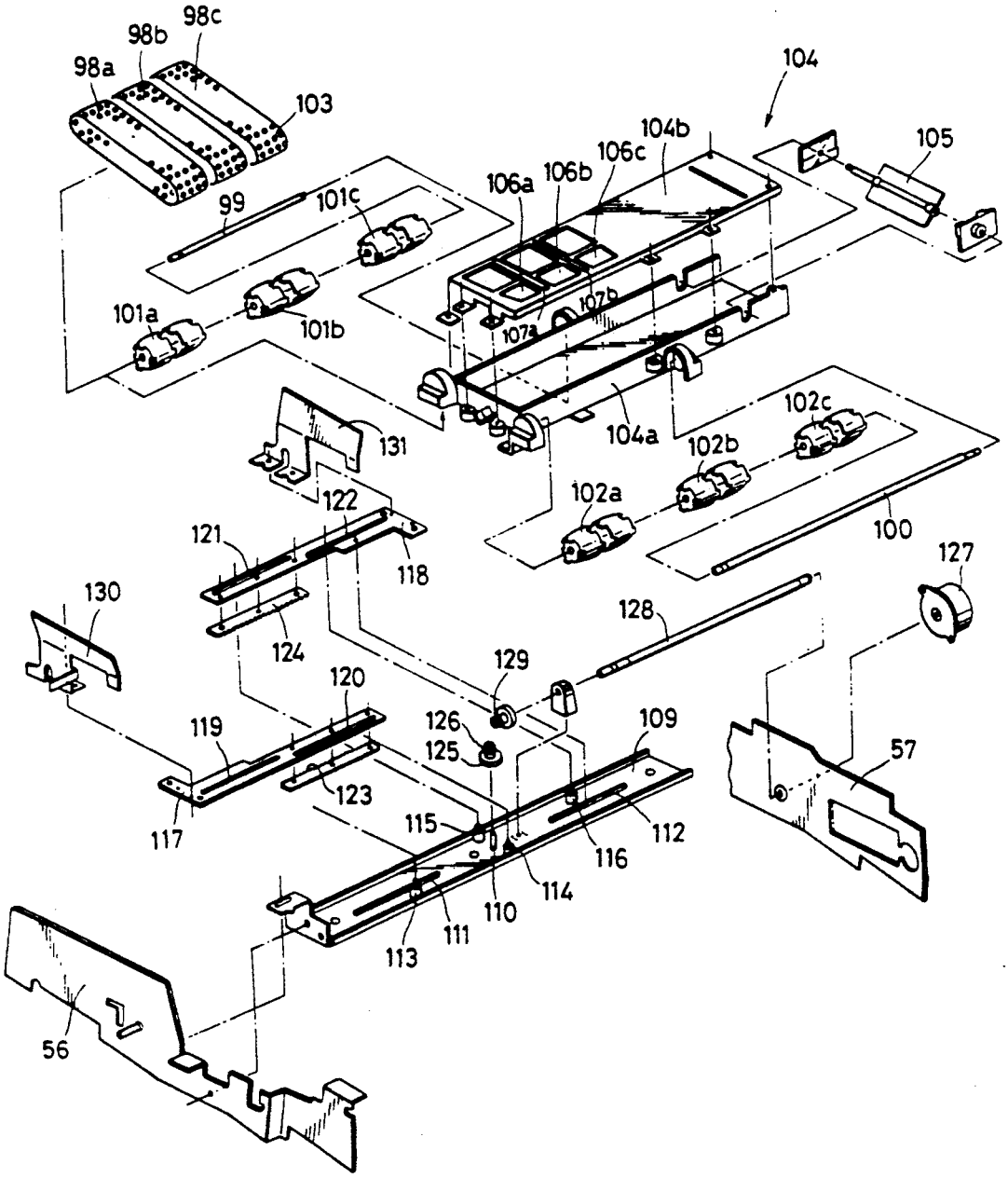

FIG. 9 and FIG. 10 are exploded perspective views of the paper feeder 21. Referring also to FIG. 5 to FIG. 7, the paper feeder 21 is described below. The paper feeder 30 of the document feeder 25 is composed basically same as the paper feeder 21 described below. The paper feeder 21 comprises the laying plate 45 on which the recording papers conveyed in the conveying direction A1 are stacked up. A notch 47 is formed in this laying plate 45, and the upper stretching parts of the belts 98*a*, 96*b* and 98*c* (collectively indicated by numeral 98 where necessary) stretched for feeding the recording paper mounted fro composing the feeding means together with the laying plate 45 are opposite to the recording paper upward, and are exposed through this notch 47.

The laying plate 45 comprises a central laying part 48 having a predetermined length W2 in the widthwise direction orthogonal to the recording paper feeding direction A2, and lateral laying parts 49, 50 formed by plastically folding so as to be bent upward along the widthwise outward direction by forming an angle of $\theta 1$ to the central laying part 48 intetrally communicating with the both ends in the widthwise direction of the central laying part 48. The lateral laying parts 49, 50 are extended longer than the central laying part 48 toward the downstream side of the feeding direction A2, and downward dropping stepped parts 51*a*, 51*b* are formed near the end parts thereof. A pair of parallel slots 52, 53 are formed along the paper feeding direction A2 in the laying plate 45, and pairs of slots 54*a*, 54*b*, 55*a*, 55*b* are formed in the same direction in the individual lateral laying parts 49, 50. Such laying plate 45 is formed symmetrically to the widthwise central position CNT. The laying plate 45 is screwed to the lateral plates 56, 57 at both ends in the widthwise direction.

At the upstream side of the paper feeding direction A1 of the laying plate 45, a rear end defining member 58 is disposed. The rear end defining member 58 communicates with a guide plate 59 for guiding the recording paper delivered along the conveying direction A1 by supporting from beneath, and the downstream side of the conveying direction A1 of the guide plate 59, and comprises a defining plate 62 having slots 52, 53 formed in the front ends, forming guide pieces 60, 61 slidable along the longitudinal direction of the slots 52, 53, contacting against the upstream side end part of the paper feeding direction A2 of the recording papers stacked up on the laying plate 45, and aligning the upstream side end parts of the stacked-up recording papers.

As mentioned above, the laying plate 45 is composed so that the upstream side of the paper feeding direction A2 may be lower than the downstream side with respect to the horizontal direction. Therefore, as shown in FIG. 5, the recording paper delivered in the arrow A1 direction onto the laying plate 45 by the rollers 67, 69 slides to the downstream side of the paper feeding direction A2 on the laying plate 45, and collides against a collision plate 211 of, for example a draft duct 93 mentioned below and stops, and returns to the upstream side of the paper feeding direction A2 due to the slope stated above, that is, to the rear end defining member 58 side, and stops by contacting against the defining plate 62 of the rear end defining member 58. In this way, the upstream side end portions of the feeding direction A2 of the recording papers stacked up on the laying plate 45 are aligned, and hence the downstream side end portions of the feeding direction A2 of the recording papers having the same shape are also aligned.

At both ends in the widthwise direction of the guide plate 59, side plates 63, 64 are dropping and formed, and mounting plates 65, 66 are affixed to the side plates 63, 64, respectively. In the side plates 63, 64 and mounting plates 65, 66, coaxial mounting holes 63*a*, 64*a*, 65*a*, 66*a* are formed, and a rotary shaft 68 on which the roller 67 is fixed is free to rotate and penetrate. In the mounting plates 65, 66, furthermore, mounting holes 65*b*, 66*b* are formed above the mounting holes 65*a*, 66*a*, and a rotary shaft 70 on which plural rollers 69 are fixed is free to rotate and penetrate.

On the mounting plates 65, 66, driving members 71, 7 with an approximately C-section in the section orthogonal to the longitudinal direction are fixed with the open ends directed outward in the widthwise direction. At the lower end parts of the driving members 71, 72, racks 73, 74 are formed along the longitudinal direction. On the side plates 56, 57, a rotary shaft 77 on which pinions 75, 76 to be engaged with the racks 72, 74 at both ends is rotatably mounted, and is rotated by a pulse motor 78.

At the located positions on the driving members 71, 72 in the side plates 56, 57, the rotary rollers 79, 80 are rotatably installed, and the driving members 71, 72 are composed so a to contain the rotary rollers 79, 80 therein, respectively. Therefore, the driving members 71, 72 are supported so as not to fall downward by the rotary rollers 79, 80, and are free to slide easily along the longitudinal direction. That is, by the pulse motor 78, as the rotary shaft 77, hence, pinions 75, 76 are put into rotation, the driving members 71, 72 are displaced reciprocally in the direction of arrows A3, A4 along the longitudinal direction thereof, so that the rear end defining member 58 may be displaced reciprocally to the downstream side and upstream side of the feeding direction A2.

The mounting holes 56*a*, 57*a* are formed in the side plates 56, 57, and the rotary shaft 83 on which the rollers 81, 82 are fixed is free to rotate and penetrate. The rotary shaft 83 is manually rotated by a knob 84 affixed to this shaft. The opposite side to the knob 84 of the rotary shaft 83 is fixed to a gear 86 by rotatably penetrating one end of the longitudinal direction of the coupling plate 85 formed slenderly. On the opposite side of the coupling plate 85, a pivot 87 is projecting toward the outside of the widthwise direction, and is rotatably inserted into one end in the longitudinal direction of a coupling plate 88 n the same shape as the coupling plate 88, and is further fixed in a gear 89. At the other end of the coupling plate 88, one end of the rotary shaft 68 is rotatably inserted to be fixed with the gear 90. Between the gears 86, 89, a tiny belt 92 is stretched, and between the gears 89, 90, a timing belt 92 is stretched.

That is , when the knob 84 is turned by hand, the rotary shafts 68, 83 rotate in synchronism even if the rear end defining member 58 on which the rotary shaft 68 is mounted is at an arbitrary position along the conveying direction A1, so that jamming may be cleared.

At the downstream side of the feeding direction A2 of the laying plate 45, a nozzle member 93 fixed to the side plates 56, 57 is disposed as being stretched in the widthwise direction. The nozzle member 93 is composed of a main body 94 forming a bottomless box longitudinal in the widthwise direction, and a cover body 95, and an air passage 213 is formed inside. The cover body 95 has nozzles 96*a* to 96*h* having nozzle holes 212, respectively formed in plural pairs at symmetrical positions with respect to the widthwise direction central position CNT of the laying plate 45, and draft/stop is realized to the laying plate 45 by the angular displacement state of a damper 97 installed in the nozzle member 93.

Beneath the laying plate 45, three feeding stretch belts 98*a*, 98*b*, 98*c* are disposed, for example, opposite to the notch 47, and they are stretched between the driving rollers 101*a*, 102*a*; 101*b*, 102*b*;101*c*, 102*c* fixed on the rotary shafts 99, 100, respectively.

At the upper ends of the feeding stretch belts 98*a* to 98*c*, between the upper stretching portion 214 forming the paper feeding surface and the central laying part 48 of the laying plate 45, a step difference of height $\delta$ is set so that the upper stretching part 214 of the feeding stretch belts 98*a* to 98*c* may be lower a shown in FIG. 7. This step difference height $\delta$ is selected in a range of 1 to 5 mm, or preferably about 2 mm. The step difference height $\delta$ is, as described in detail below, intended to produce a gap to the second recording paper from the bottom by deflecting downward by the step difference height $\delta$ from the central laying part 48 of the laying plate 45, when the lowest recording paper of the stack of the recording papers P on the laying plate 45 is attracted in vacuum to the feeding stretch belts 98*a* to 98*c*, thereby separating smoothly. Accordingly, if the step difference height $\delta$ is too small, the separating capacity is insufficient, or if excessive, attracting of the recording paper to the feeding stretch belts 98*a* to 98*c* is insufficient, and conveying failure may occur.

In the feeding stretch belt 98, multiple penetration holes 103 are formed as the air vent holes, and inside the feeding stretch belt 98 there is a vacuum attracting box 104 for attracting in vacuum the recording paper by negative pressure on the feeding stretch belt 98 through the penetration holes 103. The vacuum attracting box 104 is composed of a box-shaped main body 104*a* and a cover body 104*b*, and attracting holes 106*a* to 106*c* are formed in the conveyor body 104*b* at positions corresponding to the feeding stretch belts 98*a* to 98*c*. Among the attracting holes 106*a* to 106*c* there are formed protrusions 107*a*, 107*b* extending along the feeding direction A2, and they are selected at a height projecting higher than the upper stretching part 214, among the feeding stretching belts 98*a* to 98*c*. The vacuum attracting box 104 is connected to a vacuum source (not shown), and executes and stops the attracting action of the recording paper by the angular displacement action of the damper 105 contained inside.

As shown in the plan view in FIG. 6, the nozzles 96*b*, 96*g* possessing a second nozzle hole for forming an air injection flow C1 parallel to the feeding direction A2 are composed parallel to the feeding direction A2 in a plan view. The angle $\alpha 2$ of the nozzles 96*c*, 96*f* having a first nozzle hole forming an injection flow C outward in the widthwise direction colliding against the injection flow C1 formed with the feeding direction A2 in a plan view is 20 to 45 degrees, or preferably selected around 30 degrees. Concerning the air flow C11 combining these injection flows C1, C2, the central line $\phi 1$ of each air flow is assumed.

The angle $\alpha 1$ of the nozzles 96*d*, 96*e* forming an injection flow parallel to the central line $\phi 2$ outward in the widthwise direction and an air flow C2, inward in the widthwise direction from the nozzles 96*c*, 96*f*, formed with the feeding directions A2 in a plane view is 0 to 45 degrees, or preferably selected around 15 degrees. Besides, the angle $\alpha 3$ of the nozzles 96*a*, 96*h* forming an injection flow parallel to the central line $\phi 3$ outward in the widthwise direction and an air flow C4, disposed outward in the widthwise direction of the nozzles 96*b* to 96*g*, with the feeding direction A2 in a plan view is 9 to 45 degrees, or preferably selected around 30 degrees.

On the other hand, the angle $\beta$ of the nozzles 96*a*, 96*h* formed with the feeding direction A2 in the side view shown in FIG. 5, that is, with the central laying part 48 is 3 to 10 degrees, or preferably selected around 3.5 degrees, and is determined as follows. First of all, by the entire structure of the copying machine 22 including the paper feeder 21, the configuration of the nozzle member 93 is determined, and therefore the base end positions of the nozzles 96*a* to 96*h* determined. On the other hand, as shown in FIG. 5, the air flow C in the side view of each nozzle 96 is above the feeding stretch belt 98, and is injected to a position remote from the suction region 108 set on the feeding stretch belt 98 by the vacuum attracting box 104 by a predetermined distance L1 to the downstream side of the feeding direction A2.

In this embodiment, in other words, the air flow C is not directly blown to the downstream side end part of the feeding direction A2 of the recording papers P stacked up as shown in FIG. 6 on the laying plate 45 including the range above the feeding stretch belt 98, but it is once injected to the feeding stretch belt 98 at the downstream side of the feeding direction than the downstream side end portion of the feeding direction of the stacked-up recording papers, and the reflected air flow collides against the downstream side end part in the feeding direction A2 of the recording papers P, thereby separating the bottom recording paper P1 from the second recording paper P2. That is, if the air flow C is directly injected to the downstream side end part of the recording paper, such air flow generates a force for pressing the recording papers P to the downstream side, which may be inconvenient for separating the recording papers. By using the reflected flow, the recording paper P is blown upward, apart from the feeding stretch belt 98, so that the separation action may be done smoothly. Besides, the air flow from the nozzle 96 does not contribute to the separation of recording papers, which is effective to prevent undesired attracting to the vacuum attracting box 104.

The configuration of the nozzles 96*b*, 96*g* may be shorter that the distance L1 of the nozzles 96*b*, 96*g* may be shorter than the length L2 of the longer side of the recording paper of the minimum width assumed to be used, for example, the B5 format of JIS, and the air flow C11 composed of the injection flow C1 from the nozzles 96*c*, 96*f* is directed inward in the widthwise direction than the both end parts of the widthwise direction of the recording paper of the minimum width. Besides, the configuration of the nozzles 96*a* and 96*h* is determined so that their distance L3 may be shorter by a specific extent than the length of the longer side of the maximum recording paper assumed to be used, for example, B4 or A3 of JIS or the double letter size WLT generally used in English-speaking nations (11 inches by 17 inches), and the air flow C4 from these nozzles 96*a* and 96*h* is directed inward in the widthwise direction than the both end parts of the widthwise direction of the maximum recording paper.

Beneath the feeding stretch belt 98, the side plate 56 is fixed, and a longitudinal support plate 109 is disposed in the widthwise direction. In the central position of the support plate 109 in the widthwise direction, a pivot 110 is set up, and relating to the pivot 110, guide grooves 111 and 112 extending in the widthwise direction are formed at both sides in the widthwise direction. Guide pins 113 to 116 are set up on the support plate 109, and these guide pins 113 to 116 are inserted into slots 119, 120; 12, 122 formed on the support plate 109 and extending in the widthwise direction of longitudinal driving members 117 and 118 in the widthwise direction, and the driving members 117 and 118 are defined in the moving direction in the widthwise direction by the guide pins 113 to 116.

In the mutually confronting edge parts of the driving member 117, 118, racks, 123, 124 are formed respectively, and are engaged with a gear 125 rotatably installed in the pivot 110 manually from the opposite sides. On this gear 125, a bevel gear 126 is coaxially fixed, and it is engaged with a bevel gear 129 fixed at the front end of a rotary shaft 128 rotated by a pulse motor 127 fixed on the side plate. At the outer end parts in the widthwise direction of the driving members 117, 118, there are fixed lateral end defining plates 130 and 131 engaged with the slots 54*a*, 55*a*; 54*b*, 55*b* of the laying plate 45, and arranged being projected upward from the laying plate 45.

That is, in the copying machine 22, when any of the paper feeders 38 to 40 in which recording papers of various sizes are stored is selected, the pulse motor 127 is driven in a specified direction by the action of the control unit mentioned later, and the amount of rotation depends on the engagement of the bevel gears 129, 126, and the driving members 117, 118 are displaced inward or outward along the widthwise direction, and the gap of the lateral end defining plates 130, 131 is set to the size of the selected recording paper, thereby aligning the lateral ends in the widthwise direction of the recording papers delivered onto the laying plate 45.

Figure 11:
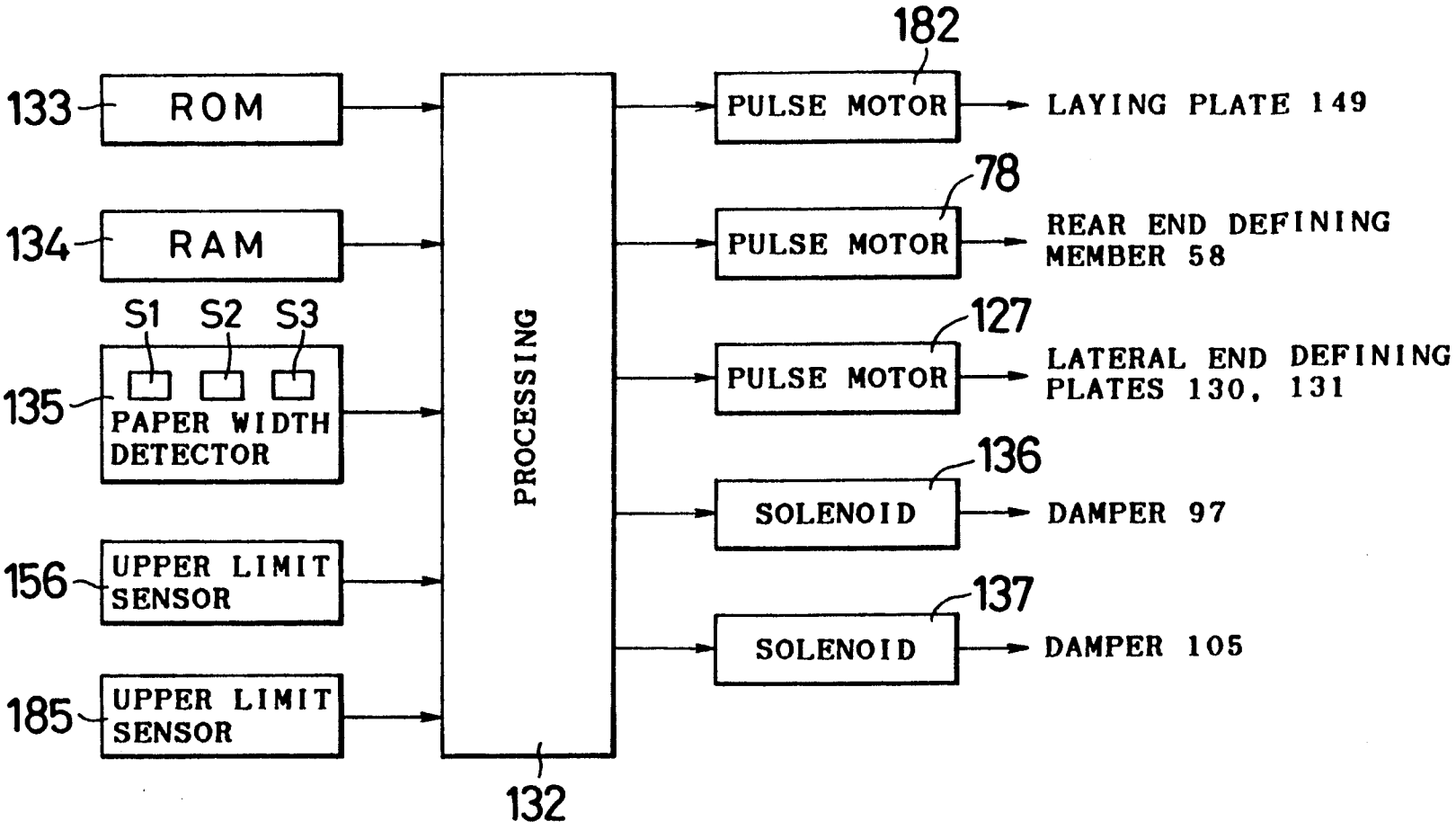
FIG. 11 is a block diagram showing an electrical structure of the copying machine 22.

FIG. 11 is a block diagram showing an electric composition of the copying machine 22, in which only essential parts are shown for the sake of simplicity of explanation. The copying machine 22 comprises, for example, a central processing unit (CPU) 132 containing a microprocessor, and the CPU 132 controls the actions of the copying machine 22, for example, according to the action program stored in a ROM (read-only memory) 133. The CPU 132 comprises a RAM (random access memory) 132 for storing the input data such as number of copies and various operation modes, and a paper width detector 135 for detecting the width of the recording papers stored in the paper feeders 38 to 40.

Figure 31:
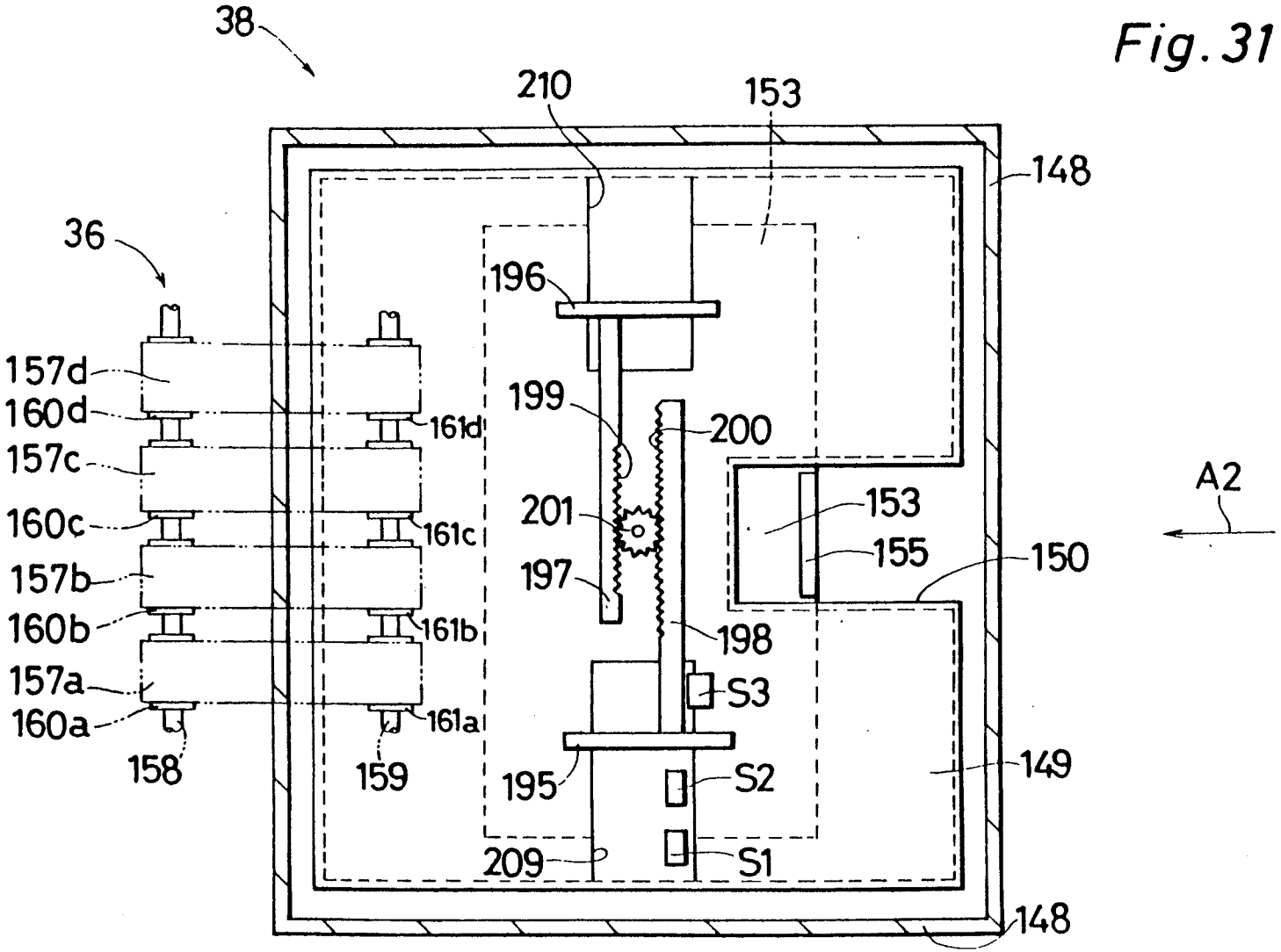
FIG. 31 is a plan view for explaining a paper width detecting mechanism 135 in the paper feeder 38.

A constitutional example of the paper width detector 135 is shown later in FIG. 31, and anyway in the paper feeding apparatus 21, the lateral end defining plate 131 is manually operated, and limit switches or other position sensors are disposed for every moving position of the lateral end defining plate 131, corresponding to JIS sizes such as B4, B5 and A4, or American or European sizes such as letter size LT (11 inches by 8.5 inches), regal size RG (14 inches by 8.5 inches) and double letter size WLT (17 inches by 11 inches).

The pulse motors 78 and 127 are connected to the CPU 132, and on the basis of the dimension in the widthwise direction of the recording paper being used detected by the paper width detector 135, the rear end defining member 58 is moved to the upstream side or downstream side of the feeding direction A2, and the lateral end defining plates 130 and 131 are moved inward or outward in the widthwise direction. Moreover, electromagnetic solenoids 136 and 137 are connected to open or close the dampers 97 and 105. Furthermore, the CPU 132 controls the pulse motor 132 which moves up and down the laying plate 45 of the recording papers of the paper feeders 38 to 40 within the paper feeders 38 to 40.

Figure 12:
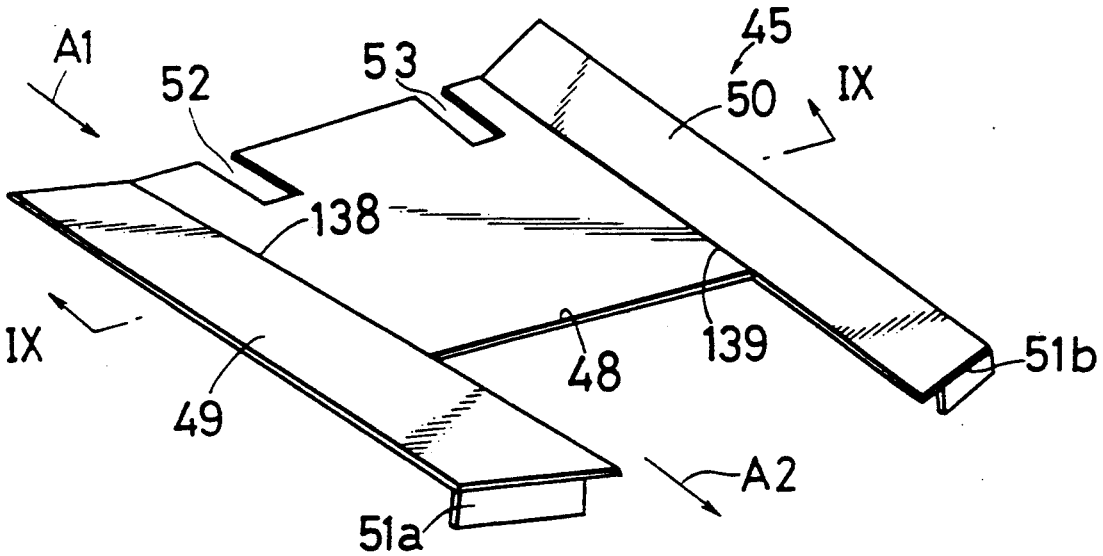
FIG. 12 is a perspective view of a laying plate 45.
Figure 13:
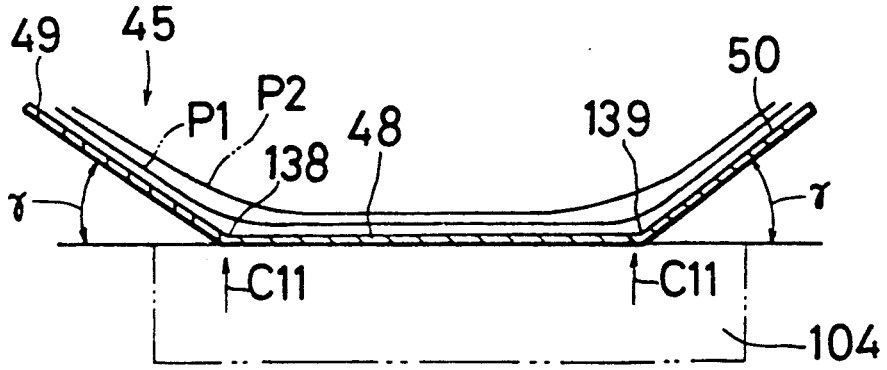
FIG. 13 is a sectional view of the laying plate 45.

FIG. 12 is a simplified magnified perspective view of the laying plate 45, and FIG. 13 is a sectional view from sectional line X13—X13 of FIG. 12. Regarding the central laying part 48 of the laying plate 45, the both side laying parts 49 and 50 are bent upward by the angle $\gamma$ (3 to 10 degrees, preferably about 3.5 degrees) as predetermined as going outward in the widthwise direction, and bent parts 138 and 139 are formed in their boundary, parallel to the feeding direction A2. In the feeding apparatus 21 of the embodiment, in order to separate the bottom recording paper P2 and the second recording paper P2 in the stacked recording papers P, it is necessary that the gap in which the air flow from the nozzle 96 is blown and injected be formed between the recording papers P1 and P2. Accordingly, in this embodiment, the angle $\gamma$ is set between the central laying part 48 and of the laying plate 45 and the lateral laying parts 49, 50, and the bent parts 138, 139 are composed. Moreover, the step difference height $\delta$ is provided between the inward end part i the widthwise direction of the lateral laying parts 40, 50 and the feed stretch belt 98.

Figure 14:
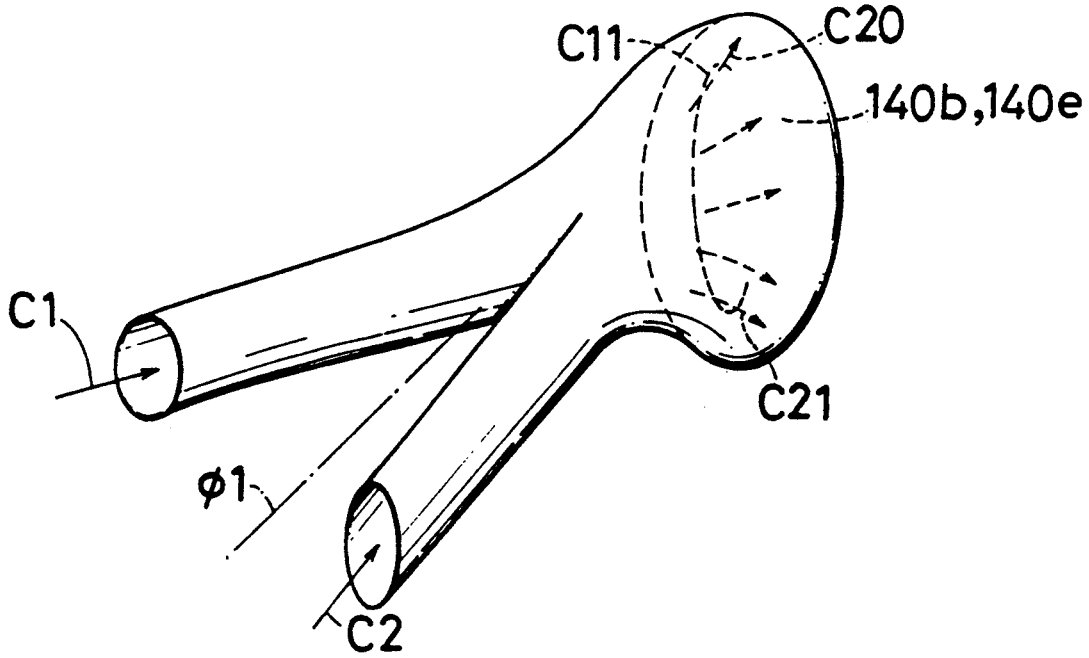
FIG. 14 is a perspective view showing the state of air streams from nozzles 96*b*, 96*c* in the embodiment.
Figure 15:
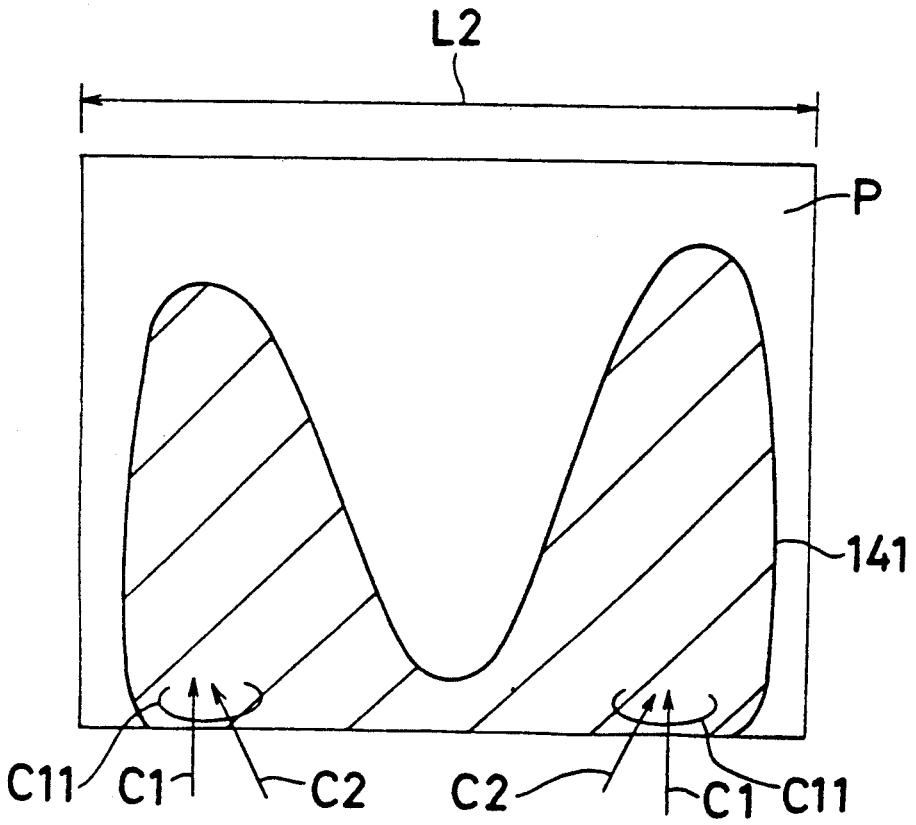
FIG. 15 is a plan view for explaining the state of air streams from nozzles 96*b*, 96*c*; 96*f*, 96*g* in the embodiment.
Figure 17:
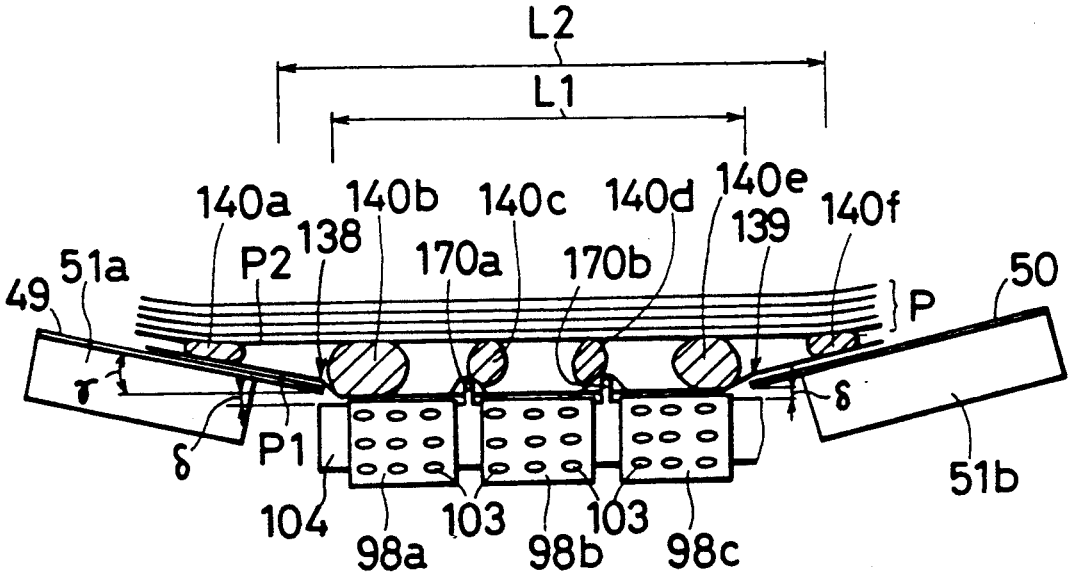
FIG. 17 is a side view for explaining the action of this embodiment.

Therefore, when the recording paper P1 is attracted as shown in FIG. 13 by the negative pressure by the vacuum attracting box 104 to the feeding stretch belts 98*a* to 98*c*, a gap is formed between the recording papers P1 and P2, at least near the bent parts 38 and 139. The nozzles 96*b*, 96*c*; 96*f*, 96*g* are composed so as to blow the air flow C11 into the gap around the bent parts 138, 139 along the center line 11 as shown in FIGS. 14, 15, and therefore the blown air flow C11 is inflated in the vertical direction. The vacuum attracting box 104 has protrusions 107*a*, 107*b*, and the recording paper P1 is curved in a profile along these protrusions 107*a* and 107*b* as shown in FIG. 17. On the other hand, since the second recording paper P2 is not attracted by the vacuum attracting box 104, a gap is produced against the recording paper P1 at both sides of the protrusions 107*a* and 107*b*.

The nozzles 96*d* and 96*e* blow air flow into the gap at the inward side in the widthwise direction of the protrusions 107*a*, 107*b*, and this air flow collides against the side walls of the protrusions 107*a*, 107*b* to inflate in the vertical direction. As a result, regions 140*c*, 140*d* shown in FIG. 17 are created, which contributes to separation of the recording papers P1 and P2. AT this time, as mentioned above, the layout gap L1 between the nozzles 96*b*, 96*g* is set shorter than the length L2 of the longer side of the recording paper in, for example, B5 format of JIS. Still more, the injection flows indicated by arrows C2, C3 directed from inward to outward in the widthwise direction of the nozzles 96*c* to 96*f* are blocked by the injection flows parallel to the feeding direction A2 as indicated by arrow C1 of the nozzles 96*b*, 96*g* to be united into one air flow C11, which run in the direction of arrow C11 and is inflated in the vertical direction as mentioned above, thereby realizing the separating region C14 shown in FIG. 16. It is therefore possible to avoid flapping of the widthwise end parts, or disturbance of stacked state or emission of noise, due to ejection of the air flow C11 from the widthwise ends of the recording paper with width L2.

FIG. 17 is a front vie for proving the separation action of recording papers in this embodiment. The shaded regions 140*a* to 140*f* in FIG. 17 indicate the size and range of the air flow for separating the bottom recording paper P1 in the stack of recording papers P from the second recording paper P2 and others, by the injection of the air flow by the nozzles 96*a* to 96*h* mentioned above. In the regions 140*b*, 140*e*, the jet flows are concentrated in the widthwise direction as indicated by arrows C1, C2 by the nozzles 96*b*, 96*c*; 96*f*, 96*g*. Therefore, the jet flows concentrated along the widthwise direction as shown in FIG. 14 inflate vertically as shown by arrows C20, C21, and the recording papers P1, P2 are separated by this pressure. The occupied areas of the air flows inflating in the vertical direction are indicated as regions 140*b* and 140*e* in FIG. 17.

As examples of recording paper with wider width L4 than the width L2, there are double letter size and B4 size recording papers, and when separating such wide recording papers, the gap L3 of the nozzles 96*a* to 96*h* is selected smaller than the width L4 as mentioned above. Moreover, the laying plate 45 has step different parts 51*a*, 51*b* in the running direction of air flow from the nozzles 96*a*, 96*h* as stated above. That is, the majority of the air flow from the nozzles 96*a*, 96*h* collides against the step parts 51*a*, 51*b*, and flows in other direction than the laying plate 45, so that the flow rate and speed may be suppressed.

Therefore, the air flow from the nozzles 96*a*, 96*h* indicated by arrow C4 is relatively weakened, and injected between the recording papers p1, P2. In consequence, the separating region 142 in the recording paper P with width L4 becomes a region indicated by shading enclosed with broken lines in FIG. 16, and a wider area is realized than in the case of the separating region 141 for the recording paper P of smaller size. In this embodiment, more specifically, even if the recording papers are grater in width or size, it is possible to separate effectively. Still more, near the both ends in the widthwise direction of larger recording paper P, as mentioned above, the air flow from the nozzles 96*a* to 96*h* is controlled in flow rate to be injected. Therefore, it is possible to avoid disturbance of stacked state or generation of noise due to flapping of the end parts of the recording papers as mentioned above, resulting from the leak of air flow from both sides in the widthwise direction of the larger recording papers P.

Figure 18:
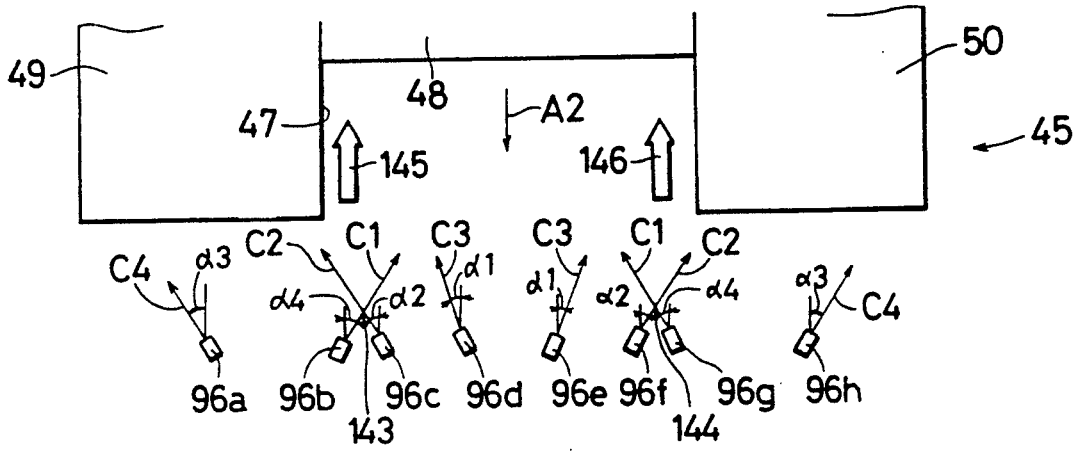
FIG. 18 through 21 are plan view for explaining other layouts of nozzles 96*a* to 96*h* of the same embodiment.

According to the embodiment, a relatively large separating capacity is realized by concentrating the air flows in the regions 140*b*, 140*e* shown in FIG. 17, and the separating capacity is further enhanced by injecting the air flow at specified flow rate into the regions 140*a*, 140*c*, 140*d*, 140*f*. Therefore, the configuration of the nozzles 96*a* to 96*h* for realizing the characteristic action is not limited to the layout sown in FIG. 6 and 7. A first modification example of configuration of nozzles 96*a* to 96*h* is shown in FIG. 18, in which the nozzles 96*b*, 96*g* in the above embodiment are inclined by an angle of $\alpha 4$ inward in the widthwise direction with respect to the feeding direction A2.

In this embodiment, the injection flows C1, C2 from the nozzles 96*b*, 96*c*, and the injection flows C1, C2 from the nozzles 96*f*, 96*g* respectively collide against the collision positions 143, 144 in the widthwise direction, forming air flows 145, 146 parallel to the feeding direction A2, so that the regions 140*b*, 140*e* shown in FIG. 17 may be realized. The actions of the other nozzles 96*a*, 96*d*, 96*e*, 96*h* are same as in the foregoing embodiment.

Figure 16:
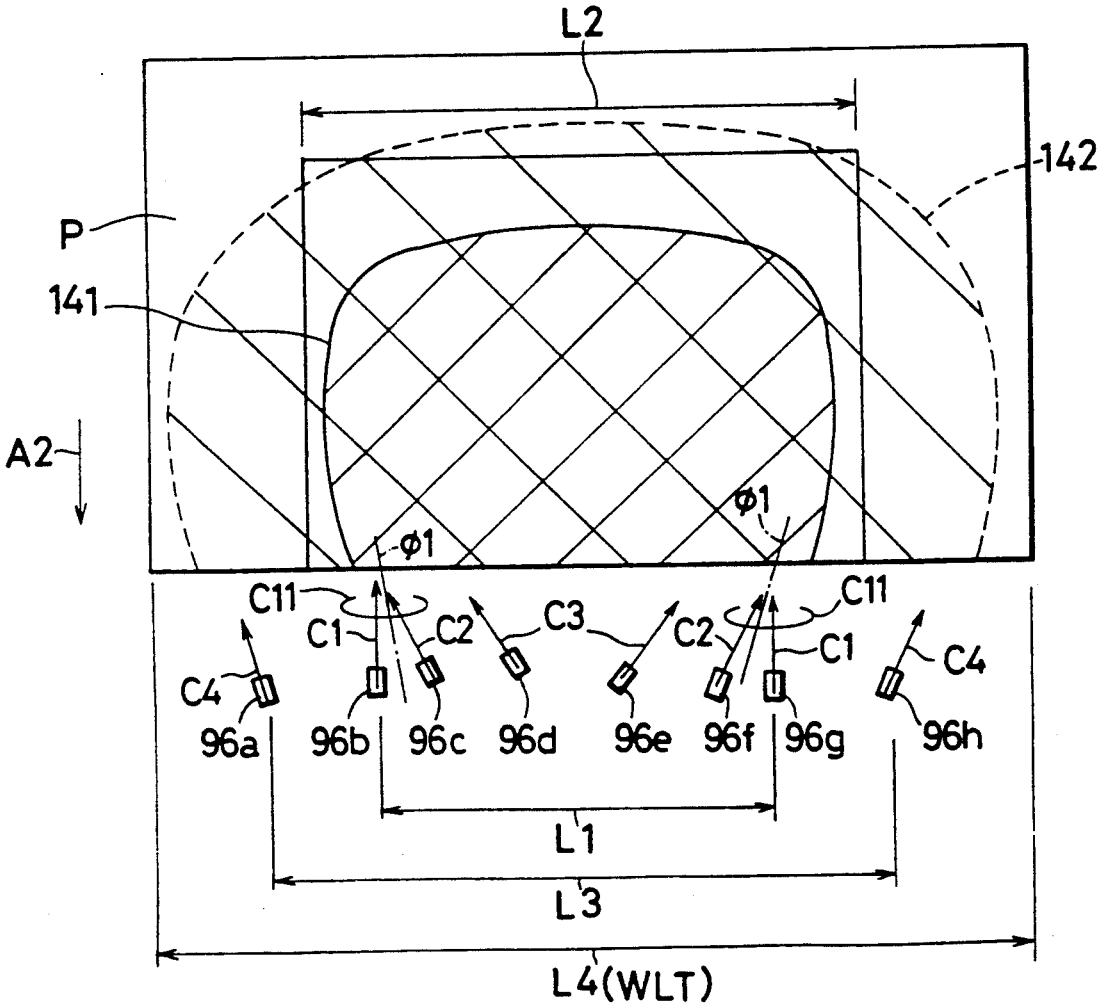
FIG. 16 is a plan view for explaining the state of air streams from nozzles 96*a* to 96*h*.
Figure 19:
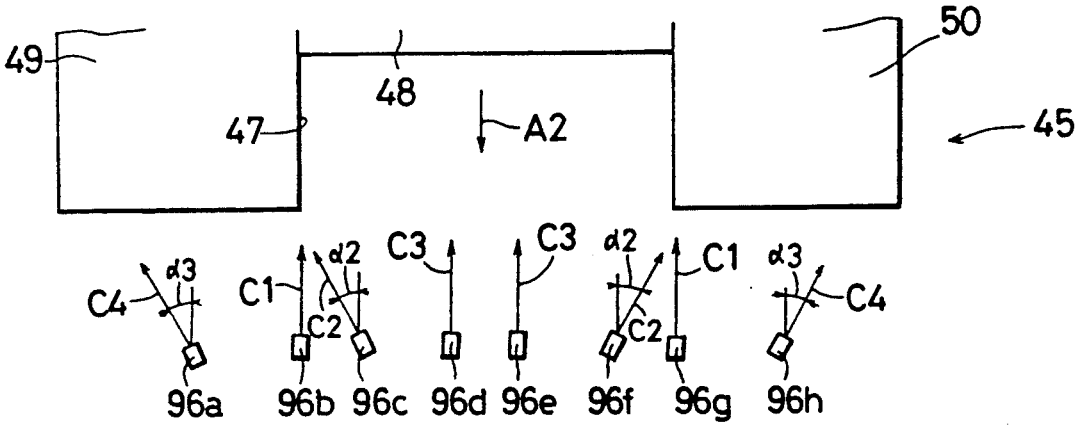

A second modification is shown in FIG. 19, in which the nozzles 96*d*, 96*e* are formed parallel to the feeding direction A2. The actions of the nozzles 96*a* to 96*c*, and nozzles 96*f* to 96*h* in this embodiment are same as in the first embodiment. The nozzles 96*d* to 96*e* of the embodiment are to inject air flow parallel to the protrusions 107*a*, 107*b* in the gap between the recording papers P1, P2 formed by the protrusions 107*a*, 107*b* formed in the vacuum attracting box 104 as explained by reference to FIG. 17. The stacked recording papers P are mutually contacting with each other, at widthwise both ends and upstream side end of feeding direction A2, as shown in FIG. 16. Accordingly, when air flow is injected into the gap, it produces a positive static pressure within the enclosed separating regions 141, 142, thereby realizing the separation in the vicinity of the widthwise central part of the recording papers P. By this embodiment, too, the same effect as in the foregoing embodiment may be realized.

Figure 20:
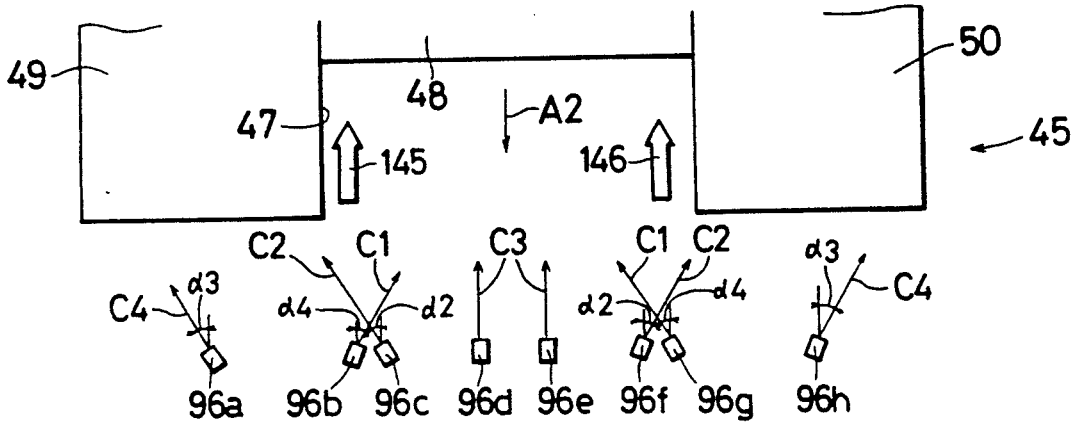

A third modification example is given in FIG. 20. The characteristic point of this embodiment is that the nozzles 96*b*, 96*g* in the second modification example are inclined inward in the widthwise direction by an angle $\alpha 4$, same as in the first modification example. In this embodiment, the action of the nozzles 96*a*, 96*h* is the same as in the first embodiment, the action of the nozzles 96*b*, 96*c*; 96*f*, 96*g* is same as in the first modification, and the action of the nozzles 96*d*, 96*e* is same as in the second modifications. In such embodiment, too, the same effect as in the preceding embodiments may be realized.

Figure 21:
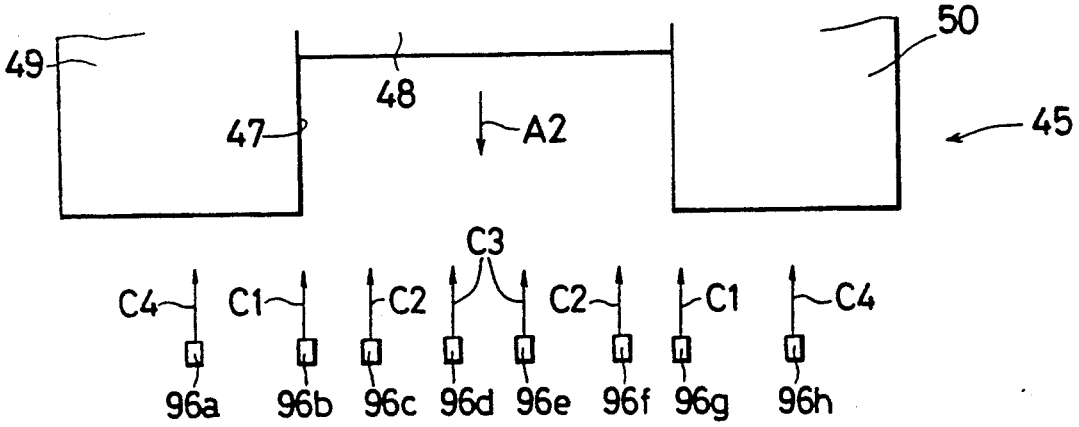

A fourth modification example is shown in FIG. 21. Its feature is that the nozzles 96*a* to 96*h* are parallel to the feeding direction A2 in a plan view. As explained by reference to FIG. 16, the upstream side end of the feeding direction A2 and the both widthwise end parts of the stacked papers P are contacting with each other. Therefore, even when injecting air to the recording papers P using the nozzles 96*a* to 96*h* all parallel to the feeding direction in a plan view, a positive static pressure can be produced among the recording papers P, so that the same effect as in the foregoing embodiments may be achieved.

Figure 22:
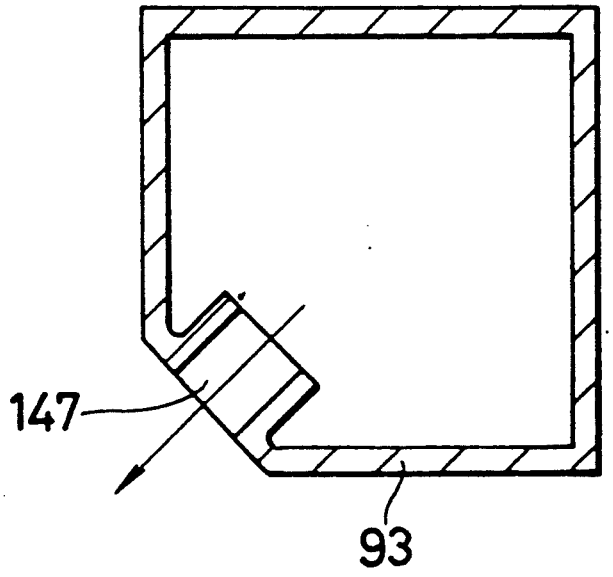
FIG. 22 is a sectional view showing other layout of nozzle member 93 and nozzle 96.

FIG. 22 is a sectional view showing a modified example of the nozzle member 93 in the foregoing embodiment. As shown in FIG. 5, the means for forming injection flow and air flow for separating the recording papers in the nozzle member 93 is not limited to the nozzles 96*a* to 96*a* as in the foregoing embodiment. For example, as shown in FIG. 22, in the nozzle member 93, plural nozzle holes 147 are fore md in the longitudinal direction of the nozzle member 93, that is, along the widthwise direction, and the axial direction of the nozzle holes 147 is identified with the axial direction of the nozzles 96*a* to 96*h*. In such embodiment, too, the same air flows as in the preceding embodiments may be formed, and the same effects as before are obtained.

Figure 23:
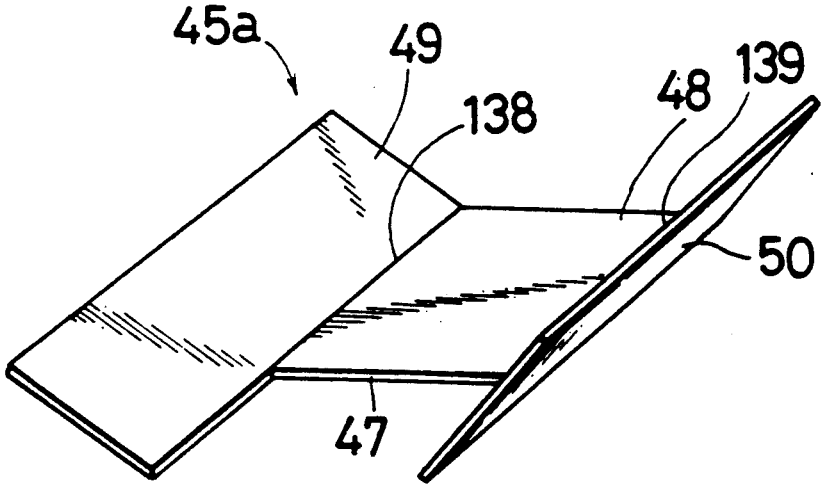
FIG. 23 through FIG. 26 are perspective views showing other layouts of laying plate 45.

The laying plate 45 in the foregoing embodiments forms stepped parts 51*a*, 51*b* at the downstream side end parts of the feeding direction A2 of the lateral laying parts 49 and 50. On the other hand, the essential constitution of the invention is to compose the regions 140*a*, 140*f* explained by reference to FIG. 17, in the bent parts 138, 139 of the laying plate 45, and therefore the structure of the laying plate 45 for realizing this action is not limited to the foregoing embodiments alone. A first modification example of the laying plate 45*a* is shown in FIG. 23, in which stepped parts 51*a*, 51*b* are not provided. Even in such constitution, the same effect as in the foregoing embodiments may be evidently achieved.

In the above embodiment, the action of stepped parts 51*a*, 51*b* has been explained, but when it is supposed that the flow rate form the nozzles 96*a*, 96*h* may be excessive as compared with that from the other nozzles 96*b* to 96*g*, the nozzles 96*a*, 96*h* may be reduced in diameter, and thus the supposed problem may be favorably avoided by modifications belonging to the scope of the properties of the invention.

Figure 24:
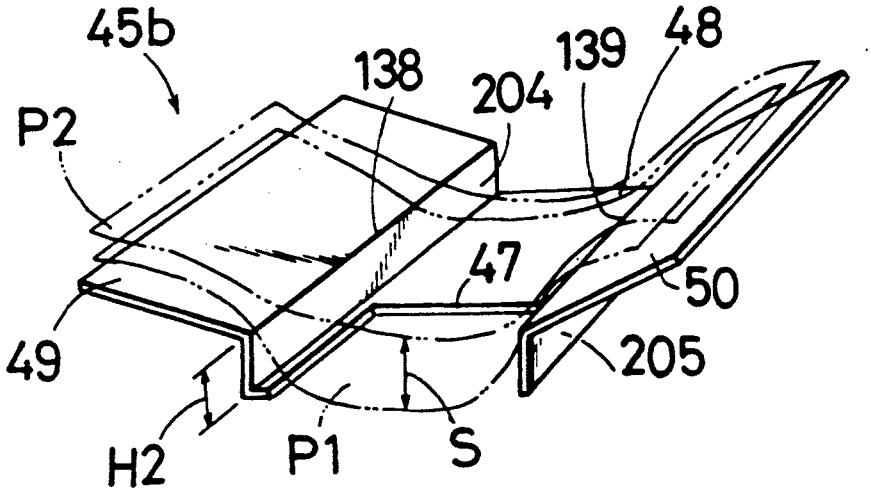

A second modification is given in FIG. 24. In this embodiment of the laying plate 45*b*, stepped parts 204, 205 with height H2 are disposed between the central laying part 48 and the lateral laying parts 49, 50, so that the central laying part 48 may be lower by the height H2 than the inward end of the widthwise direction of the lateral laying parts 49, 50. In this embodiment, the action due to the height $\delta$ of the step difference between the central laying part 48 and the upper stretching part 214 of the feeding stretch belt 98 explained in the foregoing embodiment may be further enhanced. That is, the bottom recording paper P1 of the recording papers P stacked on the laying plate 45*b* is largely curved and fits into the recess formed by the central laying part 48 and the stepped parts 204, 205, and the gap S to the second recording paper P2 may be set larger than in the foregoing embodiment. In such embodiment, not only the same effect as in the foregoing embodiment may be achieved, but also the separating capacity of the recording papers P may be further increased.

Figure 25:
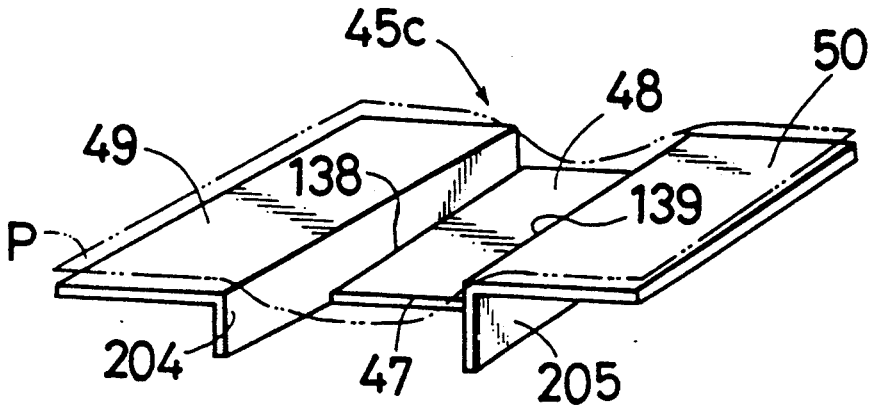

A third modification example is shown in FIG. 25. This laying plate 45*c* is similar to the laying plate 45*b* in FIG. 24, and the angle $\gamma$ formed between the lateral laying parts 49, 50 and the central laying part 48 is set nearly at 0 degree. That is, the stepped parts 204, 205 and the lateral laying parts 49, 50 are set to cross nearly orthogonally with each other, and the both lateral laying parts 49, 50 are determined within a same plane. In such embodiment, too, the separating capacity as in FIG. 24 may be achieved. In this modification, too, as compared with the inclined lateral laying parts 49, 50, the recording papers P stacked up on the laying plate 45*c* are prevented from producing an inward force in the widthwise direction due to the weight of the stacked recording papers. Therefore, even if the recording papers P are extremely low in the coefficient of friction, sliding of the recording papers in the widthwise inward direction is prevented.

Figure 26:
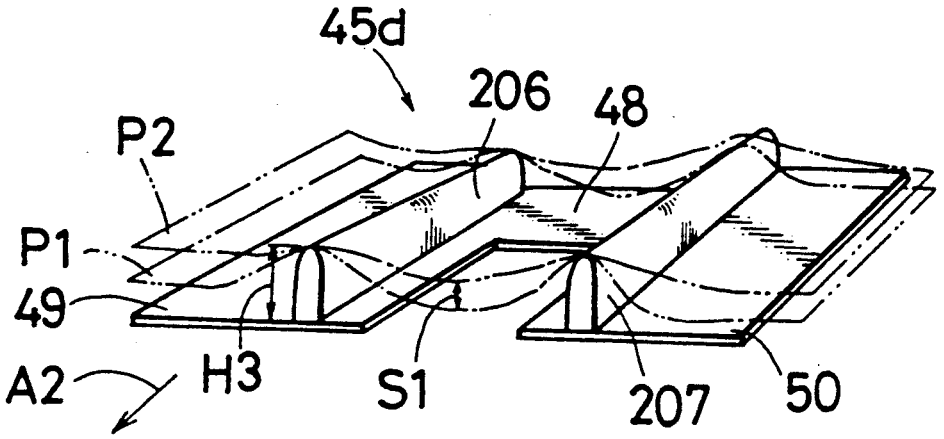

A fourth modification example is shown in FIG. 26. In this modified laying plate 45*d*, the central laying part 48 and lateral laying parts 49, 50 are formed flatly on a same plane. Besides, in the widthwise direction setting positions of the bent parts 138, 139 of the laying plates 45*a* to 45*c* in the above embodiments, protrusions 206, 207 extending parallel to the feeding direction A2 and projecting upward are formed in a height of, for example H3. This height H3 may be selected equal to the height H2 of the stepped parts 204, 205.

In such embodiment, the bottom recording paper P1 of the recording papers P stacked up on the laying plate 45*d* is curved along the shape of the laying plate 45*d*, but the second recording paper P2 is not exposed to the vacuum attracting action from the feeding stretch belt 96, so that a relatively large gap S1 may be formed between the recording papers P1 and P2. By such constitution, too, the same effect as in the preceding embodiments may be realized.

Figure 27:
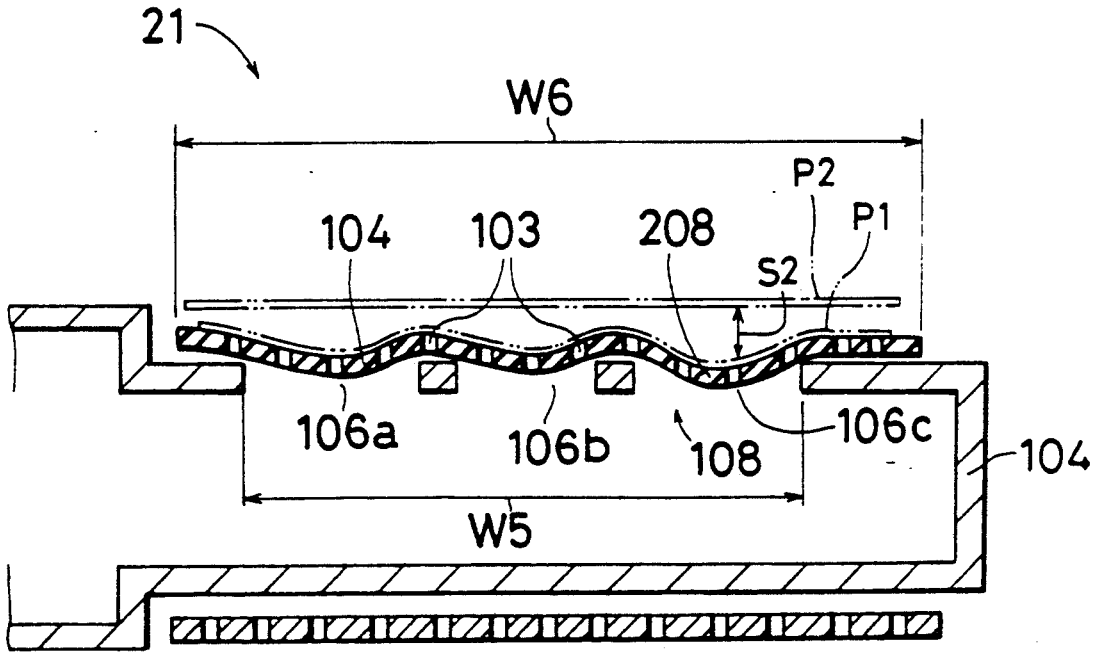
FIG. 27 is a sectional view showing other layout of the embodiment.

FIG. 27 is a sectional view showing a modified example of the feeding apparatus 21. The feature of this embodiment is that the feeding stretch belt 208 externally surrounding the vacuum attracting box 104 is composed of a single endless belt having a width W6 greater than the widthwise length W5 of the attracting region 108 in the vacuum attracting box 104. Multiple penetration holes 103 same a in the foregoing embodiments are formed in this feeding stretch belt 208, which is made of a relatively flexible material.

Therefore, the upper stretching part 214 stretched near the attracting region 108 of such feeding stretch belt 208 is curved largely as shown in FIG. 27 as being attracted by the negative pressure to the attracting ports 106*a* to 106*c*. Therefore, the bottom recording paper P1 of the stacked recording papers P is attracted in vacuum to the feeding stretch belt 208, and contacts with the feeding stretch belt 208 in the same deflection state. On the other hand, the second recording paper P2 is not exposed to such attracting action from the feeding stretch belt 208, an therefore a gap S2 is produced against the bottom recording paper P1. Thus, in this constitution, too, the same effect as in the foregoing embodiments may be obtained.

Figure 28:
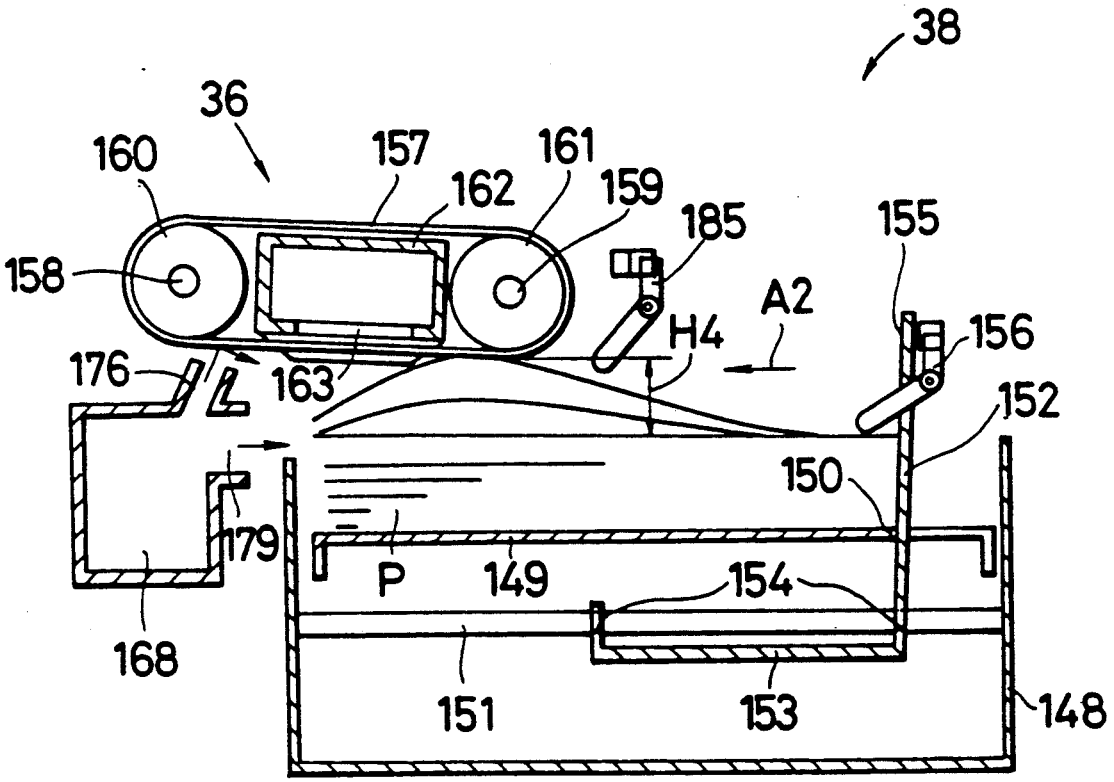
Figure 29:
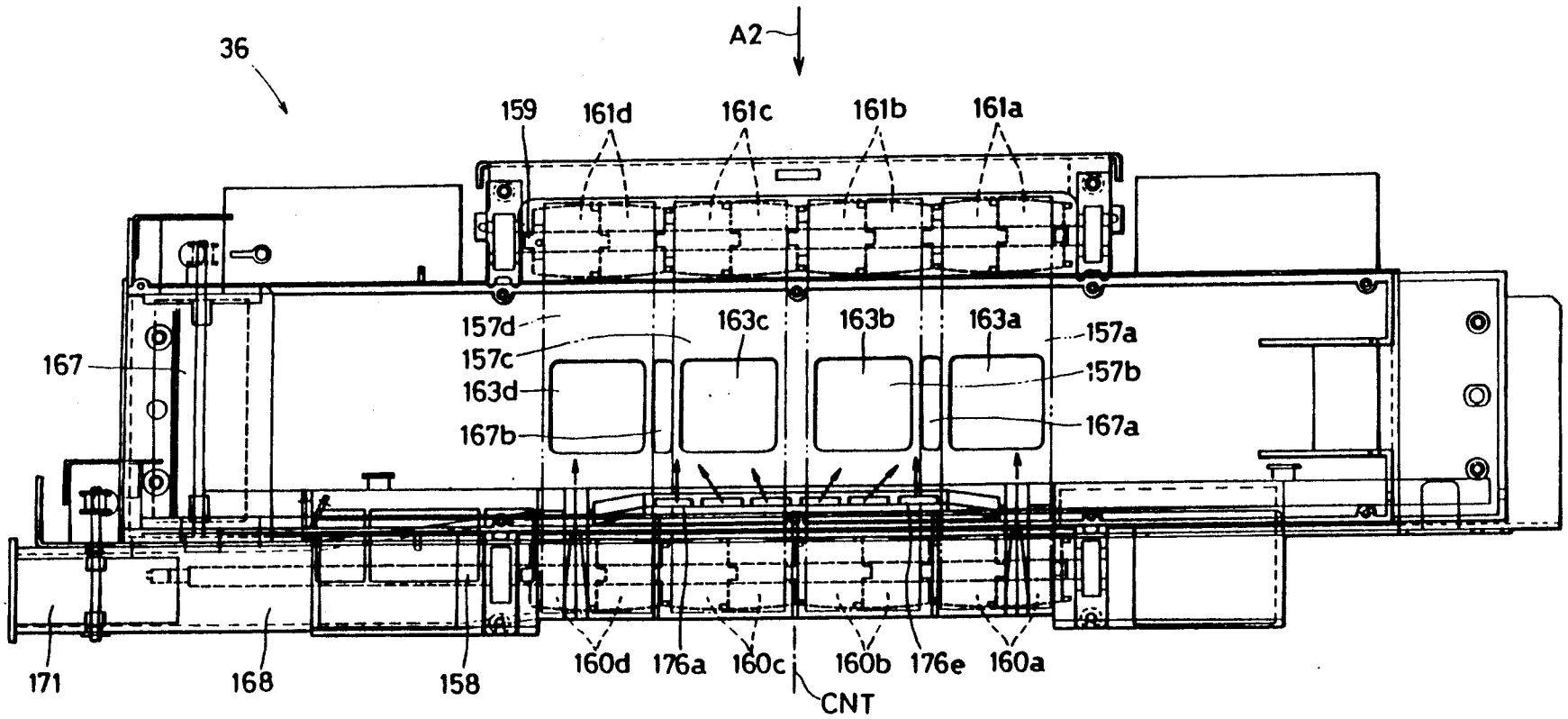
FIG. 29 is a side view showing the composition of the paper feeder 38.
Figure 30:
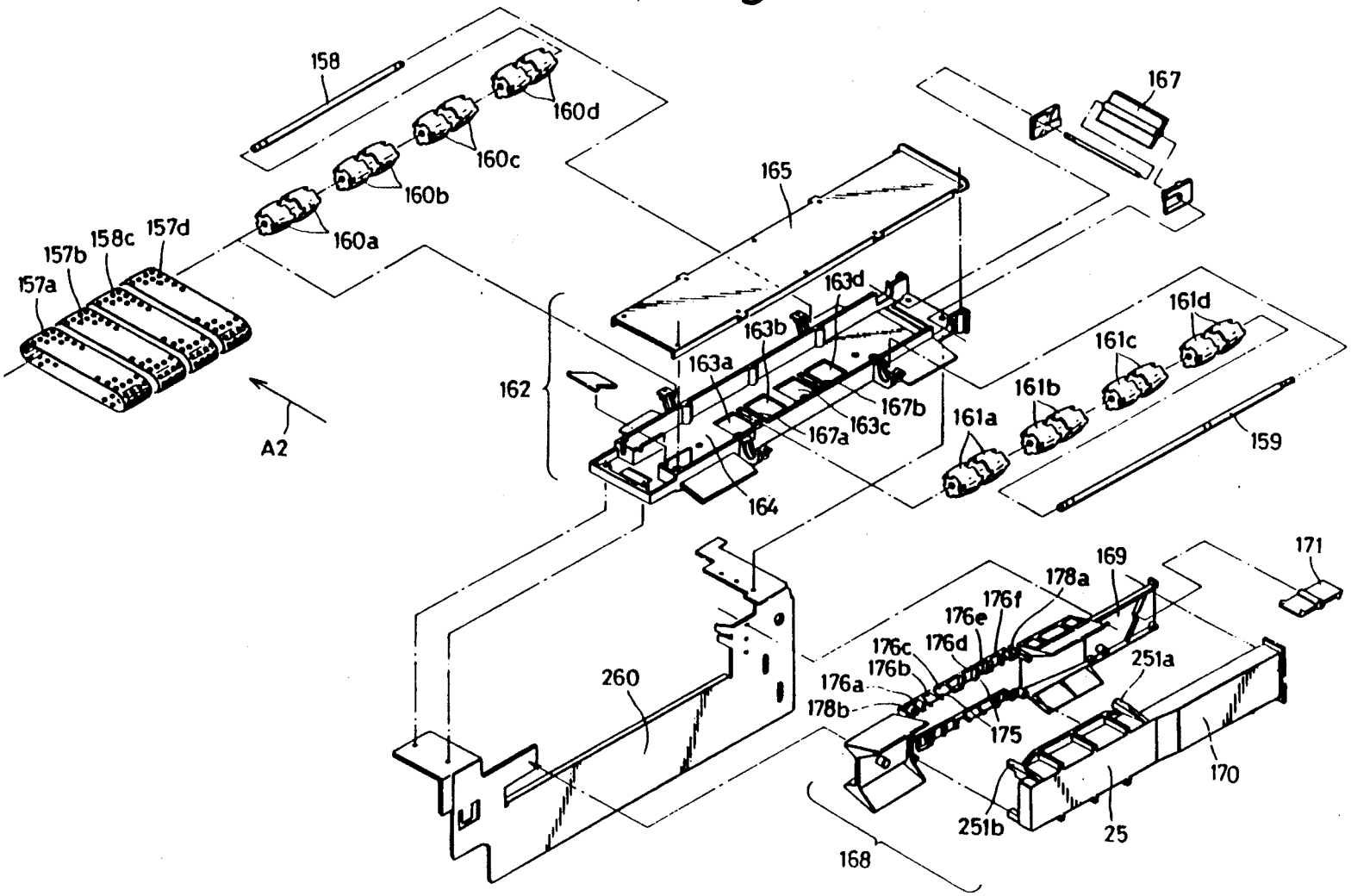
FIG. 30 is an exploded perspective view of the composition shown in FIG. 29.

FIG. 28 is a side view showing a section of a paper feeder 38 in a copying machine 22. FIG. 29 is a plan view of FIG. 28. FIG. 30 is an exploded perspective view of the paper feeder 38, and FIG. 31 is a simplified plan view of the paper feeder 38. Referring now to these drawings, the constitution of the paper feeder 38 is explained below. The other paper feeders 39, 40 are composed alike. Meanwhile, the constituent elements of the paper feeder in this embodiment are similar to the constituent elements in the paper feeder 21 in the foregoing embodiments. except that this embodiments relates to the top-taking structure while the paper feeder 21 is of so-called bottom-taking top-returning structure.

The paper feeder 38 comprises a frame body 148 in which recording papers are stacked and stored, and a feeding unit 220 for separating and feeding one by one the recording papers stacked an stored in the frame body 148, and the frame body 148 incorporates a laying plate 149 being driven vertically by a lifting mechanism mentioned below on which recording papers P are stacked up. The laying plate 149 has a slot 150 extending in the feeding direction A2, and a guide rail 151 extending along the feeding direction A2 is formed beneath the laying plate 149. This guide rail 151 is provided with a mounting part 153 of a rear end defining member 152, slidably in the longitudinal direction, through plural insertion holes 154 in the mounting part 153. The rear end defining member 152 is provided with a defining part 155 extending above the laying plate 149 through the slots 150 of the laying plate 149 disposed in the mounting part 153. At a predetermined position of the defining part 1555, an upper limit sensor 156 such as limit switch is provided, and when an excessive recording paper P is put on the laying plate 149, it is detected.

At a position predetermined with respect to the laying plate 149 of the machine body of the copying machine 22, an upper limit switch 185 realized, for example, by a limit switch is provided, and it is detected that the top recording paper P1 of the recording papers P stacked up on the laying plate 149 has a predetermined gap of H4 to the feeding stretch belt 157. That is, when the top recording paper P1 approaches abnormally, exceeding the distance H4 to the feeding stretch belt 157, the upper limit sensor 185 is actuated to stop elevation of the recording paper.

The paper feeder 36 is provided with, for example, four feeding stretch belts 157*a* to 157*d* at predetermined positions with respect to the frame body 148. These feeding stretch belts 157*a* to 157*d* are stretched respectively on the rollers 160*a* to 160*d*; 161*a* to 161*d* fixed on the rotary shafts 158, 159. Between the rollers 160 and 161, a vacuum attracting box 162 is stored, which comprises a main body 164 forming attracting ports 163*a* to 163*d* opposite to the feeding stretch belts 157*a* to 157*d*, and a cover body 165 covering the main body 164. A damper 166 is concentrated in the vacuum attracting box 162, and a vacuum source (not shown) to which the vacuum attracting box 162 and the vacuum attracting box 162 are communicated/shut off. The attracting box 162 is supported by a support member 260 fixed on the frame body 148. Between attracting ports 163*a*, 163 *b* and the attracting ports 163*c*, 163*d* of the main body 164, protrusions 167*a*, 167*b* extending along the feeding direction A2 and projecting downward are formed, and they project downward from between the feeding stretch belts 157*a*, 157*b*, and feeding stretch belts 157*c*, 157*d*.

At the downstream side of the feeding direction A2 of the frame body 148 and beneath the feeding stretch belt 157, a nozzle member 168 is provided. The nozzle member 168 contains the main body 169 and cover body 170, and a damper 171 is included in an internal air passage 216, thereby communicating/shutting off the blower (not shown) and the nozzle member 168.

The layer plate 149 in the frame body 148 is provided with slots 209, 210 along the widthwise direction, and lateral end defining plates 195, 196 ar inserted from top to bottom of the laying plate 149. Near the rear side end of the laying plate 149 of the lateral end defining plates 195, 196, one longitudinal end of the driving members 197, 198 extending along the widthwise direction is fixed. At the mutually confronting end parts along the feeding direction A2 of the driving members 197, 198, racks 199, 200 are formed, and these racks 199, 200 are engaged mutually from the opposite dies with a pinion 201 rotatably disposed on a support plate 149 disposed between the driving members 197, 198.

Regarding the lateral end defining plate 195, a widthwise displacement position is detected, for example, by three positions sensors S1, S2, S3 which are disposed from outward to inward in the widthwise direction. The lateral end defining plates 195, 196 cooperate with each other by means of the racks 199, 200 and pinion 201, and by aligning the distance of the lateral end defining plates 195 in the widthwise length of the stored recording papers P, the widthwise length of the stored recording papers can be detected on the basis of the output from the position sensors S1 to S3.

Figure 32:
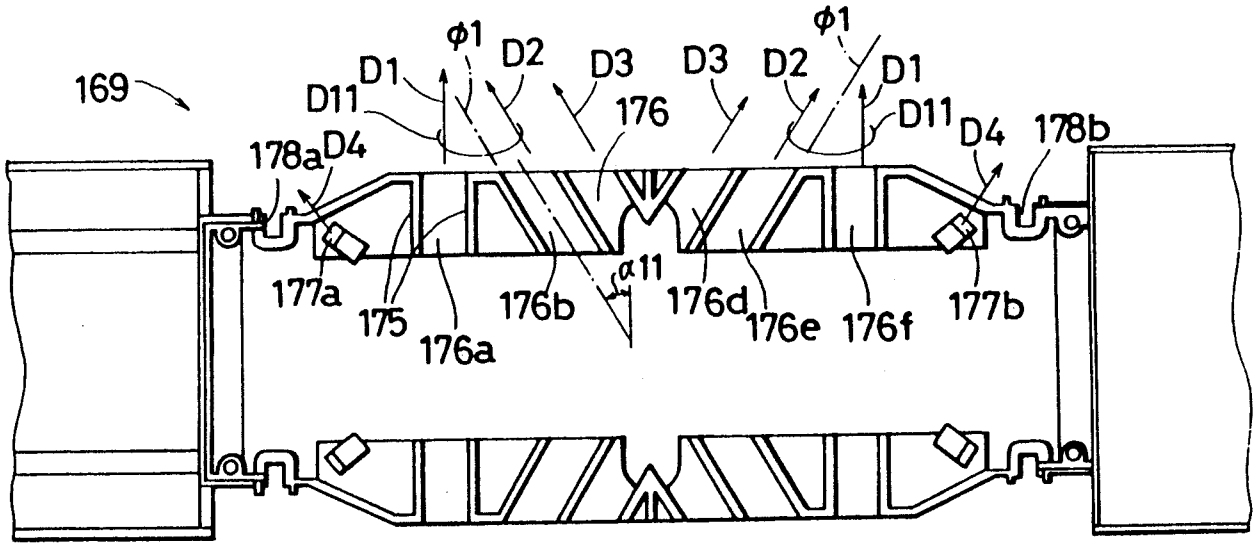
FIG. 32 is a front view of a main body 169 of a draft duct 168.
Figure 33:
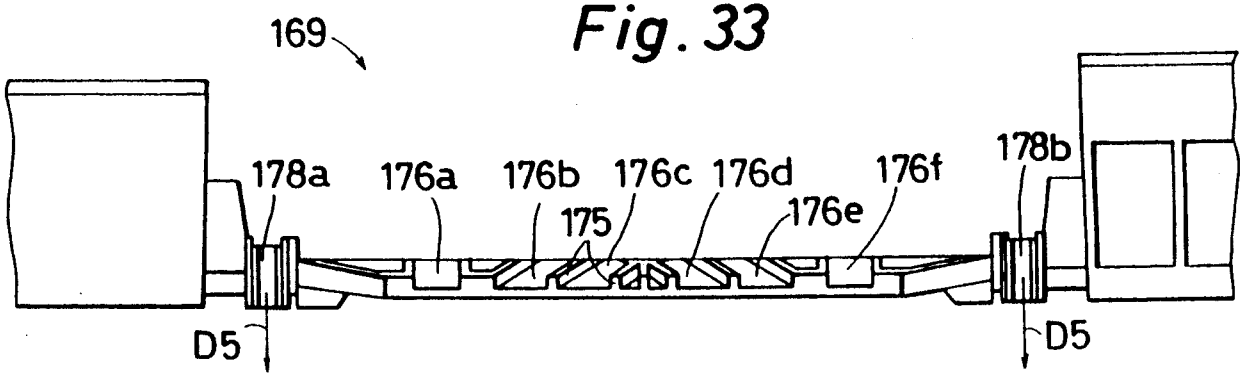
FIG. 33 is a plan view of the main body 169.
Figure 34:
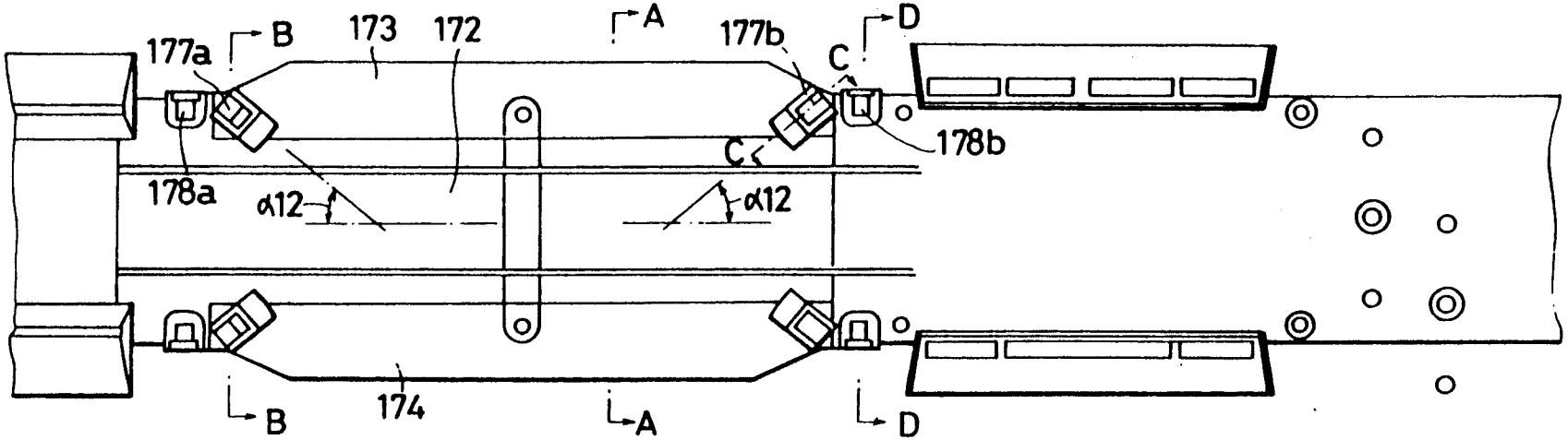
FIG. 34 is a rear view of the main body 169.

FIG. 32 is a front view of the main body 169. FIG. 33 is a plan view of the main body 169. FIG. 34 is a back view of the main body 169, and FIGS. 3 to 38 are sectional vies seen from the sectional lines A—A, B—B, C—C, D—D in FIG. 34. Referring together to these drawings, the composition of the nozzle member 168 is described in detail below. The main body 169 comprises a flat plate 172 extending in the widthwise direction, and slope 173, 174 consecutive to the vertical direction thereof and inclined by an angle $\theta 3$ (e.g. 20 degrees) to the main body 148 side. At the downstream side of the feeding direction A2 of the slopes 173, 174, plural guide pieces 175 are formed, and when the cover body 170 is put on the main body 169, nozzle holes 176*a* to 176*f* forming the same jet flows D1 to D3 as the jet flows C1 to C3 by the nozzle 96 in the foregoing embodiment are formed by the adjacent guide pieces 175, and the nozzle is composed of the nozzle holes 176*a* to 176*f* and the adjacent guide pieces 175.

The nozzle holes 176*a*, 176*f* form a jet flow of arrow D1 toward the feeding stretch belt 157, in the vertical plane parallel to the feeding direction A2. The nozzle holes 176*b*, 176*f* have an angle of $\alpha 11$ (e.g. 30 degrees) to the feeding direction A2 in a plan view, and form a jet flow expressed by arrow D2 directed to the feeding stretch belt 157. The nozzle holes 176*c*, 176*d* form a jet flow and an air flow parallel to the arrow D2 an indicated by arrow D3. The jet flow D1, D2 are converged and synthesized on the central line 11 to form an air flow D11. In the lower stretched part 215 of the feeding stretch belt 157, the flow is injected to the position remote to the downstream side by the predetermined distance L5 from the downstream side end part of the feeding direction of the recording paper attracted so as to cover the attracting region 108 defined by the attracting vacuum box 162 and the range exceeding to the downstream side of the feeding direction A2. The reflected air flow from the feeding stretch belt 157 is blown and injected between the top recording paper P1 and the second recording paper P2. The injected air flow is inflated in the vertical direction, thereby separating the recording papers P1, P2.

Figure 37:
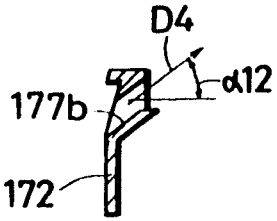
Figure 36:
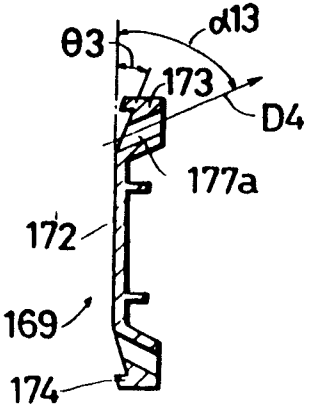

Further outward of the nozzle holes 176*a*, 176*f* of the main body 169, there are formed nozzle holes 177*a*, 177*b* having the sectional shapes as shown in FIGS. 36 and 37. The nozzle holes 177*a*, 177*b* are composed at an inclination outward in the widthwise direction as going upstream in the feeding direction at an angle of $\alpha$12 (e.g. 40 degrees) with respect to the widthwise direction as shown in FIG. 34 outward in the widthwise direction, and are composed at an inclination to the upstream side of the feeding direction A2 as going from downward topward by an angle of $\alpha$13 (e.g. 65.7 degrees) from the vertical direction as shown in FIG. 36.

Figure 38:
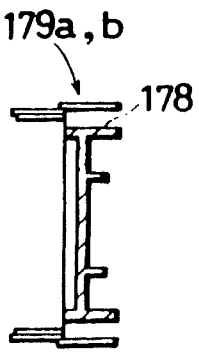
FIG. 35 through FIG. 38 are sectional views seen from sectional lines A—A, B—B, C—C, D—D in FIG. 34.

That is, to the upstream side of the feeding direction A2 than the jet flow of the nozzle holes 176*a* to 176*f*, the jet flow and air flow are injected as indicated by arrows D4. Further outward in the widthwise direction from the nozzle holes 177*a*, 177*b* of the main body 169, groves 178*a*, 178*b* parallel to the feeding direction A2 are formed as the sectional shape is shown in FIG. 38. The grooves 178*a*, 178*b* are covered with the cover body 170 as shown in FIG. 38, and form a jet flow and an air flow parallel to the feeding direction A2 (indicated by arrow D5).

Figure 35:
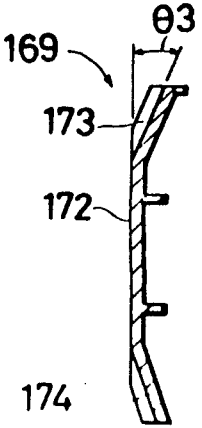

The cover body 170 shown in FIG. 35 is put on thus composed main body 169. At both sides of the cover body 170 in the widthwise direction, fitting projections 251*a* and 251*b* having a pair of upper and lower nozzle holes 252*a* and 252*b* are formed. These projections 251*a* and 251*b* are projected in the feeding direction A2, and the nozzle holes 252*a* and 252*b* are composed by the holes 250*a*, 178*a*; 250*b* and 178*b* in the state of being fitted to the grooves 178*a* and 178*b* of the main body 169. From these nozzle holes 252*a* and 252*b*, a jet flow may be formed in the direction of arrow D5 as shown in FIG. 28. A pair of upper and lower ribs 254 and 255 are integrally formed on the end plate 253 of such over body 170, and by these ribs 254 and 255, the nozzle holes 176*a* to 176*e* are defined in the state of communicating in the direction of jet flows D1 to D3.

Figure 40:
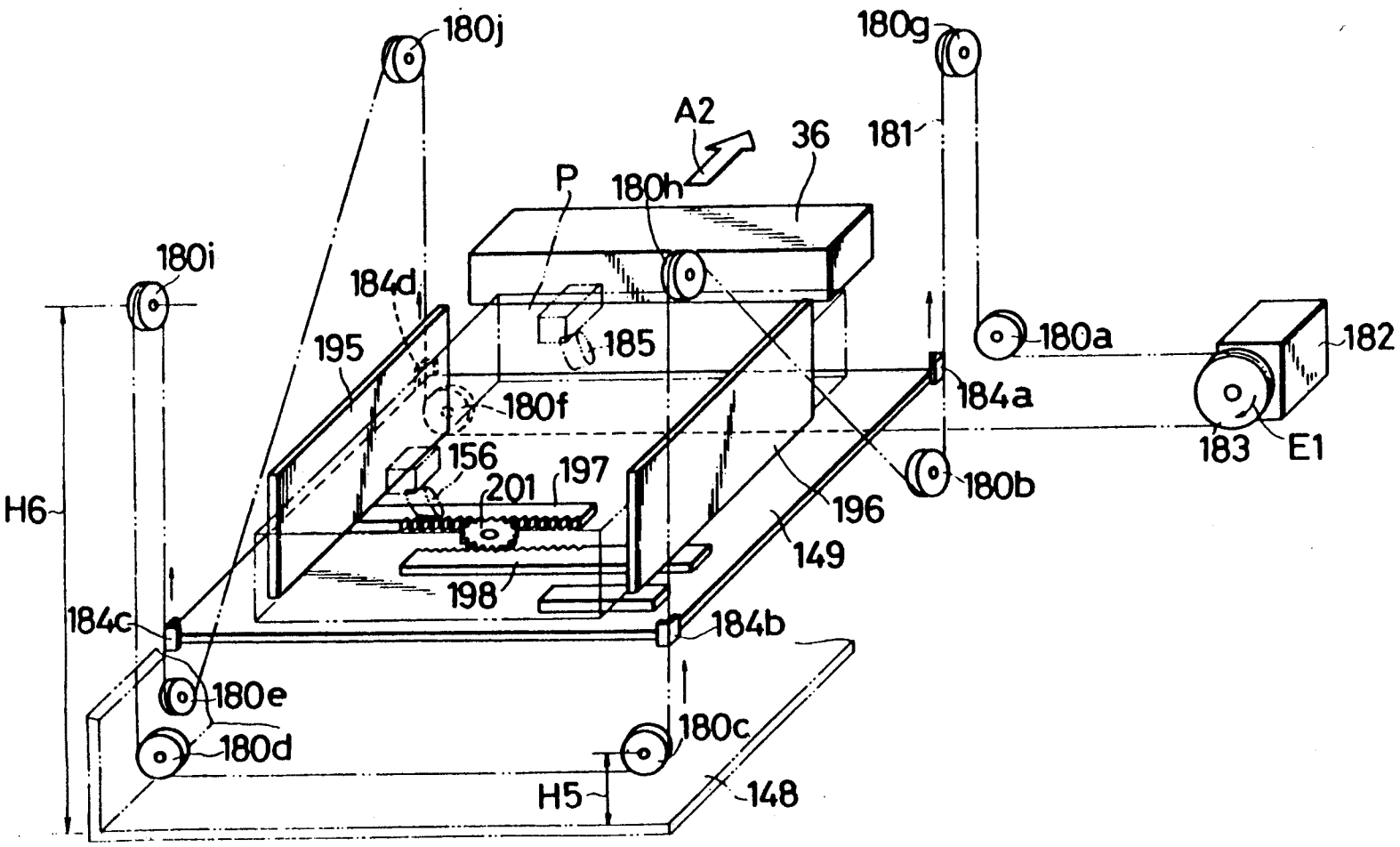
FIG. 40 is a block diagram from explaining a lifting mechanism of the laying plate 149 in the paper feeder 38.

FIG. 40 is a perspective view showing the composition of elevating the laying plate 149 in the paper feeder 38. In the frame body 148, plural pulleys 180*a* to 180*f* are disposed as shown in the drawing at a predetermined height H5 from the bottom of the frame body 148, and pulleys 180*g* to 180*j* are disposed at a position of a predetermined height H6 from the bottom. A wire 181 is applied on these pulleys 180*a* to 180*j*, and the both ends of the wire 181 are wound around a driving roller 183 rotated by a pulse motor 182. In the portions stretching vertically at four corners of the frame body 148 of this wire 181, support pieces 184*a* to 184*d* from mounting the four corners of the laying plate 149 are fixed.

That is, when the driving roller 183 is rotated in the direction of arrow E1 by the pulse motor 182, the laying plate 149 is elevated, while the laying plate 149 is lowered. Thus, as shown in FIG. 28, the highest recording paper P1 in the vertical direction of the recording papers P put on the laying plate 149 is maintained at a position remote by a predetermined distance of H4 from the feeding stretch belts 157*a* to 157*d*. Consequently, a favorable vacuum attracting action of the top recording paper P by the feeding stretch belts 157*a* to 157*d* may be realized.

Figure 41:
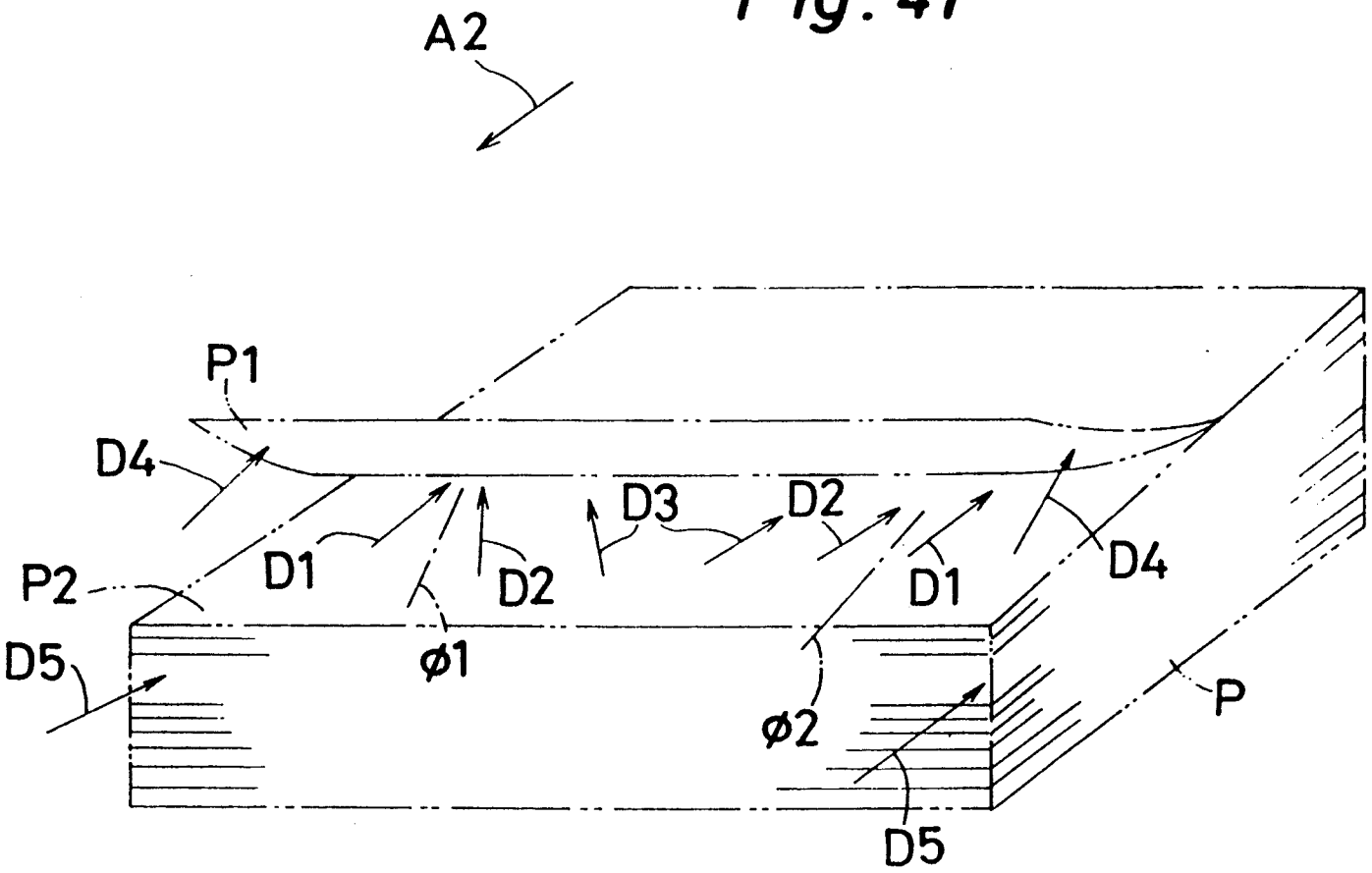
FIG. 41 is a perspective view for explaining the action of air streams in the embodiment.

FIG. 41 is a perspective view for explaining the basic function of each air flow indicated by arrows D1 to D5 and D11 from the nozzle holes 176*a* to 176*f*; 177*a*, 177*b*; 178*a* and 178*b*. The jet flows of arrows D1 and D2 are concentrated as an air flow D11 in the widthwise direction of the recording paper P, and it is blown in and injected in the gap formed as shown below between the top recording paper P1 and the second recording paper P2, and is inflated in the vertical direction to separate the recording papers P1 and P2. The air flow indicated by arrows D3 also separates the recording papers P1 and P2 as mentioned below.

The air flow D5 from the nozzle holes 178*a* and 178*b* is an air stream injected parallel to the feeding direction A2 in the relatively upward portion of the stacked recording papers P, and it maintains a plurality of recording papers P near the upper part always in a lifted state. On the other hand, the air flow indicated by arrow D4 from the nozzle holes 177*a* and 177*b* pushes up the uppermost recording paper P1 of the plurality of recording papers P lifted by the air flow of arrow D5 to the feeding stretch belt 157 side, and the recording paper P1 is attracted in vacuum to the feeding stretch belt 157 by the negative pressure by the vacuum attracting box 162. At this time, in order that the plural recording papers P may not be attracted at the same time, the recording papers P are separated by the air flows indicated by arrows D11 and D3.

Figure 42:
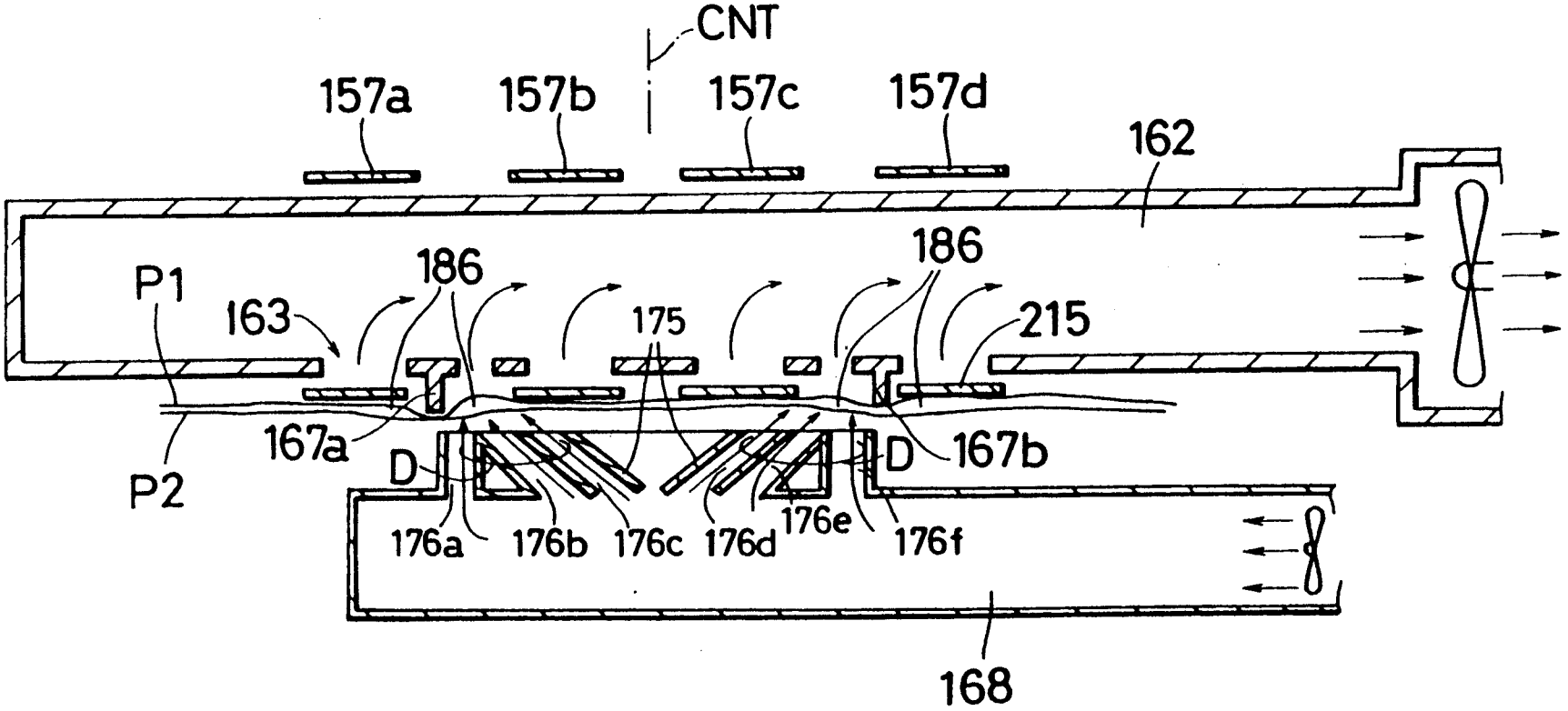
FIG. 42 is a sectional view for explaining the action of the embodiment.

FIG. 42 is a sectional view explaining the separating action of the recording papers P in the paper feeder 38. For the sake of simplicity of explanation, the structure is shown in a simplified form in FIG. 42. Hereinafter, the nozzle holes 176*a* to 176*f* and the guide pieces 175 for defining them are collectively called a handling nozzle and indicated by same reference number. Besides, the nozzle holes 177*a*, 177*b*; 179*a* and 179*b* and guide pieces 175 for defining them are called pushing nozzle and lifting nozzle, respectively, and indicated by same reference numbers. As shown in FIG. 28 and FIG. 41, when the air flow indicated by arrow D5 is injected from the lifting nozzle 179 of the nozzle member 168 to the recording papers P stacked up on the laying plate 149, the relatively upper recording papers of the stacked recording papers P are lifted within the frame body 148.

At this time, when a negative pressure is generated in the vacuum attracting box 162, the floating recording papers P are attracted vacuum to the lower stretching part 215 of the feeding stretch belt 157. The top recording paper P1 at this time is attracted in vacuum to the lower stretching part 215 of the feeding stretch belt 157 while being lifted by the protrusions 167*a*, 167*b* projecting downward from within the feeding stretch belt 157, being formed in the vacuum attracting box 162. The second recording papers P2 is prevented from being attracted to the feeding stretch belt 157 because almost entire portion of the lower stretched part 215 of the feeding stretch belt 157 is covered by the recording paper P1. If attracted, it is only relatively weakly attracted. Accordingly, as shown in FIG. 42, a gap 186 is produced between the recording papers P1 and P2, near the protrusions 167*a* and 167*b*.

The air flow D from the handling nozzles 176*a* to 176*f* collides against the portion not opposing the attracting port 163, once at the feeding stretch belt 157, as mentioned above, and its reflected flow is injected between the recording papers P1 and P2. Therefore, the air flow injected downward in the gap 186 is inflated in the vertical direction, and the recording papers P1 and P2 are separated by this positive pressure. The air flow in the direction of arrow D3 from the handling nozzles 176*c* and 176*d* is attracted into the gap 186, and realizes the same separating action. The pushing nozzles 177*a* and 177*b* are to lift one or plural recording papers P of the uppermost area of the floating recording papers P to the feeding stretch belt 157 side.

In this embodiment, too, air flows C11 and C3 inflating in the vertical direction are formed at symmetrical positions about the widthwise central position CNT of the recording paper, and a satisfactory separating action is realized whether the recording papers P being used are relatively large or small in size. What is more, the air flow from the nozzle member 168 is concentrated in the widthwise plural position to the recording papers P, and if the recording papers are relatively small in size or weight, scattering of the recording papers P by the air flow from the handling nozzles 176*a* to 176*f* without being attracted to the feeding stretch belt 157 may be avoided. Besides, although the air flow from the handling nozzle 176*e* is directed from inward to the outward side in the widthwise direction, this air flow is blocked by the air flow from the handling nozzles 176*a* and 176*f*, and leakage from both ends of the widthwise direction of the recording papers P may be prevented. Hence, it is possible to avoid flapping of the both ends in the widthwise direction at the recording papers P, disturbance of stacked state, or generation of noise.

Figure 43:
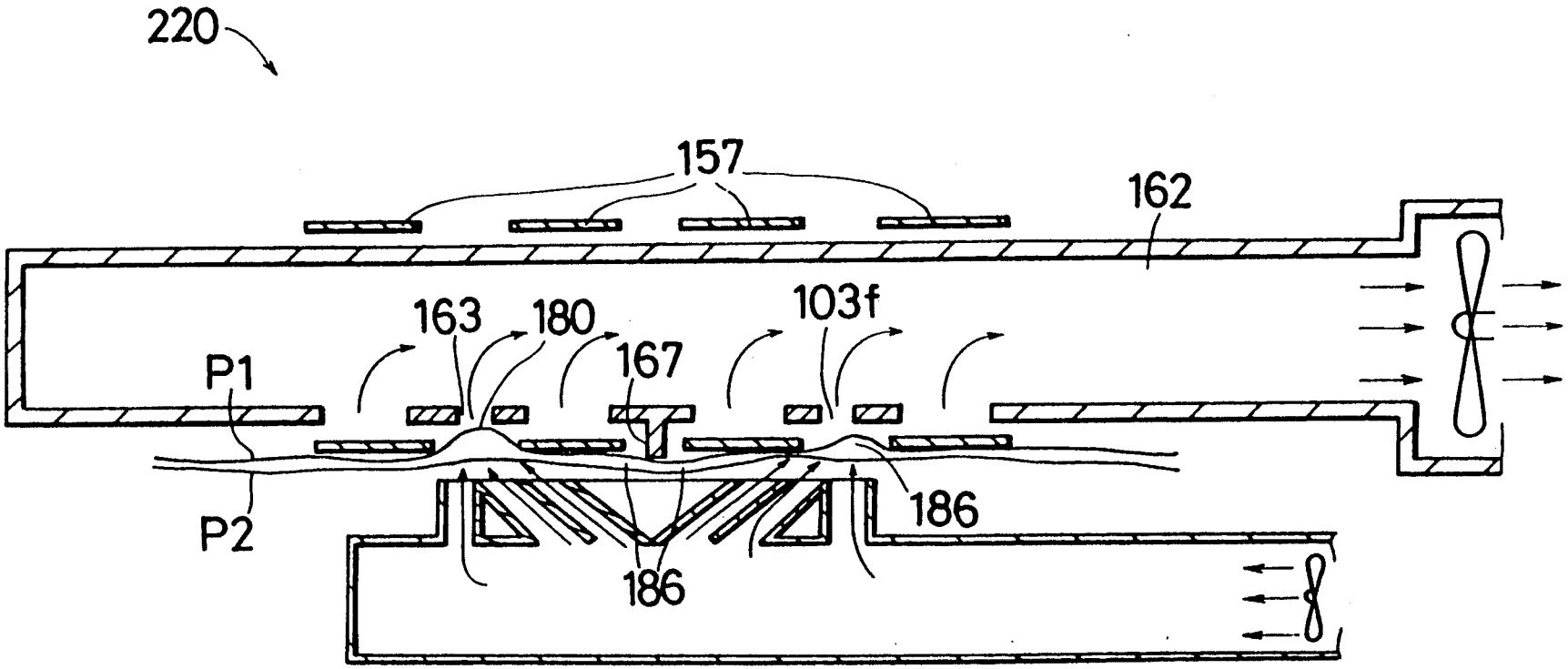
FIG. 43 is a sectional view for explaining other constitution of the embodiment.

FIG. 43 is a sectional view showing other constitutional example of the feeding unit 220 of the paper feeder 38. This embodiment is similar to the foregoing embodiments, and corresponding parts are identified with same reference numbers. What is of note in this embodiment is that the protrusion 167 formed in the vacuum attracting box 162 is determined so as to be positioned in the widthwise central position CNT between the feeding stretch belts 157*b* and 157*c*, and that attracting ports 163*e* and 163*f* are disposed in the vacuum attracting box 162 between the feeding stretch belts 157*a* and 157*b*, and between the feeding stretch belts 157*c* and 157*d*.

Figure 39:
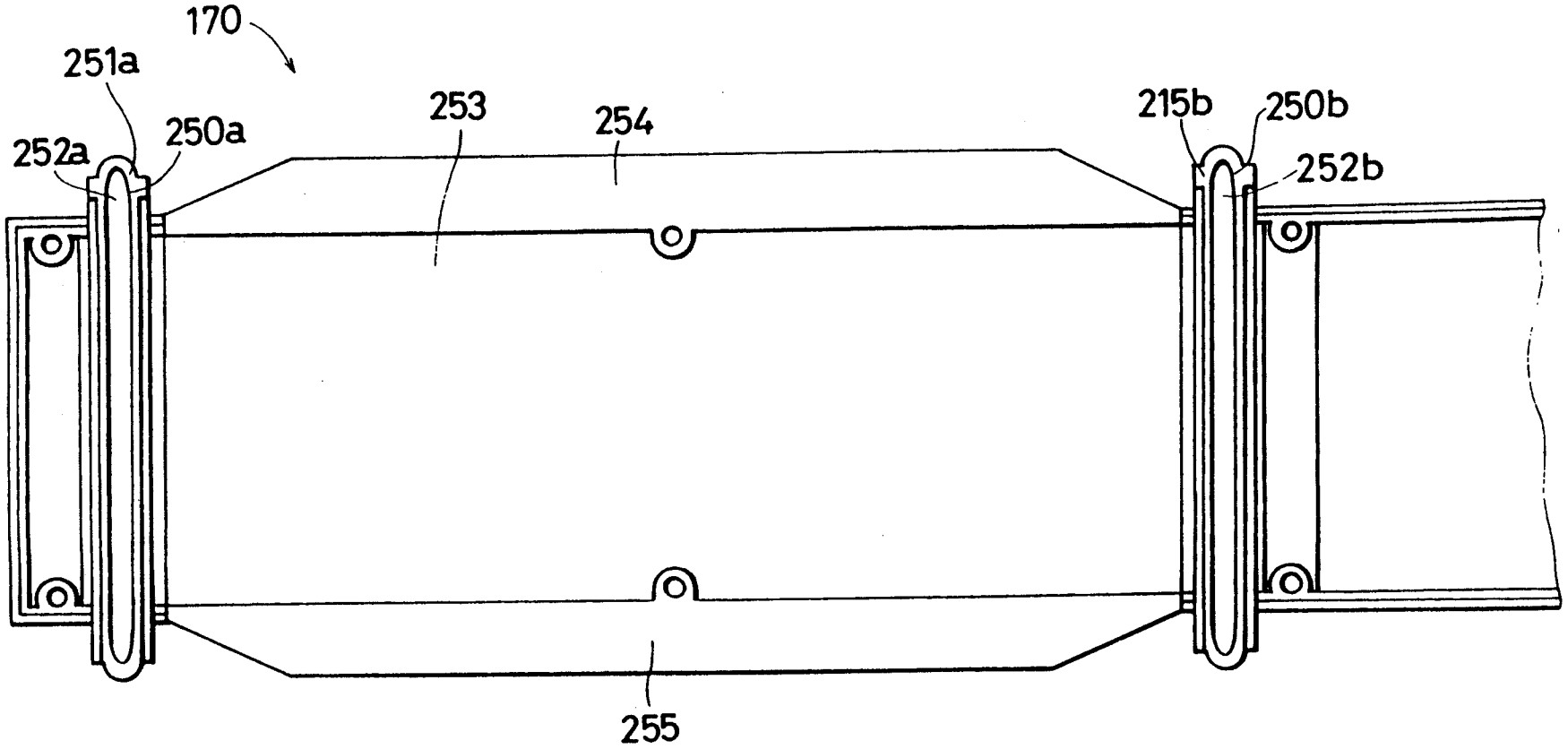
FIG. 39 is a front view of a cover main body 170.

Employing such constitution, as explained by reference to FIGS. 28 and 41, the recording paper P on the laying plate 149 is lifted by the lifting nozzles 179*a* and 179*b*, and the lifted recording paper P is pushed up by the pushing nozzles 177*a* and 177*b* to the feeding stretch belt 157 side. When the vacuum attracting box 162 generates a negative pressure, the top recording paper P1 is attracted to the feeding stretch belt 157, but the range opposing the attracting ports 163*e* and 163*f* is the gap of the feeding stretch belt 157, and therefore the recording paper p1 is attracted and dented to the vacuum attracting box 162 side as shown in FIG. 39. It is the same with the recording paper P1 opposing the attracting port 163*f*. Furthermore, the recording paper P1 is lifted in the direction of going away from the vacuum attracting box 162 by the protrusion 167 formed in the central position CNT.

Therefore, between the recording papers P1 and P2, a gap 186 is formed at the position corresponding to the attracting ports 163*e*, 163*f* and protrusion 167. Therefore, the air flows C11, C3 due to handling nozzles 176*a* to 176*f* are injected into the gap 186, and inflated in the vertical direction as mentioned above to separate the recording papers P1 and P2. In such embodiment, too, the same effect as mentioned in the foregoing embodiments is achieved.

Figure 44:
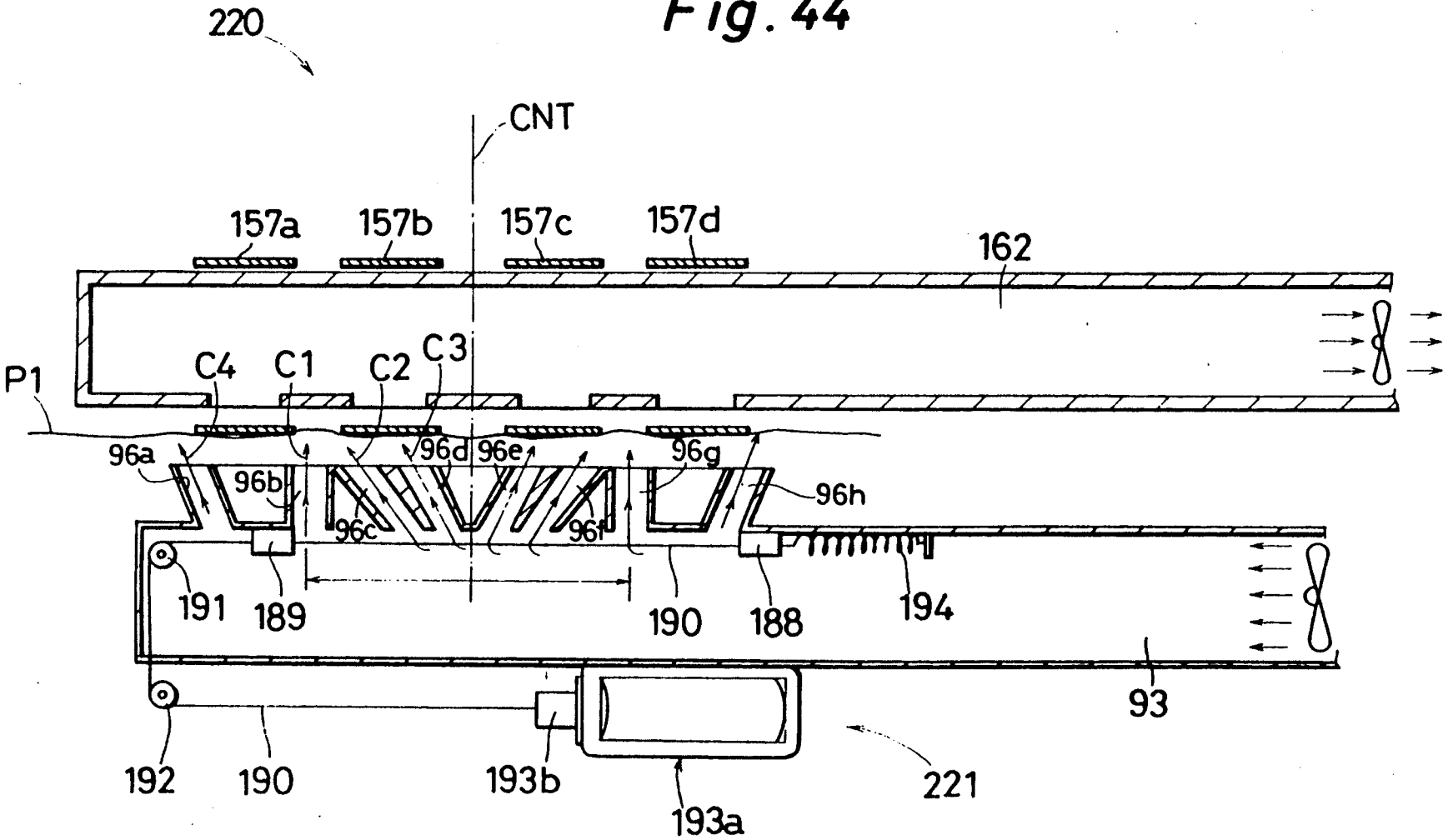
FIG. 44 is a sectional view for explaining the constitution of the embodiment.

FIG. 44 is a sectional view showing other constitutional example of the nozzle member 93 in the feeding unit 21. This embodiment is similar to the foregoing embodiments, and corresponding parts are identified with the same reference numbers. The nozzle member 93 comprise nozzles 96*a* to 96*h* in the configuration as mentioned above, and injection flows C1, C2, C3 and C4 as mentioned in the preceding embodiments are formed. In the nozzle member 93, the valve body 188 is disposed outward in the widthwise direction of the nozzle 96*h*, and the valve body 189 is disposed inward in the widthwise direction of the nozzle 96*a*. These valve bodies 188 and 189 are disposed so as to be reciprocally displaceable only in the widthwise direction, and are mutually coupled with a wire 190. This wire 190 connects the valve body 189 to the plunger 193*b* of the electromagnetic solenoid 193*a* disposed outside the nozzle member 93 through the pulleys 191 and 192. The valve body 188 has a spring 94, and it is thrust in the opposite direction of the valve body 189. The wire 190, pulleys 191 and 192, electromagnetic solenoid 193*a* and plunger 193*b* are combined to compose the opening and closing driving means 221.

More specifically, the valve bodies 188 and 189 are determined at the positions shown in FIG. 44 by the spring force of the spring 194 as far as the electromagnetic solenoid 193*a* is not actuated, and the nozzles 96*a* and 96*h* are fully open. On the other hand, when the electromagnetic solenoid 193*a* is actuated to contract the plunger 193*b*, the valve bodies 188 and 189 are pulled in the arrow E3 direction by the wire 190, and are moved to the base part of the nozzles 96*a* and 96*h*, thereby shielding these nozzle 96*a* and 96*h*. At this time, the jet flow obtained from the nozzles member 93 is only the flows indicated by arrows C1 to C3.

Figure 45:
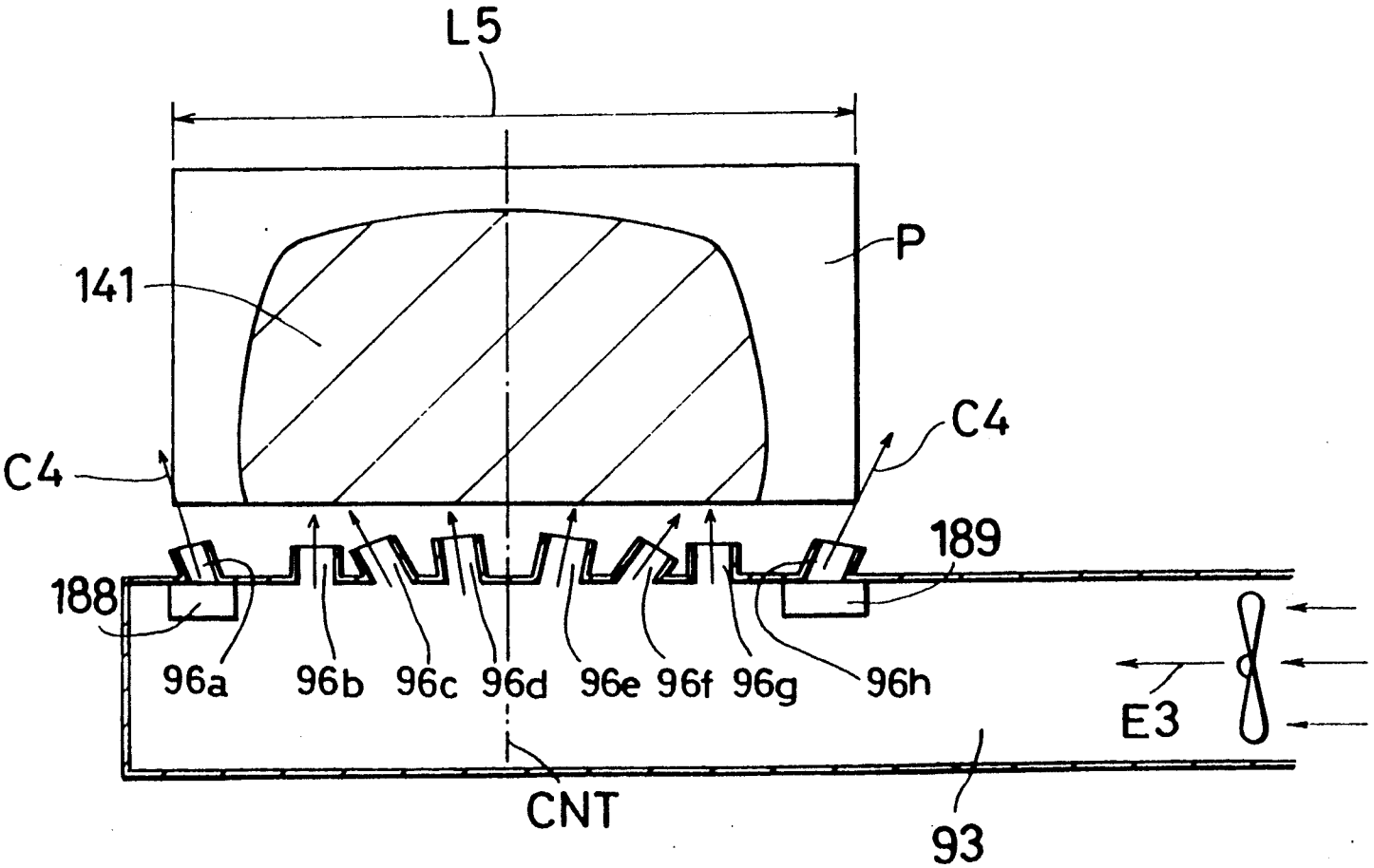
FIG. 45 and FIG. 46 are plan views for explaining the action of the embodiment.
Figure 46:
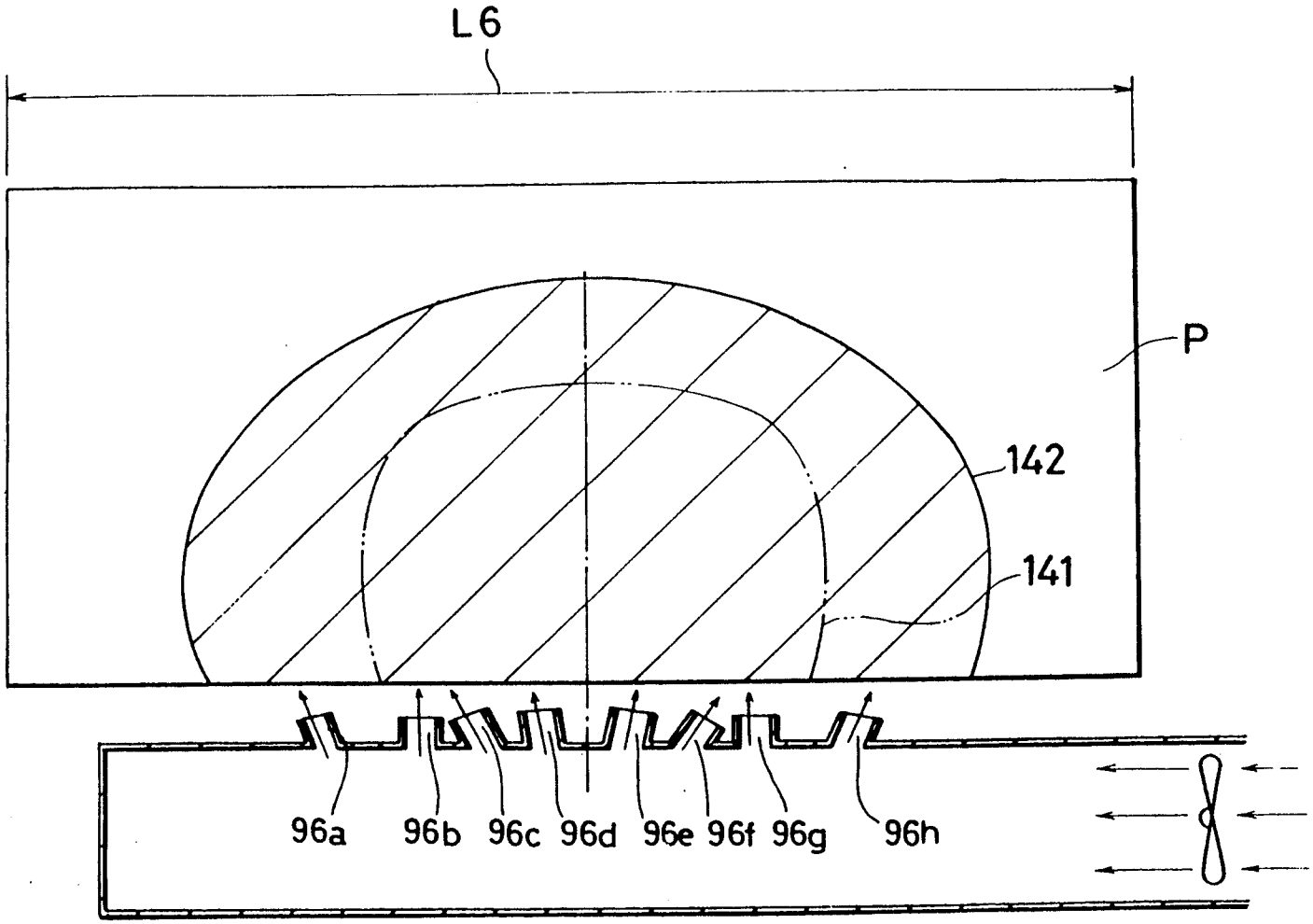

FIG. 45 and FIG. 46 are plane views for explaining the action of the embodiment. The type of the recording paper carried into feeding unit 21 is determined by selecting any one of the paper feeders 38 to 40 in the foregoing embodiment. That is, for example, in the selected paper feeder 38, the paper width detection mechanism 222 as explained by reference to FIG. 31 is disposed, and the CPU 132 shown in FIG. 11 can detect the width of the set recording paper, by the dislocating position of the lateral end defining members 195 and 196 set manually, for example.

When the size of the selected recording paper is relatively small, for instance, width L5 shown in FIG. 45, if the air flow C4 from the nozzles 96*a* and 96*h* is formed, this air flow C4 leaks from both ends of the widthwise direction of the recording paper P outward in the widthwise direction, and both widthwise ends of the recording paper P come to flap. In this case, the stacked state of the recording papers P in the paper feeder 21 is disturbed, and duplicate feed, defective feed or noise may be caused.

In this embodiment, in order to avoid such trouble, when the paper P is relatively small in size, the electromagnetic solenoid 193*a* is actuated by controlling the CPU 132, and the valve bodies 188 and 189 are moved in the direction of arrow E3 to the base part of the nozzles 96*a* and 96*h* so as not to form air flow C4. As a result, concerning the stacked recording papers P, the separating region 141 as indicated by the shaded area in FIG. 45 is realized, and a favorable separating action is realized for the recording papers P of small size.

On the other hand, when the selected recording paper P is relatively large in size, for example, width L6 as shown in FIG. 46, if the air flow C4 is not formed, only the separating region 141 by the nozzles 96*b* to 96*g* indicated by shaded are in FIG. 46 is formed, and separation may be defective in the case of large-sized recording paper P, and duplicate feed or other trouble may occur. Therefore, in this embodiment, when the selected recording paper P is relatively large in size, the electromagnetic solenoid 193*a* is de-excited by the control of the CPU 132, and the valve bodies 188 and 189 move and return in the direction of arrow E4 to the position shown in FIG. 44. In consequence, the nozzles 96*a* and 96*h* are fully open, and the air flow C4 is formed. As a result, the separating region 142 far wider than the separating region 141 is formed, and a favorable separating action is realized in large-sized recording papers P.

Figure 47:
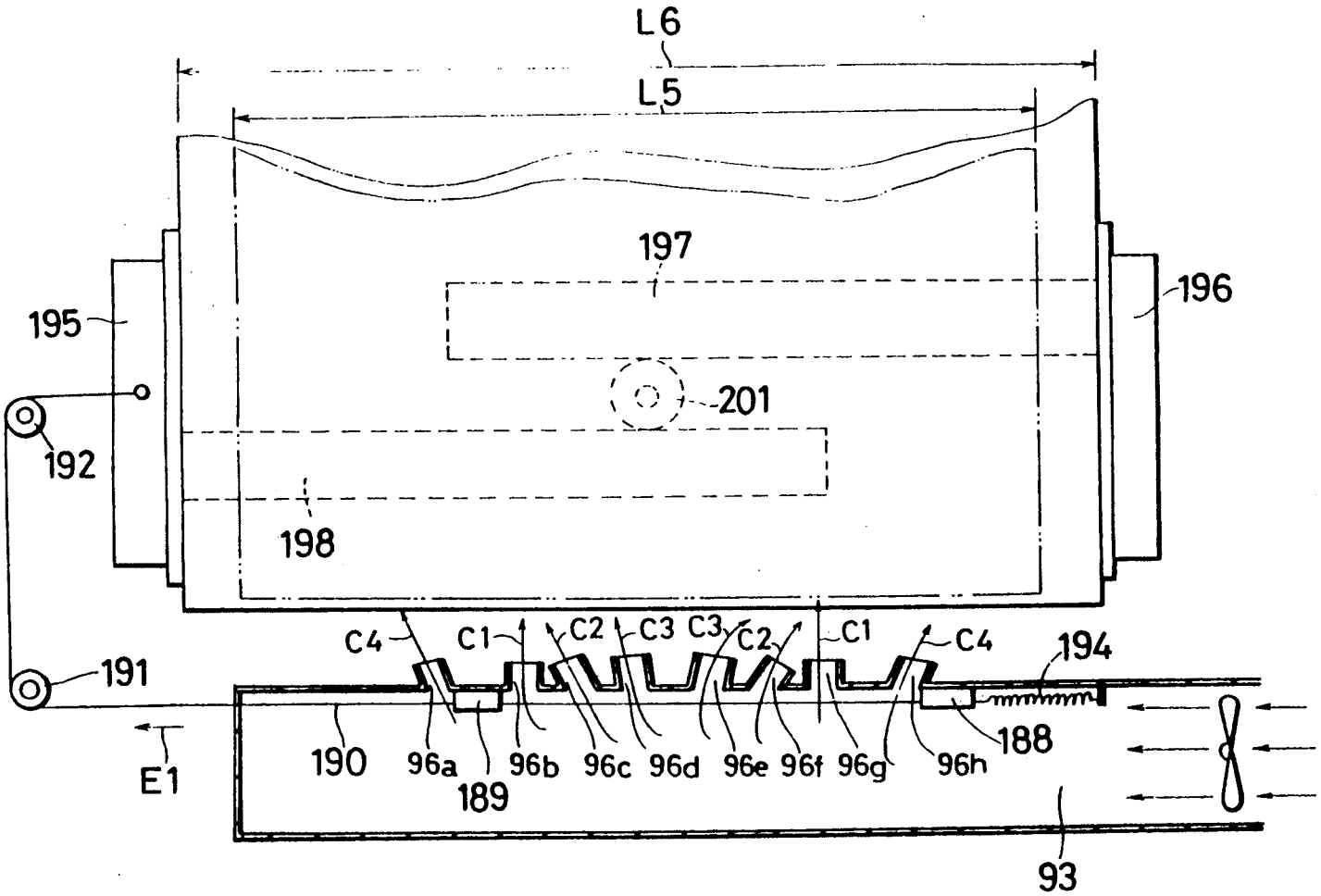
FIG. 47 is a plan view showing other constitution of the embodiment.

FIG. 47 is sectional view showing another constituent example of the nozzle member 93 in the feeding unit 21. This embodiment is similar to the foregoing embodiments, and the corresponding parts are identified with the same reference numbers. In this embodiment, too, the valve bodies 188 and 189 are arranged in the nozzle member 93 in the same configuration as in the preceding embodiment, and the wire 190 mutually connects the vale bodies 188 and 189, and is connected to either one of the lateral end defining members 195 or 196 though the pulleys 191 and 192. In this embodiment, it is connected to the lateral end defining member 195.

The lateral end defining members 195 and 196 are respectively fixed to the driving member 197 and 198 forming racks 199 and 200 at the mutually confronting sides as explained by reference to FIG. 31, and the racks 199 and 200 are engaged with the pinion 201 disposed between them mutually from the opposite sides. Therefore, the lateral end defining members 195 and 196 are interlocked with each other by the driving member 197 and 198, and pinion 201, and when the one side is moved outward in the widthwise direction manually, for example, the other side also moves outward in cooperation.

That is, in this embodiment, as far as the lateral end defining members 195 and 196 are spaced at a distance L6 corresponding to the large-sized recording papers P, the valve bodies 188 and 189 are in the position not to shield the nozzles 96*a* and 96*g*, and a favorable separating action is effected on the recording paper P of large size as explained by reference to FIG. 43.

Incidentally, using a relatively small recording paper P, when the lateral end defining members 195 and 196 mutually approach to have a spacing of width L5, the wire 190 is pulled in the direction of arrow E3, resisting the spring force of the spring 194, and the valve bodies 188 and 189 shield the nozzles 96*a* and 96*h*. Hence, even in the case of relatively small recording paper P, a favorable separating action is realized as explained by reference to FIG. 42.

Figure 48:
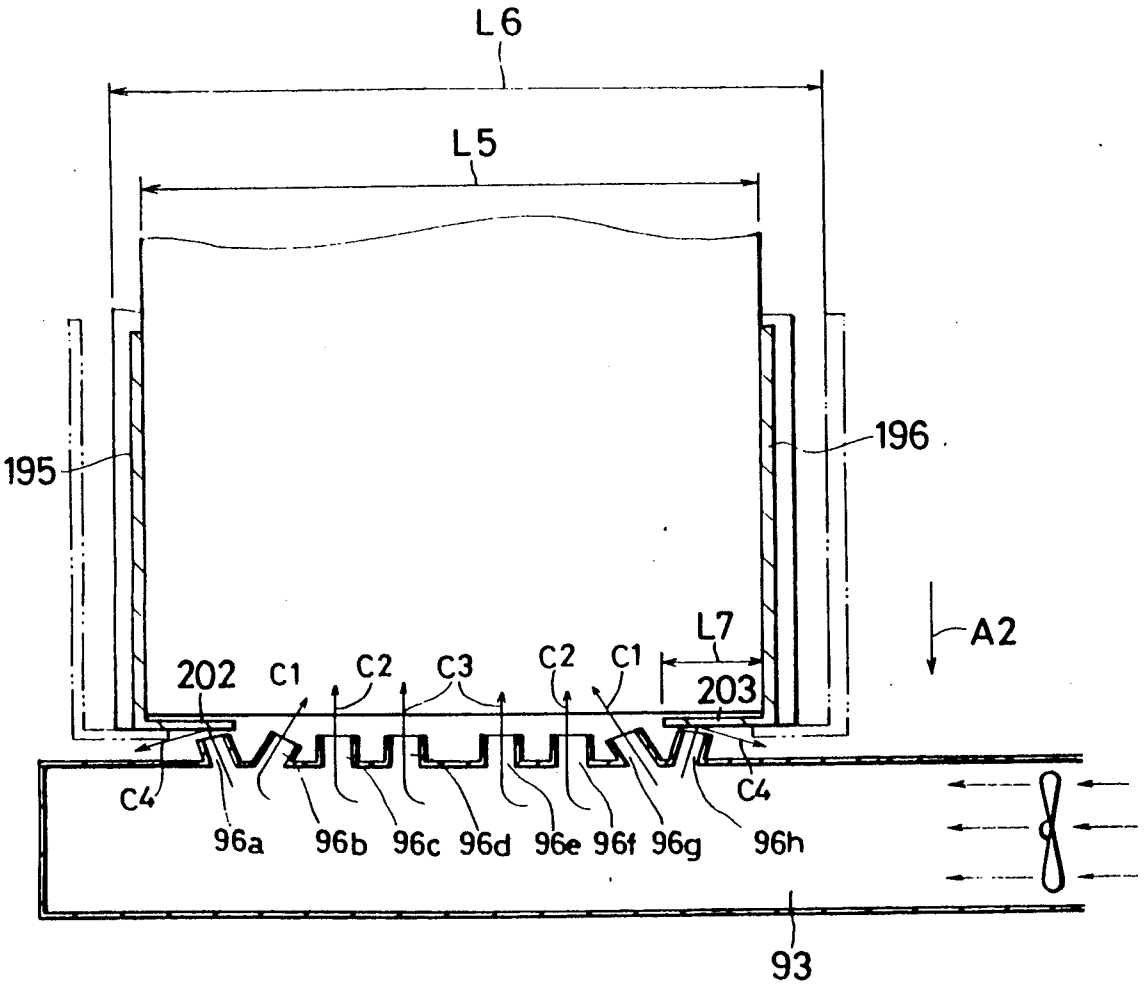
FIG. 48 is a sectional view showing a different constitution of the embodiment.
Figure 49:
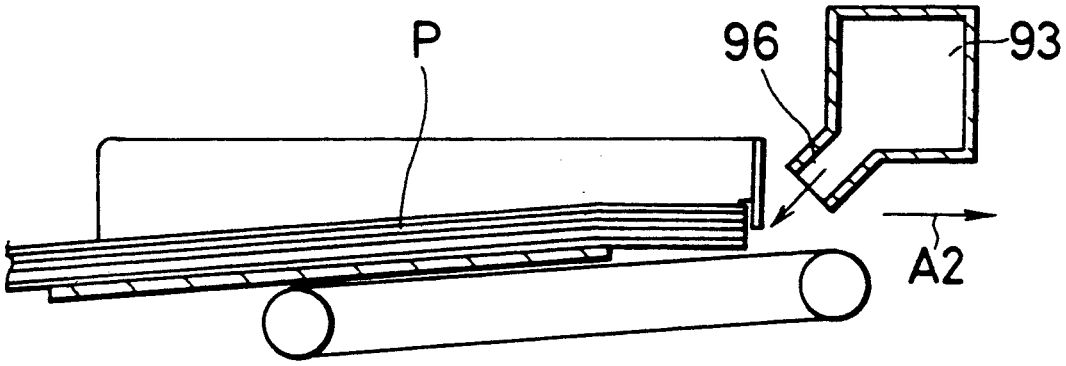
FIG. 49 is a side view of the embodiment.

FIG. 48 is a plane view showing a sectional view of a further different constitutional example around the nozzle member 93, and FIG. 49 is a front view of FIG. 48. This embodiment is similar to the foregoing embodiments, and the corresponding parts are identified with same reference numbers. In this embodiment, at the downstream end part of the feeding direction A2 of the lateral end defining plates 195 and 196, there are shielding pieces 202 and 203 extending mutually in the widthwise direction. When the lateral end defining plates 195 and 196 are space at a width L5 corresponding to the small-sized recording paper, the nozzles 96*a* and 96*h* of the nozzle member 93 are shielded by the shielding pieces 202 and 203, respectively, and the air flow C4 directed to the recording papers P is shielded.

On the other hand, when the lateral end defining plates 195 and 196 are spaced at a width L6 corresponding to the large-sized recording papers P, the nozzles 96*a* and 96*h* are not shielded by the shielding pieces 202 and 203, and are fully open. Besides, the length L7 in the widthwise direction of the shielding pieces 202 and 203 is determined to freely open or close the nozzles 96*a* and 96*h* on the basis of the difference of the gap of the lateral end defining members 195 and 196.

In such embodiment, too, the nozzles 96*a* and 96*h* may be opened or closed depending on the size of recording paper, and the same effect as in the foregoing embodiments may be attained.

Figure 50:
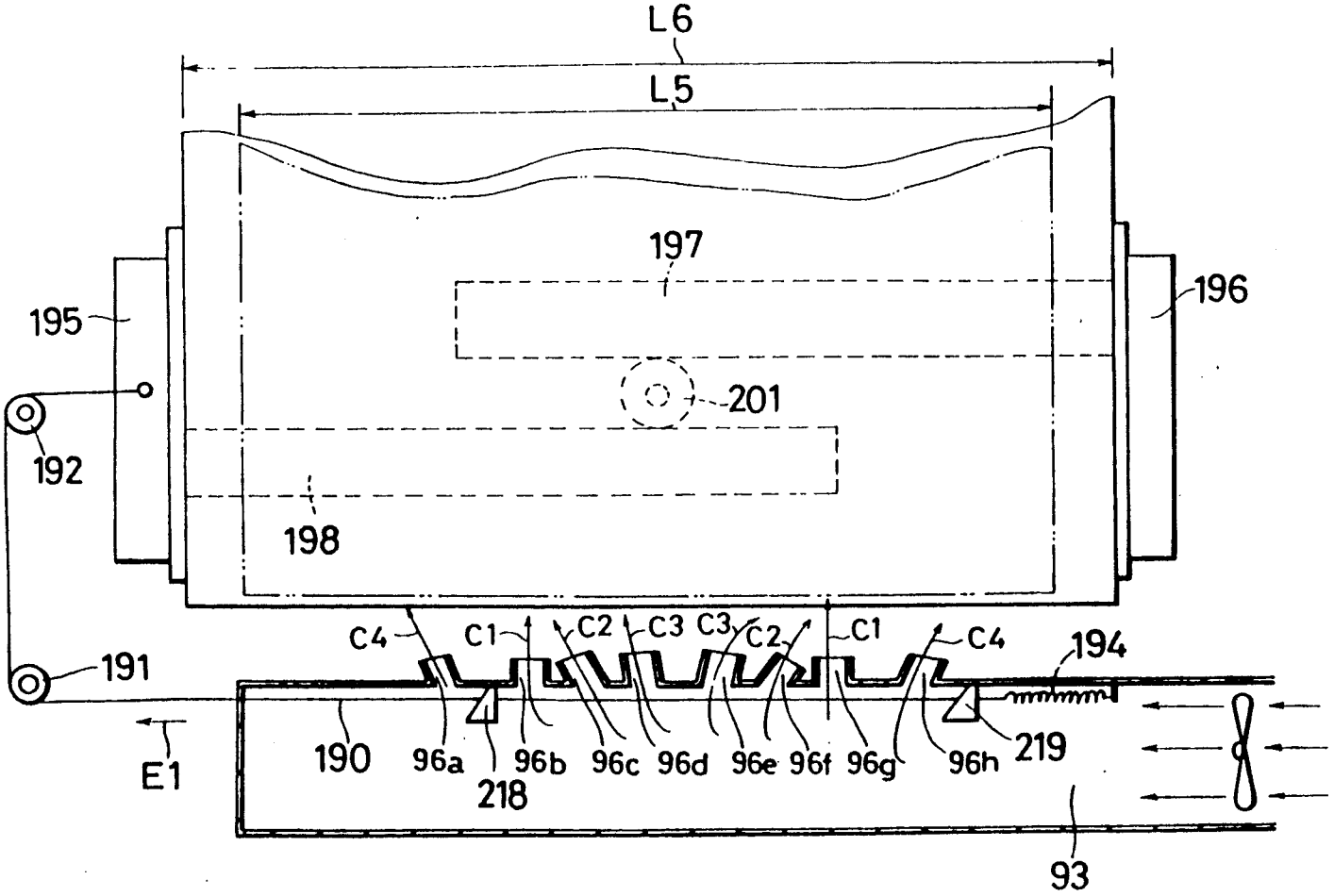
FIG. 50 is a sectional view showing other constitution of the embodiment.

FIG. 50 is a plan view showing a sectional view of another different constitutional example around the nozzle member 93. This embodiment is similar to the foregoing embodiments, and the corresponding parts are identified with the same reference numbers. In the preceding embodiment, the valve bodies 188 and 189 are disposed in the nozzle member 93 realized the action of changing over the nozzles 96*a* and 96*c* between shielding and full opening. The feature of this embodiment is that valve bodies 127 and 218 are disposed in the nozzle member 93, and that the shape of the valve body is 217 and 218 is designed so as not to completely shut off the nozzles 96*a* and 96*h* even if the electromagnetic plunger 193*a* is actuated as mentioned above. As a result, the air flow C4 generated by the nozzles 96*a* and 96*h* is designed to vary between the maximum flow rate and the intermediate flow rate determined by the half open state mentioned above. By properly setting the intermediate flow rate, the same effect as in the preceding embodiments may be achieved.

Figure 51:
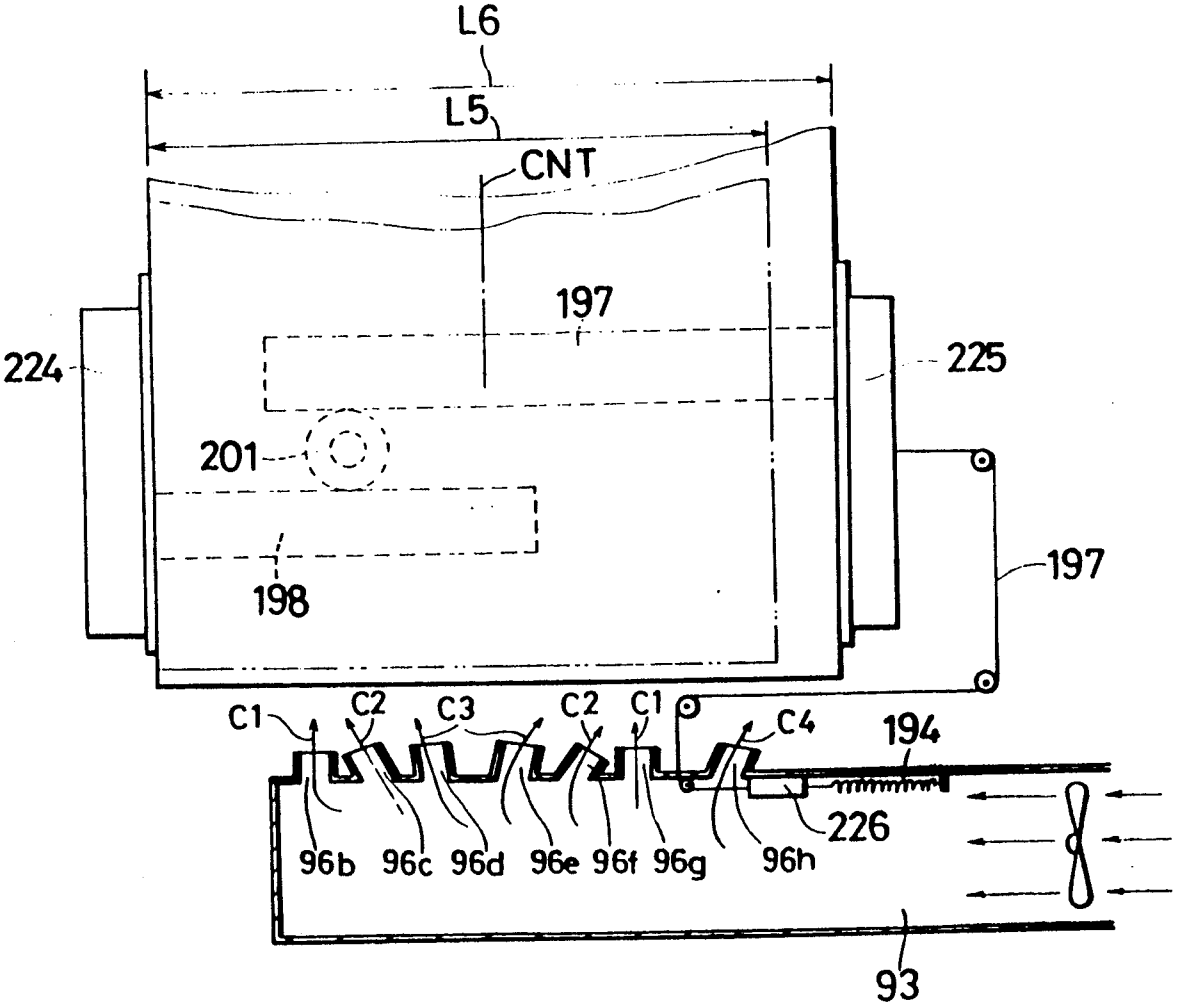
FIG. 51 is a sectional view showing other constitution of the embodiment.

FIG. 51 is a sectional view showing a further different constituent example of the nozzle member 93. This embodiment is similar to the foregoing embodiments, and the corresponding parts are identified with the same reference numbers. In the preceding embodiments, it is designed to match the widthwise central position of the recording paper is matched with the widthwise central position CNT of the laying plates 45 and 149, while the present embodiment is characterized by that one end in the widthwise direction of the recording paper is matched with one end in the widthwise direction of the laying plates 45 and 149. Therefore, the fixed side lateral end defining plate 224 is disposed at one end in the widthwise direction of the laying plates 45 and 149, while the movable lateral end defining plate 225 is disposed at the other end. Accordingly, the valve body 226 disposed in the nozzle member 93 is selected in the shape of opening and closing the nozzle 96*h* around the lateral end part of the configuration of the lateral end defining plate 225 of the nozzle member 93. In such embodiment, too, the same effect as in the preceding embodiments will be achieved.

Incidentally, the nozzles 96*a*, 96*d*, 96*e* and 96*h*, the nozzle hole 175*c*, and handling nozzles 187*a*, 187*d*, 187*e* and 187*h* in the foregoing embodiments may not be always employed from the viewpoint of the important aspect of the invention, and even such cases are included in the tue spirit of the invention. Meanwhile, the protrusions 107*a*, 107*b*; 167*a*, 167*b*; 206 and 207 are not limited to the shape continuous on a straight line, but may be formed in a shape of single projection of circular head, for example, and a plurality of such protrusions may be composed along the feeding direction A2. In the preceding embodiments, it is composed so that the recording paper may be attracted to the feeding stretch belts 46*a*to 46*c*, 157*a* to 157*d* and 208, in a range exceeding the attracting region 108, and that the air flow for separation is once injected to a remote position preliminarily to the downstream side in the feeding direction from the downstream side end part of the feeding direction A2 of the recording paper as mentioned above, thereby the reflected flow acts to separate the recording papers. As other example of the invention, for example, when the recording paper is relatively small in size, it may be also designed that the recording paper may be exposed, not covered, near the downstream side end portion of the attracting region 108. In such a case, the air flow for separating is attracted into the attracting region 180, and the flow rate is suppressed. Therefore, scatter of the small-sized recording paper by the air flow of large flow rate may be avoided. In the case of recording papers of relatively large size or larger weight, it is enough to suck as in the preceding embodiment.

In other embodiment of the invention, the ends of one side in the widthwise direction of sheets may be stacked up on the laying plate, and the papers may be fed in this end aligned state.

Furthermore, in a different embodiment of the invention, the rear end defining members 58 and 152 may be designed to detect the size of the sheets (that is, width or length) or the pile of the stack by detecting means, thereby driving to displace forward or backward in the feeding direction.

The invention may be applied in a wide range, not only for feeding the recording papers of copying machine, but for feeding the recording papers of a printer, or feeding other sheets than recording papers.

The invention may be modified in a range not departing from the scope of the claims thereof, easily by those skilled in the art, and such modifications and changes are embraced within the true spirit of the invention.

A further difference embodiment of the invention is described as follows while referring to FIGS. 52 and 55.

The intermediate tray relating to this embodiment is incorporated in an electrostatic transfer type copying machine capable of performing reversal copy and/or synthetic copy, or electrophotographic apparatus such as laser printer. This electrophotographic apparatus possesses a photosensitive material for forming a visible image by depositing a toner on an electrostatic latent image exposed through an optical system which is not shown in the drawing, and a transfer changer for transferring the visible image formed on the photosensitive material onto a recording paper is disposed closely to the photosensitive material.

The recording paper is designed to pass through the transfer unit formed between the transfer charger and the photosensitive material, and this transfer part forms a part of a circulating route capable of conveying the recording paper which has once passed, back to the transfer unit again. The recording paper passing once through the transfer unit is conveyed to the fixing unit, and this fixing unit is designed to fix a visible image by compressing the recording paper by a pair of heated rollers.

Figure 52:
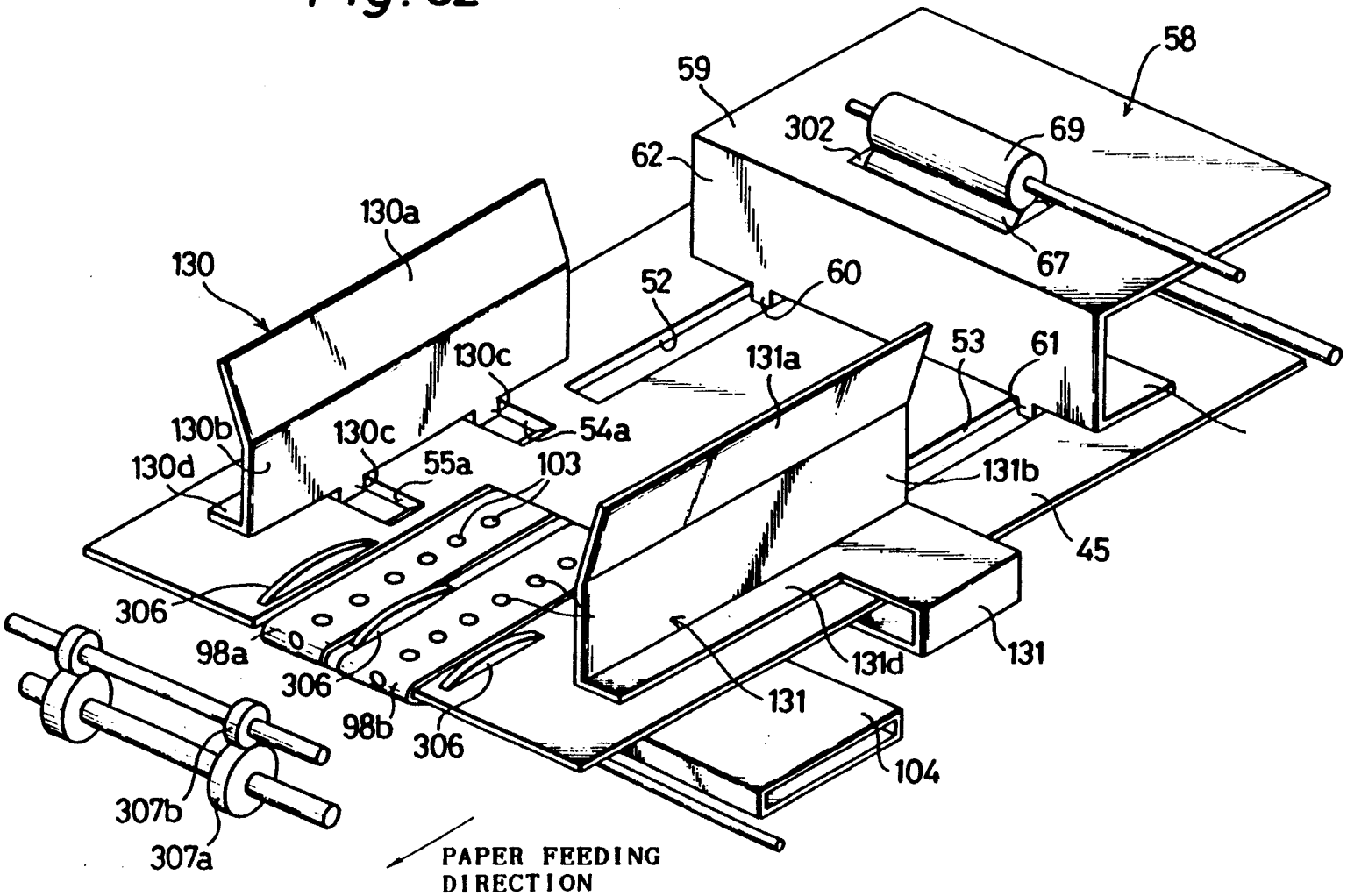
FIG. 52 is a perspective view of an intermediate tray in other embodiment of the invention.

The circulating route comprises rollers such as conveying rollers for conveying the recording paper, inverting claw for correcting the running direction of the recording paper, a switchback unit for inverting the recording paper, and intermediate tray for temporarily storing the recording paper on which the visible image is transferred on one side, among others, and the intermediate tray possesses a stack tray 45 for mounting the recording paper as shown in FIG. 52.

The stack tray 45 has a pair of rear end plate defining grooves 52 and 53 possessing a longitudinal direction matched with the longitudinal direction which is the feeding direction of the stack tray 45, and also comprises a pair of matching plate defining grooves 55*a*, 55*b*; 54*a* and 54*b* possessing a longitudinal direction matched with the widthwise direction of the stack tray 45, symmetrically on the right and left sides as seen from the paper feeding direction. On the top of the stack tray 45 forming the rear end plate defining grooves 52 and 53, there is a rear end plate 58 which is moved by a driving member such as stepping motor not shown in the drawing, and contacts against the rear end of the recording paper to define the rear end position. Meanwhile, the rear end of the recording paper refers to the end of the other side when the end of the running direction side is supposed to be the front end, with respect to the feeding direction indicated by the arrow.

The rear end plate 58 comprises an upper surface 59 which prevents distortion of the recording paper by contacting against the lower side of the recording paper conveyed onto the stack tray 45, and a lower surface 301 which supports the side surface 62 contacting against the rear end of the recording paper, and the rear end plate 58 by contacting against the upper surface of the stack tray 45. An opening 302 is formed in the upper surface 59, and a pair of conveying rollers 69 and 67 are disposed vertically in this opening 302 across the upper surface 59. These conveying rollers 69 and 67 are designed to match the conveying direction of the recording paper in the longitudinal direction of the stack tray 45 as the axial center coincides with the widthwise direction of the stack tray 45.

At the lower end of the side part 62, protrusions 60 and 61 to be fitted with the rear end plate defining grooves 52 and 53 are formed, and these protrusion 60 and 61 ar designed to define the direction by the rear end plate defining grooves 52 and 53. Hence, the moving direction of the rear end plate 58 is always matched with the longitudinal direction of the stack tray 45, same a the conveying direction of the recording paper.

On the top of the stack tray 45 on which matching plate defining grooves 54*a* to 55*b* are formed, there are a pair of matching plates 130 and 131 for defining the lateral end position by contracting against the lateral ends of the recording paper. These matching plates 130 and 131 possess opening bent parts 130*a* and 131*a* bent in the opposite direction of the confronting matching plates 131 and 130, and these opening bent parts 130*a* and 131*a* are designed to store the recording paper between the matching plates 130 and 131 even when the recording paper conveyed by the conveying rollers 69 and 67 is slightly deviated in position.

At the lower end portion of the opening bent parts 130*a* and 131*a*, side faces 130*b* and 131*b* contracting against the lateral ends of the recording paper stored between the matching plates 130 and 131 are formed. At the lower end potion of these side faces 130*b* and 131*b*, there are protrusions 130*c* and 131*c* to be fitted with the matching plate defining grooves 54*a* and 55*b*, and the matching plates 130, 131 are designed to define the moving direction together with the matching plate defining grooves 54*a* to 55*b*. Furthermore, at the lower end portion of the side faces 130*b* and 131*b*, lower surfaces 130*d* and 131*d* for supporting the matching plates 130 and 131 are formed, and these lower surfaces 130*d* and 131*d* have moving support parts 130*e* and 131*e* formed at the end of one direction of the rear end plate, in a pi-form enclosing the stack tray 45 in three directions.

Figure 53:
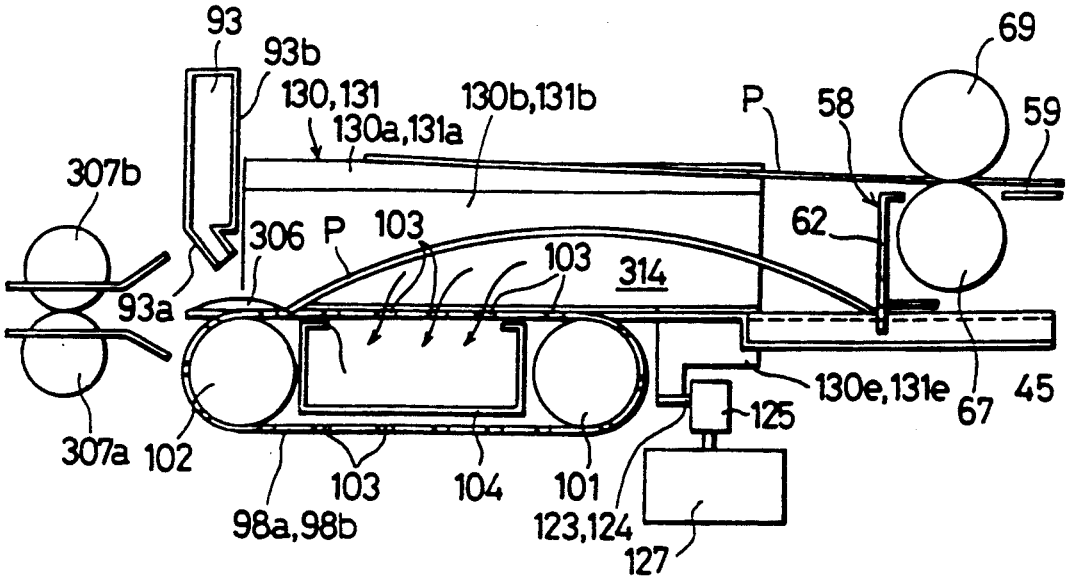
FIG. 53 is an explanatory drawing showing the state of conveyance of recording paper into the intermediate tray as seen from the widthwise direction side.

The moving support parts 130*e* and 131*e* possess rack parts 123 and 134 coinciding with the widthwise direction of the stack tray 45 beneath the stack tray 45 as shown in FIG. 53, and the rack parts 123 and 124 contact against the pinion 125 disposed in the driving member 127 of stepping motor or the like. Hence, the matching plates 130 and 131 are positioned depending on the paper size of the recording paper P by the rotation of the driving member 127.

The stack tray 45 is also provided with a pair of attracting belts 98*a* and 98*b* (collectively 98) as shown in FIG. 52 at the front end side of the paper feeding direction, and multiple attracting holes 103 . . . are opened in these attracting belts 98*a* and 98*b*. At the side of the attracting belts 98, protrusions 306 . . . formed in a curve shape on the top are formed in the stack tray 45, and these protrusions 306 . . . are formed at a higher position than the attracting belts 98 in the upper surface level so a to contact against the lower side of the recording paper P. Consequently, the recording paper P is, a seen from the feeding direction side, formed in a corrugated shape by means of the protrusions 306 . . . and attracting belts 98. These protrusions 306 . . . may be also formed by rotary bodies rotatable in the feeding direction.

The attracting belts 98 are stretched by belt rollers 101 and 102 rotated by a motor or the like, not shown, as shown in FIG. 53, and attracting ducts 104 having openings 106 on top are formed in these belt rollers 102 and 102. Accordingly, the air in the space 314 formed between the stack tray 45 and the recording paper P curved downward at both ends is extracted through the attracting ducts 104 through attracting holes 103 . . . of the attracting belts 98 as indicated by the arrow.

Besides, above the belt roller 102, a blow duct 93 for blowing air to the recording paper P is disposed, and the side face 93*b* of this blowing duct 93 is set lower than the opening bent parts 130*a* and 131*a* of the matching plates 130 and 131 at the lower end part. At one end of the flowing duct 93, a blower is connected which is not shown, while a nozzle 93*a* for blowing out air sent from the blower is formed at the other end. The air blowing direction of the nozzle 93*a* is set in the end direction of the recording paper P, and the recording papers P are separated by the air blown out of the nozzle 93*a*. At the feeding direction side of the stack tray 45 for mounting the recording paper P, there are a pair of feed rollers 307*a* and 307*b* for holding the recording paper P conveyed by the attracting belt 98.

The air blown out of the blowing duct 93 is controlled by the control means (not shown) in the blowing timing, and this timing is set so as to start blowing action from the blowing duct 93 after start of the attracting action by the attracting duct 140 and the like. This series of actions are to be executed by the control program stored in the control means, and this control program is designed to execute, aside from the above timing control, the rotation control of the attracting belt 98, position control of the rear end plate 58, matching plates 130 and 131 and the like.

In this constitution, the operation of the intermediate tray is described below.

First, the control means not shown herein recognizes the size of the first recording paper, and moves the rear end plate 58 and matching plates 130 and 131 to the position corresponding to the paper size a shown in FIG. 52. Afterwards, as shown in FIG. 52, the recording paper P having a visible image formed on one side thereof is held by the conveying rollers 69 and 67, and is sent out above the stack tray 45.

The recording paper P, when sent out from the conveying rollers 69 and 67, contact against the side face 93*b* of the blowing duct 93, and drops in the direction of the stack tray 45. At this time, the recording paper P easily stops into the stack tray 45 along the matching plates 130 and 131, even if slightly deviated in the send-out direction, because the width of the opening bent parts 130*a* and 131*a* of the matching plates 130 and 131 is set larger than the width of the recording paper P. Accordingly, the recording paper P is defined at the end part in the longitudinal direction by the side part 93*b* of the blowing duct 93 and the rear side part 62 of the rear end plate 58, while the end of the widthwise direction of the recording paper P is defined by the side faces 130*b* and 131*b* of the matching plates 130 and 131.

The recording paper P is heated in the fixing unit (not shown) when fixing the visible image, and this heating causes the recording paper P to curl. This curling is particularly large when the texture direction of the recording paper P runs at right angle to the fixing unit. The curled recording paper P contacts against the stack tray 45 only at the both ends, and is stacked up while forming a space 314 between the recording paper P and the stack tray 47.

Next, when feeding the recording paper P, first the attracting duct 104 is decompressed to remove air from the space 314 through the attracting belt 98, which is the attracting process. At this time, since the both lateral ends of the recording paper P are contacting against the matching plates 130 and 131, the air tightness of the space 314 is increased, and it is attached to the attracting belt 98 efficiently. Later, air is blown out of the blowing duct 93, which is the blowing process. The air-blown recording papers P are separated into the recording paper P contacting against the stack tray 45 in the lowermost layer and the recording paper P stacked up in the recording paper P. At this time, since the space 314 is eliminated by the attracting process, the blown air does not enter the space 314. Therefore, the recording papers P are not scattered about by the blowing action.

When the recording papers P are separated by air, the attracting belt 98 begins to rotate through the belt rollers 101 and 102. At this time, the entire surface of the recording paper P is contacting against the stack tray 45 and attracting belt 98. Therefore, the recording paper P at the front end side of the feeding direction contacts against the attracting belt 98 and protrusions 306 . . . , so as to be formed in a corrugated profile as seen from the feeding direction side. Hence, since the top and bottom of the corrugation are formed parallel to the feeding direction, the recording paper P is reinforced in the feeding direction, so that the recording paper P may reach the feed rollers 307*a* and 307*b*, without being bent, in the process of conveyance by the attracting belts 98.

On the other hand, the recording paper P put on the stack tray 45 may be curled as the both lateral ends contact against the stack tray 45. In this case, as the rear end of the recording paper P and thee lateral part 62 of the rear end plate 58 contact against each other, the airtightness of the space 314 is enhanced. Therefore, the space 314 is efficiently eliminated by the attracting action, and the recording paper P reaches the feed rollers 307*a* and 307*b*, without being bent at the attracting belts 98 and protrusions 306 . . . , same as in the case of the recording paper P curved at the front and rear ends mentioned above.

Thus, the intermediate tray of the invention is designed to execute the blowing action after executing the attracting action. At this time, at the recording paper P contacts against the rear end plate 58 and matching plates 130 and 131 at the end part, the airtightness of the space 314 is enhanced, and this high airtightness makes it easier to eliminate the space 314 by the attracting action. Therefore, since the blown air does not enter the space 314, scattering of recording papers P by blowing action may be prevented.

Furthermore, the recording paper P attracted by the attracting belts 98 contacts against these attracting belts 98 and protrusions 306 . . . , and it is formed in a corrugated profile as seen from the feeding direction. Therefore, this corrugated recording paper P is reinforced in the feeding direction so as to reach the feed rollers 307*a* and 307*b* without being bent, thereby preventing bending or defective biting at the curled portions.

Figure 54:
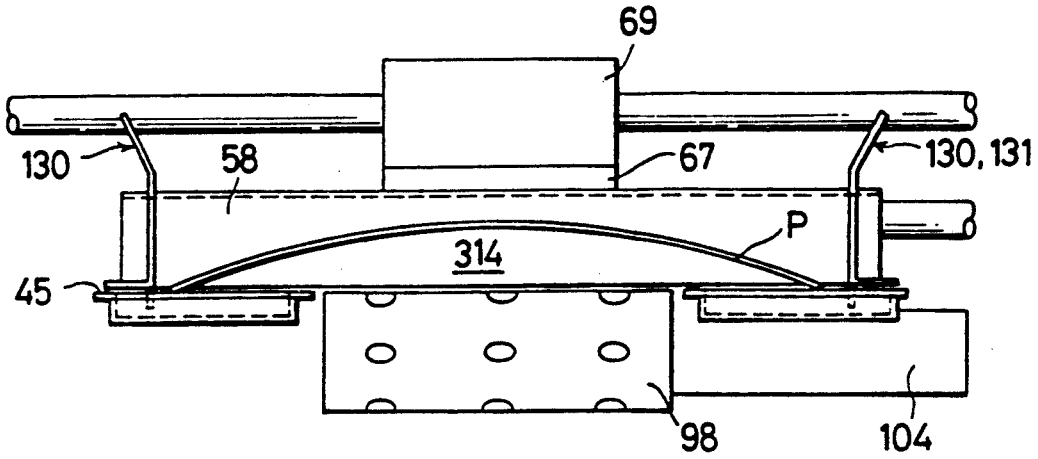
FIG. 54 is an explanatory drawing for showing the conveyed state of recording paper in the intermediate tray as seen from the paper feeding direction side.

The protrusion 306 . . . of the embodiment are particularly effective when the recording paper P is curled at its front end and rear end contact against the stack tray 45, and as shown in FIG. 54, in the case of the recording paper P having curls as the both lateral ends contact against the stack tray 45, only the attracting belts 98 may be formed in the intermediate tray.

Figure 55:
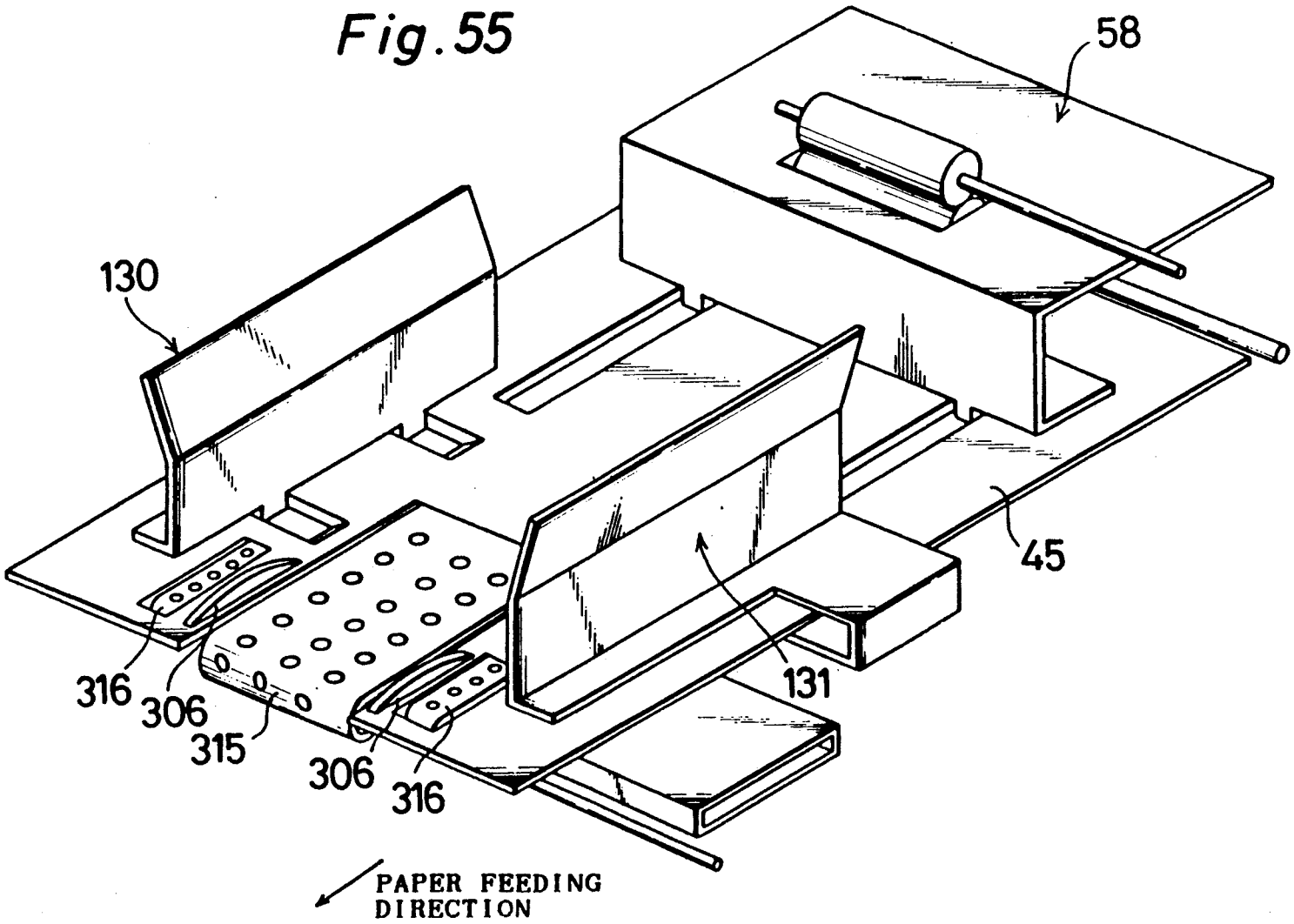
FIG. 55 is a perspective view of the intermediate tray.

Moreover, the intermediate tray may comprise, as shown in FIG. 55, the protrusions 306 and attracting belts 316 and 316, arranged in this order, at both right and left sides of the attracting belt 315. In this case, since the both lateral end parts are attracted by the attracting belts 316 and 316, it is particularly effective when feeding the recording paper P curled upward at both lateral ends.

The invention may be embodies in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet feeding apparatus comprising:

(a) a laying plate having a centerline running in a feeding direction, for receiving a stack of sheets (b) a feeding means for feeding a sheet to be fed from the stack, the feeding means located adjacent to the position of the sheet to be fed and (c) an air stream forming means for injecting air from plural positions in directions directed outwardly from the centerline of the laying plate and in directions toward the feeding means and in directions toward the position of sheets in the laying plate, the air forming means being disposed downstream from the laying plate in the feeding direction, and (d) an air stream flow rate control means for controlling the air flow based on the sheet size to provide a separating action between the sheet to be fed and the remainder of the sheets.

2. A sheet feeding apparatus of claim 1, wherein the air stream forming means comprises a nozzle member for injecting air from at least one nozzle hole disposed for each of the air steams, and the air stream flow rate control means comprises:

a valve for opening and closing the nozzle hole, having a movable valve body and an opening and closing driving means for moving the valve body relative to the nozzle hole to regulate the air stream flow rate from the nozzle hole.

3. A sheet feeding apparatus of claim 1, in which the laying plate is mirror-symmetric with respect to a plane passing through the centerline of the laying plate, wherein the air stream forming means injects said plural air streams in symmetrical positions with respect to the plane, and the air stream flow control means controls simultaneously the flow rate of outward air streams in the widthwise direction of the air stream.

4. A sheet feeding apparatus of claim 3, wherein the laying plate possesses a nearly horizontal central laying part and side laying parts extending to both sides in the widthwise direction from the centerline, an end portion of the central laying part which is located at the downstream side in the feeding direction has a notch and the feeding means for feeding the sheet to be fed faces the notch, and the air stream forming means comprises a first air stream injected toward the boundary of the central laying part and a side laying part of the laying plate and a second air stream injected outwardly toward both side laying parts in a widthwise direction of the laying plate, and the air stream control means controls air flow rate in the second air stream.

5. A sheet feeding apparatus of claim 1, wherein the feeding means is above the top sheet in the stack of sheets, and means for injecting air for lifting sheets is disposed toward an end portion at the downstream side in the feeding direction of the stack sheets.

6. A sheet feeding apparatus comprising:

(a) a laying plate for receiving a stack of a plurality of individual sheets, (b) a feeding means for a sheet to be fed from the stack, the feeding means located adjacent to the position of the sheet to be fed, (c) an air stream forming means for injecting air from plural positions in widthwise directions of the laying plate and in directions toward the feeding means and in directions toward the position of sheet in the laying plate, the air forming means being disposed downstream from the laying plate in the feeding direction, and (d) an air stream flow rate control means for controlling the air flow based on sheet size to provide a separating action between the sheet to be fed and the remainder of the sheets, which flow rate control means comprises a valve for opening and closing the nozzle hole, having a movable valve body and an opening and closing driving means for moving the valve body relative to the nozzle hole to regulate the air stream flow rate from the nozzle hole and which driving means comprises:

a plunger coupled with the valve, and an electromagnetic solenoid for driving the plunger.

7. A sheet feeding apparatus of claim 6, wherein further comprises detecting means for detecting the size of the sheets in a widthwise direction, and control means for controlling the electromagnetic solenoid in response to the output of the detecting means to regulate the air stream flow rate from the nozzle hole based upon the width of the sheet.

8. A sheet feeding apparatus of claim 6, which also comprises a lateral end defining member movable in the widthwise direction relative to the sheets to align the lateral ends of the sheets stacked on the laying plate, wherein the opening and closing means cooperates with the lateral end defining member and regulates the air stream flow rate from the nozzle hole based upon the width of the sheet.

9. A sheet feeding apparatus comprising:

(a) a laying plate for receiving a stack of a plurality of individual sheets, (b) a feeding means for feeding a sheet to be fed from the stack, the feeding means located adjacent to the position of the sheet to be fed, (c) an air stream forming means for injecting air from plural positions in widthwise directions of the laying plate and in directions toward the feeding means and in directions toward the positions of sheets in the laying plate, the air forming means being disposed downstream from the laying plate in the feeding direction, and (d) an air stream flow rate control means for controlling the air flow based on sheet size to provide a separating action between the sheet to be fed and the remainder of the sheets furthermore comprises a lateral end defining member movably in the widthwise direction relative to the sheets to align the lateral ends of the sheets stacked up on the laying plate, wherein the air stream forming means possesses a nozzle member for injecting air from at least one nozzle hole disposed for every air stream, and the lateral end defining member has shut-off piece located opposite to the air injection end of the nozzle hole.

10. A sheet feeding apparatus suitable for an electrophotographic apparatus capable of performing composite copy and two-sided copy in which plural sheets are temporarily stored in a circulating route which feeds the lowermost sheet while separating the sheets by blowing air to the stored sheets, wherein the sheet feeding apparatus comprises a stack tray for laying sheets on comprising bilateral end defining members comprising a pair of matching plates having lateral sides for contacting both side ends of the sheets on said stack tray when moved in a widthwise direction of the stack tray, and a rear end defining member comprising a rear end plate having a lateral part for contacting the rear end of the sheets on said back tray when moved in the paper feeding direction, and said stack tray further comprises attracting means comprising attracting belt and attracting duct having attracting holes for conveying the sheet in the feeding direction while attracting the sheet in the stack tray direction, and protrusions positioned above the surface of the attracting means which protrusions provide for contact against the sheet at front end side in the feeding direction, wherein the attracting means operates prior to the blowing action.

* * * * *